US005942384A

United States Patent [19]

Arai et al.

[11] Patent Number: 5,942,384

[45] Date of Patent: Aug. 24, 1999

[54] SILVER HALIDE PHOTOGRAPHIC MATERIALS AND METHOD FOR PROCESSING THE SAME

[75] Inventors: Tsutomu Arai; Koichi Kuno; Yasuhiro Okamoto; Shuzo Suga, all of Kanagawa, Japan

[73] Assignee: Fuji Photo Film Co., Ltd., Kanagawa, Japan

[21] Appl. No.: 08/480,946

[22] Filed: Jun. 7, 1995

Related U.S. Application Data

[63] Continuation of application No. 08/243,003, May 16, 1994, abandoned, which is a continuation of application No. 07/871,749, Apr. 21, 1992, abandoned.

[30] Foreign Application Priority Data

| | | | |
|---|---|---|---|
| Apr. 22, 1991 | [JP] | Japan | 3-116573 |
| Apr. 22, 1991 | [JP] | Japan | 3-116611 |
| Apr. 25, 1991 | [JP] | Japan | 3-121798 |
| Apr. 30, 1991 | [JP] | Japan | 3-124655 |
| May 8, 1991 | [JP] | Japan | 3-131590 |
| Jul. 4, 1991 | [JP] | Japan | 3-189532 |

[51] Int. Cl.[6] ..... G03C 1/09

[52] U.S. Cl. ..... 430/603; 430/600; 430/567

[58] Field of Search ..... 430/600, 603, 430/605, 614, 567, 607, 611

[56] References Cited

U.S. PATENT DOCUMENTS

| | | | |
|---|---|---|---|
| 3,901,713 | 8/1975 | Yamasue et al. | 430/605 |
| 4,198,240 | 4/1980 | Mikawa | 430/603 |
| 4,770,961 | 9/1988 | Tanaka et al. | 430/576 |
| 4,839,263 | 6/1989 | Miyoshi et al. | 430/605 |
| 4,983,509 | 1/1991 | Inoue et al. . | |
| 5,112,733 | 5/1992 | Ihama | 430/603 |
| 5,320,937 | 6/1994 | Ihama | 430/603 |

FOREIGN PATENT DOCUMENTS

| | | | |
|---|---|---|---|
| 0132806 | 2/1985 | European Pat. Off. . | |
| 0330401 | 8/1989 | European Pat. Off. . | |
| 0336426 | 10/1989 | European Pat. Off. . | |
| 0421452 | 4/1991 | European Pat. Off. . | |
| 457298 | 11/1991 | European Pat. Off. | 430/604 |
| 2611037 | 10/1976 | Germany . | |
| 2632202 | 2/1977 | Germany . | |
| 1170937 | 7/1989 | Japan . | |
| 1154236 | 6/1969 | United Kingdom . | |
| 1527435 | 10/1978 | United Kingdom | 430/603 |

*Primary Examiner*—Mark F. Huff

*Attorney, Agent, or Firm*—Sughrue, Mion, Zinn, Macpeak & Seas, PLLC

[57] ABSTRACT

A silver halide photographic material is disclosed, comprising a support having thereon at least one light-sensitive silver halide emulsion layer, wherein at least 30 mol % of silver halide grains contained in the emulsion of the emulsion layer are silver chloride, the emulsion contains not more than $1\times10^{-6}$ mol per mol of silver of a rhodium compound and/or not more than $1\times10^{-5}$ mol per mol of silver of an iridium compound, and the silver halide grains have been selenium-sensitized. There is also disclosed a method for processing the silver halide photographic material.

8 Claims, No Drawings

SILVER HALIDE PHOTOGRAPHIC MATERIALS AND METHOD FOR PROCESSING THE SAME

This is a Continuation of application Ser. No. 08/243,003 filed May 16, 1994, now abandoned, which is a Continuation of application Ser. No. 07/871,749 filed Apr. 21, 1992 and now abandoned.

FIELD OF THE INVENTION

This invention relates to a silver halide photographic material, and more particularly to a silver halide photographic material which has high sensitivity and high contrast under the high-intensity short-time exposure conditions. Yet there is scarcely a change in sensitivity even when the compositions of developing solutions are changed. Moreover, the photographic material is excellent in handleability under safelight safety lamp, has high stability with the passage of time and can be rapidly processed. The invention also relates to a method for processing the photographic material.

BACKGROUND OF THE INVENTION

One known method for exposuring photographic materials is an image forming method using a scanner system wherein the original is scanned, and a silver halide photographic material is exposed to light on the basis of the resulting image signals to form a negative image or a positive image corresponding to the image of the original. The scanner system has been widely used in the field of printing plate making in recent years.

There are many recording devices which utilize the image forming method using a scanner system. Among them, a dot generator system using a dot generator is widely used at present.

Conventional light sources for recording with these scanner system recording devices include a glow lamp, a xenon lamp, a mercury vapor lamp, a tungsten lamp and a light-emitting diode.

However, these light sources have practical disadvantages in that their outputs are low and their life is short. Scanners have been developed using, as a light source for the scanner system, a coherent laser beam source such as a He—Ne laser, an argon laser, a He—Cd laser or a semiconductor laser.

Various characteristics are required for light sensitive materials used in these scanner systems. Particularly, exposure is carried out in a short time of $1\times10^{-3}$ to $1\times10^{-8}$ seconds. Hence, the light-sensitive materials must be high-sensitivity and high-contrast under the above conditions. Further, high-sensitivity light-sensitive materials may advantageously throttle output, so that the life of the laser tube can be prolonged. Furthermore, it is necessary that laser beam be regulated, for example, by using slits to obtain good dots. High-sensitivity light-sensitive materials are required to cope with a reduction in laser output caused by the regulation of laser beam. Particularly, many scanners using argon laser as a light source are used for the purposes of obtaining a high output and of narrowly regulated laser beam.

Generally, light-sensitive materials for an argon laser are processed by a technique called spectral sensitization with sensitizing dyes. These dyes have an absorption at about 488 nm to impart sensitivity to a light having a wavelength of 488 nm which is a wavelength of the argon laser beam.

However, light-sensitive materials after processing have a residual color caused by the sensitizing dyes, and the commercial value of the finished products is often lowered. Sometimes intrinsic desensitization is caused by the amounts of the sensitizing dyes added. Examples of methods for increasing the efficiency of spectral sensitization include those described in JP-B-49-25500 (the term "JP-B" as used herein means an "examined Japanese patent publication") for a He—Ne laser beam and those described in JP-A-59-19032 (the term "JP-A" as used herein means an "unexamined published Japanese patent application") and JP-A-59-192242 for a semiconductor laser beam. However, sometimes there are problems of residual color and deterioration of UV transmission in dot to dot work stage after exposure.

Silver halide emulsions exposed under high intensity over a short period of time have the disadvantage that development proceeds slowly and sensitivity greatly fluctuates when the compositions of the developing solutions are changed and when development temperature or time is changed.

There has been a demand to promote operation and to speed up work in the printing industry in recent years. Therefore, there is a need to speed up scanning and shorten the processing time of the light-sensitive materials.

To meet the above needs in the printing industry, there is a demand to speed up scanning in exposure devices (e.g., scanner, plotter) and to increase screen ruling or stop down beams to improve the quality of the image. With silver halide photographic materials, it is demanded to provide light-sensitive materials which have high sensitivity, are excellent in stability, and allow rapid processing or rapid development to be conducted.

The terms "rapid processing" and "rapid development" as used herein refer to processing which takes 15 to 60 seconds from the time that the top of the film is introduced into the automatic processor and then passed through a development bath, a transfer zone, a fixing bath, a transfer zone, a rinsing bath and the drying zone, until the top of the film leaves the drying zone.

Many patent specifications disclose that sensitivity can be enhanced when chemical sensitization is carried out with selenium compounds. Examples of such selenium compounds are disclosed in JP-B-44-15748 and JP-B-43-13489. Further, JP-B-43-22090 discloses that sensitivity can be increased under high intensity by the use of water-soluble iridium compounds. Sensitivity can be certainly increased by these methods.

However, when developing solutions are used for processing light-sensitive materials, the developing solutions are oxidized by oxygen in air and are easily exhausted. Hence it is very difficult to keep the same composition as that of a fresh developing solution. It is desirable that a difference in sensitivity between the processing of a fresh developing solution and the processing of an exhausted solution be as small as possible. The development time is inevitably shortened in rapid processing, in particular. Hence, dependence of processing on the compositions of the developing solutions is high, and there is a demand to improve the constitution of the light-sensitive materials.

SUMMARY OF THE INVENTION

One object of the present invention is to provide a silver halide photographic material which is highly sensitive and high-contrast during high-intensity exposure.

A second object of the present invention is to provide a silver halide photographic material which is highly sensitive and gives an image of good quality even when subjected to rapid processing, and a method for processing such a material.

A third object of the present invention is to provide a silver halide photographic material which is highly sensitive and gives an image of good quality even when the replenishment rates of the developing solution and the fixing solution are reduced, and a method for processing such a material.

A fourth object of the present invention is to provide a system which is made more stable (i) by reducing the change in sensitivity of the photographic material during fluctuation in the composition of the developing solution even when rapid processing is carried out and (ii) by eliminating the fluctuation of the screen ruling and density when outputted by a scanner.

A fifth object of the present invention is to provide a photographic material-processing solution-automatic processor system which is made more stable by reducing the change in the sensitivity of the photographic material with the passage of time.

A sixth object of the present invention is to provide a system which is stable even when the replenishment rates of the processing agents are reduced (the amounts thereof are reduced to ½ of conventional system) and which gives an image of high quality and does not pollute the environment with waste liquor discharged therefrom.

A seventh object of the present invention is to provide a silver halide photographic material which has proper spectral sensitivity to laser beams used for exposure, is highly sensitive and has a high-contrast during high-intensity and short-time exposure, has low processing dependence, and can be rapidly processed.

A eighth object of the present invention is to provide a silver halide photographic material which is excellent in handleability under a safelight safety lamp.

These and other objects of the present invention have been achieved by a silver halide photographic material comprising a support having thereon at least one light-sensitive silver halide emulsion layer, wherein at least 30 mol % of the silver halide grains contained in the emulsion of the emulsion layer are silver chloride, the emulsion contains not more than $1\times10^{-6}$ mol per mol of silver of a rhodium compound and/or not more than $1\times10^{-5}$ mol per mol of silver of an iridium compound, and the silver halide grains have been selenium-sensitized.

The above objects are also attained by a method for processing a silver halide photographic material, wherein the above silver halide photographic material is processed by an automatic processor with a total processing time of 15 to 60 seconds.

DETAILED DESCRIPTION OF THE INVENTION

The invention will be illustrated in more detail below.

The silver halide photographic emulsions of the present invention contain silver chloride, silver chloroiodide, silver chlorobromide or silver chloroiodobromide as the silver halide. The silver chloride content thereof is at least 30 mol %, preferably at least 50 mol %, more preferably at least 60 mol %, most preferably at least 70 mol %. The silver iodide content is preferably not higher than 5 mol %, more preferably not higher than 2 mol %.

The silver halide grains may have a cubic, tetradecahedral, octadecahedral, amorphous or plate form. However, a cubic form or a plate form is preferred. The mean grain size of the silver halide grains is preferably 0.01 to 1 μm, more preferably 0.01 to 0.5 μm, most preferably 0.01 to 0.4 μm. Preferred are silver halide grains having such a narrow grain size distribution that the coefficient of variation [represented by {(standard deviation of grain size)/(mean grain size)}×100] is preferably not higher than 20%, more preferably not higher than 15%, most preferably not higher than 10%.

The interior and the surface layer of the silver halide grain may be the same phase or different phase from each other. The grain may have a core/shell type structure.

The photographic emulsions of the present invention can be prepared according to the methods described in P. Glafkides, *Chimie et Physique Photographique* (Paul Montel 1967), G. F. Duffin, *Photographic Emulsion Chemistry* (The Focal Press 1966) and V. L. Zelikman et al., *Making and Coating Photographic Emulsion* (The Focal Press 1964).

Namely, the acid process, the neutral process or the ammonia process can be used. A soluble silver salt and a soluble halide can be reacted by the single jet method, the double jet method or a combination thereof.

A reverse mixing method can be used in which silver halide grains are formed in the presence of an excess of silver ion. A controlled double jet method can also be used in which the pAg in the liquid phase (in which silver halide is formed) is kept constant. According to this process, a silver halide emulsion can be obtained wherein the crystal form of the grains is regular and the grain size is nearly uniform.

It is preferred that grains are quickly grown at a rate below the degree of critical saturation to a uniform grain size. This is done by the methods wherein the addition rates of silver nitrate and an alkali halide are changed according to the growth rate of grains as described in U.K. Patent 1,535,016, JP-B-48-36890 and JP-B-52-16364 and the methods wherein the concentrations of the aqueous solutions are changed as described in U.S. Pat. No. 4,242,445 and JP-A-55-158124.

It is preferred that the formation of the grains to be contained in the silver halide emulsions of the present invention is carried out in the presence of a solvent for silver halide, such as a tetra-substituted thio urea or an organic thioether compound.

Tetra-substituted thio ureas which can be preferably used as solvents for silver halide in the present invention are compounds represented by formula (V) described in JP-A-53-82408 and JP-A-55-77737:

(V)

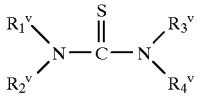

The compounds of formula (V) are illustrated below.

In formula (V), $R_1^v$, $R_2^v$, $R_3^v$ and $R_4^v$ may, be the same or different and each is a substituted or unsubstituted alkyl group, an alkenyl group (e.g., an allyl group) or a substituted or unsubstituted aryl group. The total number of carbon atoms in $R_1^v$ to $R_4^v$ is preferably not more than 30. $R_1^v$ and $R_2^v$, $R_2^v$ and $R_3^v$, $R_2^v$ and $R_4^v$ or $R_3^v$ and $R_4^v$ may be combined together to form a five-membered or six-membered imidazolidinethione, piperidine or morpholine.

The alkyl group includes both a straight-chain group and a branched-chain group.

Examples of the substituent groups for the alkyl group include a hydroxyl group (—OH), a carboxyl group, a sulfo group, an amino group, an alkoxy group having an alkyl portion having 1 to 5 carbon atoms (o-alkyl), a phenyl group or a five-membered or six-membered heterocyclic group (e.g., furyl). Examples of the substituent groups for the aryl group include a hydroxy group, a carboxyl group and a sulfo group.

Particularly preferred are the compounds wherein at least three of $R_1^v$ to $R_4^v$ are each an alkyl group having 1 to 5 carbon atoms, the aryl group is phenyl group and the total number of carbon atoms in $R_1^v$ to $R_4^v$ is not more than 20.

Examples of the compounds represented by formula (V) which can be used in the present invention include the following compounds:

(V-1)

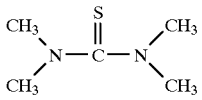

(V-2)

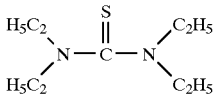

(V-3)

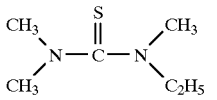

(V-4)

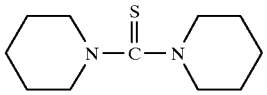

(V-5)

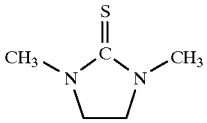

(V-6)

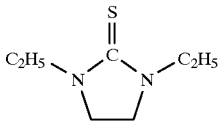

(V-7)

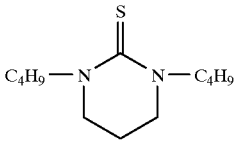

Organic thioether compounds which can be preferably used as the solvents for silver halide in the present invention include compounds wherein an oxygen atom and a sulfur atom are bonded through an ethylene group (e.g., —O—$CH_2CH_2$—S—) as described in JP-B-47-11386 (corresponding to U.S. Pat. No. 3,574,628) and linear thioether compounds having an alkyl group at both terminals (each alkyl group has at least two substituents selected from the group consisting of a hydroxyl group, an amino group, carboxyl group, an amido group and a sulfone group) as described in JP-A-54-155828 (corresponding to U.S. Pat. No. 4,276,374). Examples of such thioethers include the following compounds:

(1)

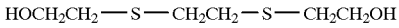

(2)

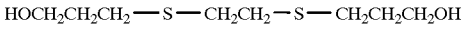

(3)

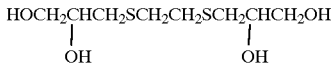

(4)

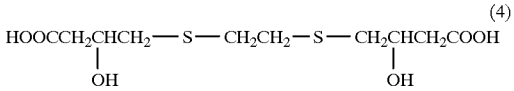

(5)

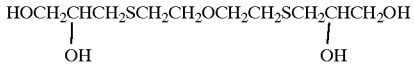

(6)

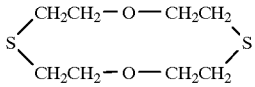

The amount of the solvent for silver halide varies depending on the type of the compounds used and the grain size and halogen composition of silver halide used, but is preferably $1\times10^{-5}$ to $1\times10^{-2}$ mol and more preferably $1\times10^{-5}$ to $1\times10^{-3}$, per mol of silver halide.

When a grain size larger than the desired size is formed by using the solvent for silver halide, the size can be reduced to the desired size by controlling the temperature during the formation of grains, the time for adding a silver salt solution and the halide solution, etc.

Water-soluble rhodium compounds can be used as the rhodium compounds in the present invention. Examples of such rhodium compounds include rhodium(III) halides and rhodium complex salts having, as a ligand, halogen, amines or oxalate, such as hexachlororhodium (III) complex salts, hexabromorhodium(III) complex salts, hexaminerhodium (III) complex salts and trioxalato rhodium(III) complex salts. These rhodium compounds are used by dissolving them in water or an appropriate solvent. To stabilize the solution of the rhodium compound, an aqueous solution of hydrogen halide (e.g., hydrochloric acid, hydrobromic acid, hydrofluoric acid) or an alkali halide (e.g., KCl, NaCl, KBr, NaBr) is added to the solution. Other rhodium compounds may be dissolved by adding separate silver halide grains previously doped with iridium during the preparation of silver halide grains, instead of using the water-soluble rhodium compounds.

The total amount of the rhodium compound in the material of the present invention is not more than $1\times10^{-6}$ mol, preferably $1\times10^{-9}$ to $1\times10^{-6}$ mol, more preferably $5\times10^{-9}$ to $1\times10^{-5}$ mol, per mol of silver halide.

These compounds may be added to the emulsion layer at any stage of during the preparation of the silver halide grains and before the coating of the emulsions, but it is preferred that the rhodium compounds are added during the formation of the grains thereby to incorporate rhodium in the grains.

Water-soluble iridium compounds can be used as the iridium compounds in the present invention. Examples of such iridium compounds include iridium(III) halide compounds, iridium(IV) halide compounds and iridium complex salts having, as a ligand, halogen, amine or oxalate such as hexachloroiridium(III) or (IV) complex salts, hexamineiridium(III) or (IV) complex salts and trioxalatoiridium(III) or (IV) complex salts. A combination of an iridium(III) compound and an iridium(IV) compound selected from the group consisting of the above-described compounds can be used in the present invention. These iridium compounds are dissolved them in water or an appropriate solvent. To stabilize the solution of the iridium compound, an aqueous solution of a hydrogen halide (e.g., hydrochloric acid, hydrobromic acid, hydrofluoric acid) or an alkali halide (e.g., KCl, NaCl, KBr, NaBr) is added to the solution. Other iridium compounds may be dissolved by adding separate silver halide grains previously doped with iridium during the preparation of silver halide grains, instead of using the water-soluble iridium compound.

The total amount of the iridium compound used in the material of the present invention is not more than $1\times10^{-5}$ mol, preferably $1\times10^{-8}$ to $5\times10^{-6}$ mol, more preferably $5\times10^{-8}$ to $1\times10^{-6}$ mol, per mol of silver halide formed.

These iridium compounds may be added to the emulsion at any stage of during the preparation of the silver halide emulsion and before the coating of the emulsions. It is particularly preferred that the iridium compounds are added during the formation of the grains thereby to incorporate iridium in the silver halide grains.

Preferred examples of the iridium compounds include iridium(III) chloride, iridium(III) bromide, iridium(IV) chloride, sodium hexachloroiridate(III) and halogenamine complex salts. and oxalate complex salts such as hexachloroiridium(III) salts, hexamineiridium (IV) salts, trioxalatoiridium(III) salts and trioxalatoiridium(IV) salts.

It is also preferred that at least one compound selected from the group consisting of an iron compound, a rhenium compound, an osmium compound and a ruthenium compound is used together with the iridium compound and/or the rhodium compound.

Iron compounds which are used in the silver halide emulsions of the present invention are compounds containing ferrous or ferric ions, and preferably iron salts and iron complex salts which are water-soluble in the range of the concentrations thereof used in the present invention. Examples of the iron compounds which can be used in the present invention include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium iron(II) nitrate, basic ferric acetate, iron(III) albuminate, ammonium iron (III) acetate, ferric bromide, ferric chloride, ferric chlorate, ferric citrate, ferric fluoride, ferric formate, ferric glycerophosphate, ferric hydroxide, acidic iron(III) phosphate, ferric nitrate, ferric phosphate, ferric pyrophosphate, sodium ferric pyrophosphate, ferric thiocyanate, ferric sulfate, ammonium ferric sulfate, guanidine ferric sulfate, ammonium ferric citrate, potassium hexacyanoferrate(II), potassium pentacyanoamineferrate (II), sodium ethylenedinitrilotetraacetato ferrate(III), potassium hexacyanoferrate(III), tris(dipyridyl)iron(III) chloride, potassium pentacyanonitrosylferrate(III) and hexacyanoiron (III) chloride. Particularly, hexacyanoferrate(II), hexacyanoferrate(III), ferrous thiocyanate and ferric thiocyanate have a remarkable effect.

The rhenium compounds, ruthenium compounds and osmium compounds which can be used in the present invention are preferably the hexadenate coordination complexes described in European Patent (Laid-Open) (EP) Nos. 0336689A1, 0336427A1, 0336425A1 and 0336426A1. Compounds having at least 4 cyanide ligands are particularly preferred. In preferred embodiments, these compounds can be represented by the following formula:

$$[M(CN)_{6-y}L_y]^n$$

wherein M represents rhenium, ruthenium or osmium; L represents a crosslinking ligand; y represents an integer of 0, 1 or 2; and n represents a number of −2, −3 or −4.

Examples of these rhenium, ruthenium and osmium compounds include the following compounds:

| | |
|---|---|
| $[Re(CN)_5]^{-4}$ | $[Ru(CN)_5]^{-4}$ |
| $[Os(CN)_5]^{-4}$ | $[ReF(CN)_5]^{-4}$ |
| $[RuF(CN)_5]^{-4}$ | $[OsF(CN)_5]^{-4}$ |
| $[ReCl(CN)_5]^{-4}$ | $[RuCl(CN)_5]^{-4}$ |
| $[OsCl(CN)_5]^{-4}$ | $[ReBr(CN)_5]^{-4}$ |
| $[RuBr(CN)_5]^{-4}$ | $[OsBr(CN)_5]^{-4}$ |
| $[ReI(CN)_5]^{-4}$ | $[RuI(CN)_5]^{-4}$ |
| $[OsI(CN)_5]^{-4}$ | $[ReF_2(CN)_4]^{-4}$ |
| $[RuF_2(CN)_5]^{-4}$ | $[OsF_2(CN)_5]^{-4}$ |
| $[ReCl_2(CN)_4]^{-4}$ | $[RuCl_2(CN)_4]^{-4}$ |
| $[OsCl_2(CN)_4]^{-4}$ | $[RuBr_2(CN)_4]^{-4}$ |
| $[OsBr_2(CN)_4]^{-4}$ | $[ReBr_2(CN)_4]^{-4}$ |
| $[RuI_2(CN)_4]^{-4}$ | $[OsI_2(CN)_5]^{-4}$ |
| $[Ru(CN)_5(OCN)]^{-4}$ | $[Os(CN)_5(OCN)]^{-4}$ |
| $[Ru(CN)_5(SCN)]^{-4}$ | $[Os(CN)_5(SCN)]^{-4}$ |
| $[Ru(CN)_5(N_3)]^{-4}$ | $[Os(CN)_5(N_3)]^{-4}$ |
| $[Ru(CN)_5(H_2O)]^{-3}$ | $[Os(CN)_5(H_2O)]^{-3}$ |

It is preferred that the above-described iron, rhenium, ruthenium and osmium compounds are added during the formation of silver halide grains. These compounds may be uniformly distributed in the grains or may be localized at the early, middle or later stage of the formation of the grains. However, it is preferred that these compounds are added at the later stage of the formation of the grains, that is, that these compounds are added after preferably 50%, more preferably 80%, of the final grain size is formed. These compounds are used in an amount of not more than $1\times10^{-3}$ mol, preferably $1\times10^{-6}$ to $1\times10^{-4}$ mol, per mol of silver.

Other Group VIII metals, that is, cobalt, nickel, iridium, palladium and platinum may be used together with the above-described compounds. The use of the above-described compounds together with particularly an iridium salt such as iridium chloride or ammonium hexachloroiridate(III) is advantageous because the high-sensitivity and high-contrast emulsions can be obtained.

Any conventional selenium compounds known to the art can be used as the selenium sensitizing agents which can be used in the present invention. Generally, an unstable type selenium compound and/or a non-unstable type compound is added to the emulsions which are stirred at a high temperature, preferably at 40° C. or higher, for a given period of time. The compounds described in JP-B-44-15748, JP-B-43-13489, and Japanese Patent Application Nos. 2-130976 and 2-229300 are preferred as the unstable type selenium compounds. Examples of the unstable type selenium compounds include isoselenocyanates (e.g., aliphatic isoselenocyanates such as allyl isoselenocyanate), selenoureas, selenoketones, selenoamides, selenocarboxylic acids (e.g. , 2-selenopropionic acid, 2-selenobutyric acid), selenoesters, diacylselenides (e.g., bis(3-chloro-2,6-dimethoxybenzoyl)selenide), selenophosphates, phosphineselenides and colloidal metallic selenium.

Though the preferred examples of the unstable type selenium compounds have been described above, selenium compounds which can be used in the present invention are not limited thereto. Any of unstable type selenium compounds which are conventionally used as sensitizing agents for photographic emulsions can be used. The structures of these compounds are not critical, so long as the selenium is unstable. It is generally understood that the structure does not play any role in the compound except that the organic moiety in the structure of the molecule of the selenium sensitizing agent carries selenium and allows selenium in an unstable form to exist in the emulsion. Such unstable selenium compounds can be advantageously used in the present invention.

The compounds described in JP-B-46-4553, JP-B-52-34492 and JP-B-52-34491. are the non-unstable type selenium compounds which can be used in the present invention. Examples of the non-unstable type selenium compounds include selenious acid, potassium selenocyanide, selenazoles, quaternary salts of selenazoles, diaryl selenides, diaryl diselenides, dialkyl selenides, dialkyl diselenides, 2-selenazolidinedione, 2-selenooxazolidinethione and derivatives thereof.

Among these selenium compounds, those represented by formulas (VI-a) and (VI-b) are preferred:

(VI-a)

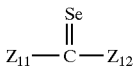

In formula (VI-a), $Z_{11}$ and $Z_{12}$ may be the same or different and each is an alkyl group (e.g., methyl, ethyl, t-butyl, adamantyl, t-octyl), an alkenyl group (e.g., vinyl, propenyl), an aralkyl group (e.g., benzyl, phenethyl), an aryl group (e.g., phenyl, pentafluorophenyl, 4-chlorophenyl, 3-nitrophenyl, 4-octylsulfamoylphenyl, α-naphthyl), a heterocyclic group (e.g., pyridyl, thienyl, furyl, imidazolyl), $—NR_{11}(R_{12})$, $—OR_{13}$ or $—SR_{14}$.

$R_{11}$, $R_{12}$, $R_{13}$ and $R_{14}$ may be the same or different and each represents an alkyl group, an aralkyl group, an aryl group or a heterocyclic group. Examples of the alkyl group, the aralkyl group, the aryl group and the heterocyclic group include those already described above in the definition of $Z_{11}$. With the proviso that $R_{11}$ and $R_{12}$ may be each a hydrogen atom or an acyl group (e.g., acetyl, propanoyl, benzoyl, heptafluorobutanoyl, difluoroacetyl, 4-nitrobenzoyl, α-naphthoyl, 4-trifluoromethylbenzoyl).

In formula (VI-a), $Z_{11}$ is preferably an alkyl group, an aryl group or $—NR_{11}(R_{12})$, and $Z_{12}$ is preferably $—NR_{15}(R_{16})$. $R_{11}$, $R_{12}$, $R_{15}$ and $R_{16}$ may be the same or different and each represents a hydrogen atom, an alkyl group, an aryl group or an acyl group.

In formula (VI-a), more preferred are N,N-dialkylselenoureas, N,N,N-trialkyl-N'-acylselenoureas, tetraalkylselenoureas, N,N-dialkyl-arylselenoamides and N-alkyl-N-aryl-arylselenoamides.

(VI-b)

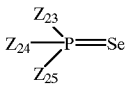

In formula (VI-b), $Z_{23}$, $Z_{24}$ and $Z_{25}$ may be the same or different and each represents an aliphatic group, an aromatic group, a heterocyclic group, $—OR_{27}$, $—NR_{28}(R_{29})$, $—SR_{30}$, $—SeR_{31}$, X or a hydrogen atom. $R_{27}$, $R_{30}$ and $R_{31}$ each represents an aliphatic group, an aromatic group, a heterocyclic group, a hydrogen atom or a cation; $R_{28}$ and $R_{29}$ each represents an aliphatic group, an aromatic group, a heterocyclic group or a hydrogen atom; and X represents a halogen atom.

The aliphatic group represent by $Z_{23}$, $Z_{24}$, $Z_{25}$, $R_{27}$, $R_{28}$ $R_{29}$, $R_{30}$ and $R_{31}$ in formula (VI-b) is a straight-chain, branched or cyclic alkyl, alkenyl, alkinyl or aralkyl group (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentinyl, benzyl, phenethyl).

The aromatic group represented by $Z_{23}$, $Z_{24}$, $Z_{25}$, $R_{27}$, $R_{28}$, $R_{29}$, $R_{30}$ and $R_{31}$ in formula (VI-b) is a monocyclic or condensed-ring aryl group (e.g., phenyl, pentafluorophenyl, 4-chlorophenyl, 3-sulfophenyl, α-naphthyl, 4-methylphenyl).

The heterocyclic group represented by $Z_{23}$, $Z_{24}$, $Z_{25}$, $R_{27}$, $R_{28}$, $R_{29}$, $R_{30}$ and $R_{31}$ in formula (VI-b) is a three-membered to ten-membered, saturated or unsaturated heterocyclic group having at least one hetero-atom of nitrogen, oxygen or sulfur (e.g., pyridyl, thienyl, furyl, thiazolyl, imidazolyl, benzimidazolyl).

The cation represented by $R_{27}$, $R_{30}$ and $R_{31}$ is an alkali metal atom or ammonium. The halogen represented by X is a fluorine atom, a chlorine atom, a bromine atom or an iodine atom.

In formula (VI-b), $Z_{23}$, $Z_{24}$ and $Z_{25}$ are preferably each an aliphatic group, an aromatic group or $—OR_{27}$, and $R_{27}$ is preferably an aliphatic group or an aromatic group.

In formula (VI-b), more preferred are trialkylphosphine selenides, triarylphosphine selenides, trialkyl selenophosphates and triaryl selenophosphates.

Examples of the compounds represented by formulas (VI-a) and (VI-b) include, but are not limited to, the following compounds;

(VIa-1)

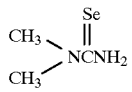

(VIa-2)

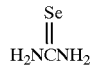

(VIa-3)

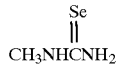

(VIa-4)

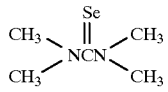

(VIa-5)

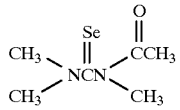

(VIa-6)

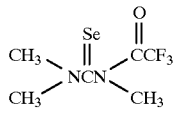

-continued
(VIa-7)
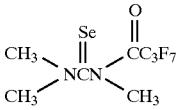
(VI-8)
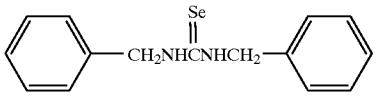
(VI-9)
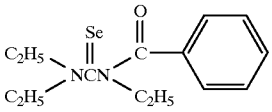
(VI-10)
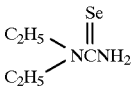
(VIa-11)
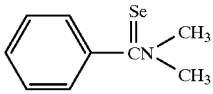
(VIa-12)
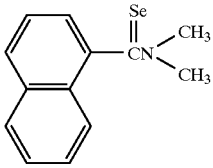
(VIa-13)
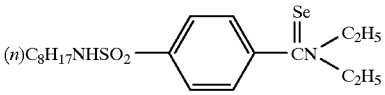
(VIa-14)
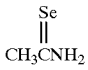
(VIa-15)
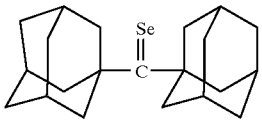
(VIa-16)
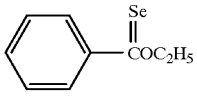
(VIa-17)
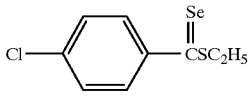
(VIa-18)
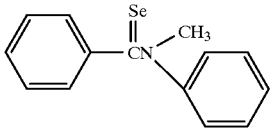
-continued
(VIa-19)
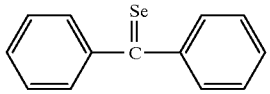
(VIa-20)
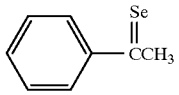
(VIb-1)
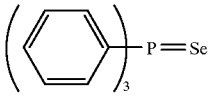
(VIb-2)
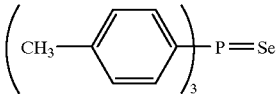
(VIb-3)
(VIb-4)
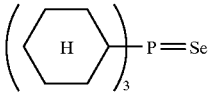
(VIb-5)
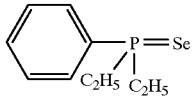
(VIb-6)
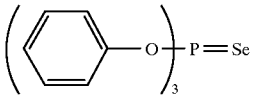
(VIb-7)
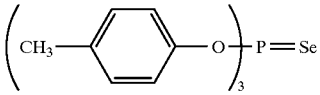
(VIb-8)
(VIb-9)
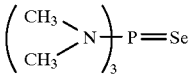
(VIb-10)
(VIb-11)
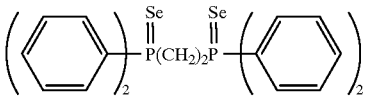
(VIb-12)
(VIb-13)
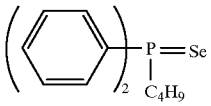

-continued (VIb-14)

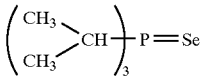

(VIb-15)

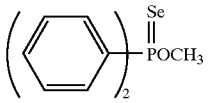

(VIb-16)

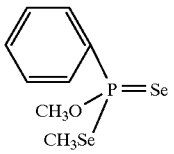

(VIb-17)

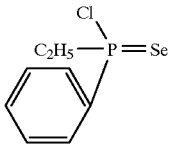

(VIb-18)

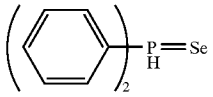

(VIb-19)

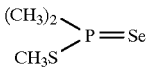

Selenium sensitization methods are disclosed in U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French Patents 2,693,038 and 2,093,209, JP-B-52-34491, JP-B-52-34492, JP-B-53-295, JP-B-57-22090, JP-A-59-180536, JP-A-59-185330, JP-A-59-181337, JP-A-59-187338, JP-A-59-192241, JP-A-60-150046, JP-A-60-151637, JP-A-61-246738, JP-A-3-4221, JP-A-3-148648, JP-A-111838, JP-A-3-116132, JP-A-3-237450, Japanese Patent Application Nos. 2-110558, 2-130976, 2-139183 and 2-229300, U.K. Patents 255,846 and 861,984 and H. E. Spencer et. al., *Journal of Photographic Science*, Vol. 31, pp. 158–169 (1983).

The selenium sensitizing agents are dissolved in water or an organic solvent such as methanol or ethanol or in a mixed solvent and added to the emulsion during chemical sensitization. For instance, the selenium sensitizing agents in the form described in Japanese patent Application Nos. 2-264447 and 2-264448 are added to the emulsion. Preferably, these agents are added before the initiation of chemical sensitization. These selenium sensitizing agents may be used either alone or in a combination of two or more. If desired, the unstable selenium compound and the non-unstable selenium compound may be used in combination. The amount of the selenium sensitizing agent to be added varies depending on the activity of the selenium sensitizing agent to be used, the type and size of the silver halide, the ripening temperature and the ripening time. Preferably, it is at least $1\times10^{-8}$ mol, more preferably at least $1\times10^{-7}$ mol, but not more than $1\times10^{-5}$ mol, per mol of silver halide. When the selenium sensitizing agents are used, the chemical ripening temperature is preferably not lower than 45° C., more preferably not lower than 50° C., but not higher than 80° C.

The pAg and pH are optional. For example, the effect of the present invention can be obtained over a wide pH range of 4 to 9.

Selenium sensitization can be more effectively made when sensitization is carried out in the presence of a solvent for silver halide.

Examples of the solvent for silver halide which can be used in the present invention include (a) the organic thioethers described in U.S. Pat. Nos. 3,271,157, 3,531,289 and 3,574,628, JP-A-54-1019 and JP-A-54-158917; (b) the thiourea derivatives described in JP-A-53-82408, JP-A-55-77737 and JP-A-55-2982; (c) the solvents for silver halide having a thiocarbonyl group between the oxygen or sulfur atom and the nitrogen atom, described in JP-A-53-144319; (d) the imidazoles described in JP-A-54-100717; (e) sulfites; and (f) thiocyanates.

Particularly preferred solvents are thiocyanates and tetramethylthiourea. The amount of the solvent to be used varies depending on the type of the solvent. For example, when thiocyanates are used, the preferred amount thereof is at least $1\times10^{-4}$ mol, but not more than $1\times10^{-2}$ mol, per mol of silver halide.

It is preferred that the total amount of gelatin coated on the silver halide emulsion side of the support is not more than 2.5 g/m$^2$ (particularly from 1.0 to 2.0 g/m$^2$) to achieve rapid processing according to the present invention. The effect of rapid processing with the present invention is more remarkable when the amount of gelatin coated on the protective layer is preferably from 0.2 to 0.5 g/m$^2$.

When selenium sensitization is carried out in combination with sulfur sensitization and/or gold sensitization in the chemical sensitization of the silver halide photographic emulsions of the present invention, a higher sensitivity can be obtained and fogging can be reduced.

Sulfur sensitization is carried out by adding a sulfur sensitizing agent to the emulsion and stirring the emulsion at a high temperature, preferably at 40° C. or higher, for a determined period of time.

Gold sensitization is carried out by adding a gold sensitizing agent to the emulsion and stirring the emulsion at a high temperature, preferably at 40° C. or higher, for a determined period of time.

Conventional sulfur sensitizing agents can be used for sulfur sensitization. Examples of the sulfur sensitizing agents include thiosulfates, thioureas, allyl isothiacyanate, cystine, p-toluenethiosulfonates and rhodanine. Further, the sulfur sensitizing agents described in U.S. Pat. Nos. 1,574,944, 2,410,689, 2,278,947, 2,728,668, 3,501,313 and 3,656,955, German Patent 1,422,869, JP-B-56-24937 and JP-A-55-45016 can be used. The sulfur sensitizing agent may be used in an amount sufficient to increase effectively the sensitivity of the emulsion. The amount widely varies depending on various factors such as pH, temperature, the size of silver halide grains, etc., but is preferably at least $1\times10^{-7}$ mol, but not more than $5\times10^{-4}$ mol, per mol of silver halide.

The gold in gold sensitizing agents used for gold sensitization may have an oxidation number of +1 or +3. Gold compounds conventionally used as gold sensitizing agents can be used. Typical examples of the gold sensitizing agents include chloroaurates, potassium chloroaurate, auric chloride, potassium auric thiocyanate, potassium iodoaurate, tetracyanoauric acid, ammonium aurothiocyanate and pyridyl trichloro-gold.

The amount of the gold sensitizing agent to be added varies depending on various factors, but is preferably at least $1\times10^{-7}$ mol, but not more than $5\times10^{-4}$ mol, per mol of silver halide.

There is no particular limitation with regard to the stage and order of the addition of the solvent for silver halide and the selenium sensitizing agent or the sulfur sensitizing agent and/or the gold sensitizing agent to be used together with the selenium sensitizing agent when chemical sensitization is carried out. For example, these compounds may be added simultaneously or separately at the early stage (preferably) of chemical ripening or during chemical ripening. These compounds are dissolved in water or a water-miscible organic solvent such as methanol, ethanol or acetone alone or a mixed solvent and then may be added to the emulsion.

Compounds represented by formulas (I-a), (I-b) and (I-c) are preferably used in the light-sensitive silver halide emulsion layers of the present invention:

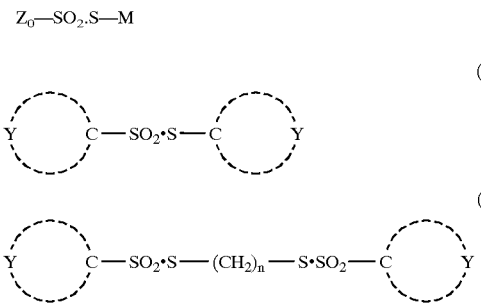

In formulas (I-a), (I-b) and (I-c), $Z_0$ represents an alkyl group having 1 to 18 carbon atoms, an aryl group having 6 to 18 carbon atoms, an aromatic group having 6 to 18 carbon atoms or a heterocyclic group, which may be optionally substituted; Y represents an atomic group necessary for forming an aromatic ring having 6 to 18 carbon atoms or a heterocyclic ring, which may be optionally substituted; M represents a metal atom or an organic cation; and n represents an integer of 2 to 10.

Examples of the substituent include a lower alkyl group (such as methyl, ethyl), an aryl group (such as phenyl), an alkoxy group having 1 to 8 carbon atoms, a halogen atom (such as chlorine), a nitro group, an amino group and a carboxyl group.

Examples of the heterocyclic group or ring represented by $Z_0$ and Y include a thiazole ring, a benzthiazole ring, an imidazole ring, a benzimidazole ring and an oxazole ring.

Examples of the metal ion represented by M include an alkali metal ion such as a sodium ion and a potassium ion. Preferred examples of the organic cation include an ammonium ion and a guanidine group.

Examples of the compounds represented by formulas (I-a), (I-b) and (I-c) include the following compounds:

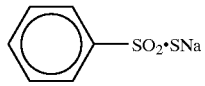

a

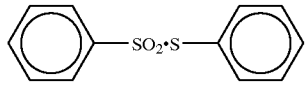

b

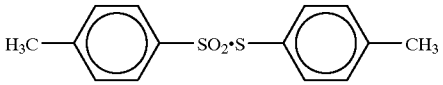

c

-continued

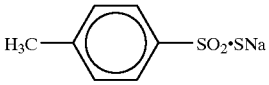

d $H_3C{\bullet}SO_2{\bullet}SNa$ e

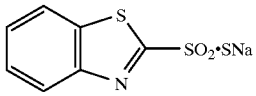

f

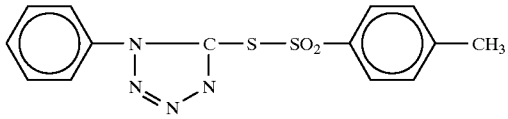

g

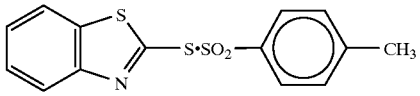

h

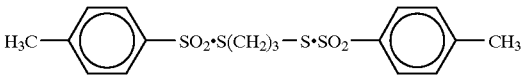

i

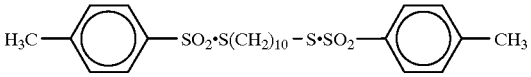

j l-Cystine disulfoxide k

The compounds of formula (I-a), (I-b) or (I-c) are used in an amount of preferably $1\times10^{-5}$ to 1 g, particularly preferably $1\times10^{-4}$ to $1\times10^{-2}$ g, per mol of silver halide.

These compounds may be added at any stage during the formation of the grains or during the chemical ripening of the emulsion. But it is particularly preferred that the compounds are added before the formation of the grains or immediately before the initiation of chemical ripening. It is more preferred that the compounds of the formula (I-a), (I-b) or (I-c) are mixed with a sulfinic acid compound such as sodium benzenesulfinate to improve the long-time stability of the solution.

The light-sensitive silver halide emulsions of the present invention may be spectral-sensitized to blue, green or red light having a relatively long wavelength or to infrared light by using sensitizing dyes. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

Useful sensitizing dyes which can be used in the present invention are described in the literature references cited in *Research Disclosure* No. 17643, item IV-A (page 23, December 1978) and ibid. No. 1831, item X (page 437, August 1979).

Sensitizing dyes having a spectral sensitivity suitable for the spectral characteristics of light sources for scanners can be advantageously chosen.

(A) For a argon laser beam source, one may use the simple merocyanines described in JP-A-60-162247, JP-A-2-48653, U.S. Pat. No. 2,161,331 and West German Patent 936,071; (B) for a helium-neon laser beam source, one may use the trinuclear cyanine dyes described in JP-A-50-62425, JP-A-

54-18726 and JP-A-59-102229; (C) for an LED beam source, one may use the thiacarbocyanines described in JP-B-48-42172, JP-B-51-9609, JP-B-55-39818 and JP-A-62-284343; and (D) for a semiconductor laser beam source, one may use the tricarbocyanines described in JP-A-59-191032 and JP-A-60-80841 and the dicarbocyanines having 4-quinoline nucleus described in JP-A-59-192242.

The sensitizing dyes which can be preferably used in the light-sensitive silver halide emulsion of the present invention are compounds represented by formula (II), (III-a), (III-b) or (III-c):

Compounds of the formula (II) which are preferably used in the light-sensitive silver halide emulsion layers of the light-sensitive materials in the present invention are illustrated below.

(II)

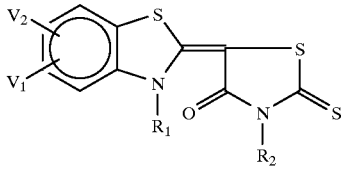

wherein $R_1$ and $R_2$ each represents an unsubstituted alkyl group (preferably having not more than 4 carbon atoms such as methyl, ethyl, 3-propyl, 3-butyl, 4-butyl) or a substituted alkyl group [having an alkyl portion of not more than 4 carbon atoms such as a sulfoalkyl group (e.g., sulfoethyl, 3-sulfopropyl, 3-sulfobutyl, 4-sulfobutyl), a carboxyalkyl group (e.g., carboxylmethyl, carboxyethyl, 3-carboxypropyl), a hydroxyalkyl group (e.g., hydroxymethyl, hydroxyethyl), an aralkyl group (e.g., benzyl, phenethyl, sulfophenethyl), an aryloxyalkyl group (e.g., phenoxyethyl, phenoxypropyl, sulfophenoxypropyl), an acetylaminoalkyl group (e.g., 2-acetylaminoethyl, 3-acetylaminopropyl), an alkylsulfonylaminoalkyl group (e.g., 2-methylsulfonylaminoethyl, 3-methylsulfonylaminopropyl), an N-alkylcarbamoylaminoalkyl group (e.g., 2-(N-methylcarbamoyl)-aminoethyl, 2-(N-ethylcarbamoyl) aminoethyl, 3-(N-methylcarbamoyl)aminopropyl] and at least one of $R_1$ and $R_2$ is an acetylaminoalkyl group or an N-alkylcarbamoylaminoalkyl group; and $V_1$ and $V_2$ each represents a hydrogen atom, a halogen atom (e.g., chlorine, bromine), an alkyl group (preferably having not more than 3 carbon atoms such as methyl, ethyl), an alkoxy group (having not more than 3 carbon atoms such as methoxy, ethoxy) or a trifluoromethyl group.

The compounds of the formula (II) are used in an amount of $1\times10^{-5}$ to $1\times10^{-2}$ mol per mol of silver halide in the emulsion layer.

Examples of the dyes of the formula (II) according to the present invention include the following compounds:

(II-1)

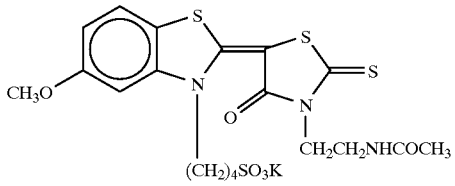

-continued (II-2)

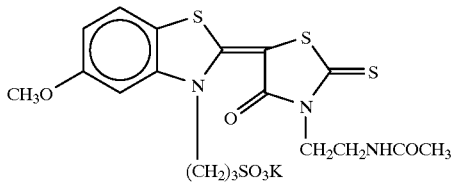

(II-3)

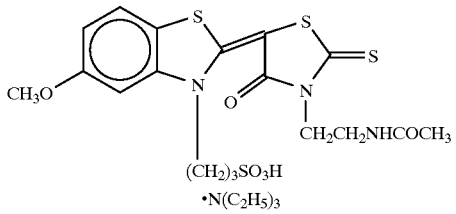

(II-4)

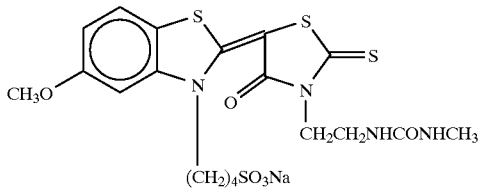

(II-5)

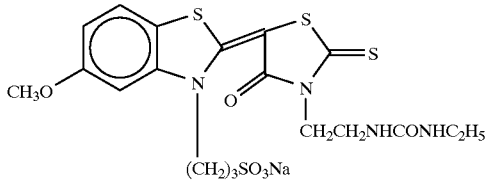

(II-6)

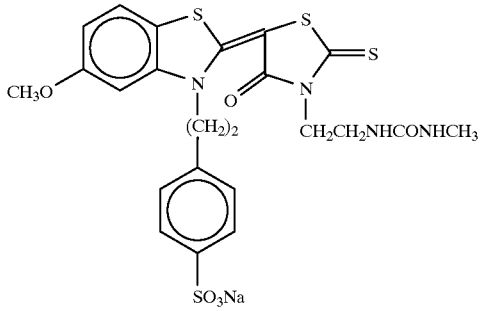

(II-7)

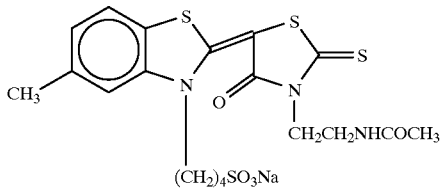

(II-8)

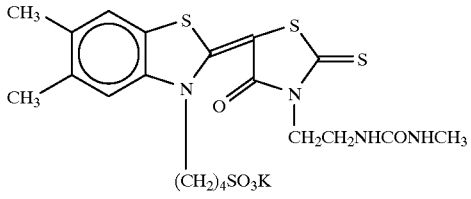

-continued (II-9)

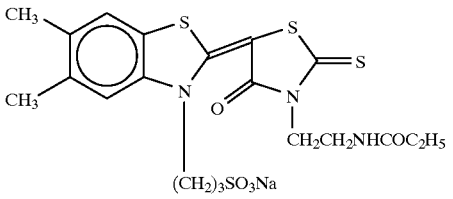

(II-10)

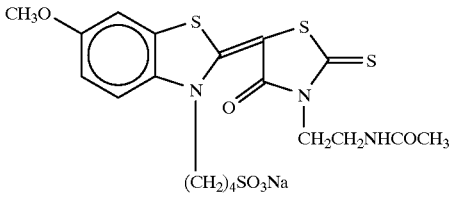

(II-11)

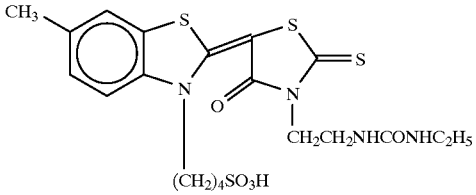

(II-12)

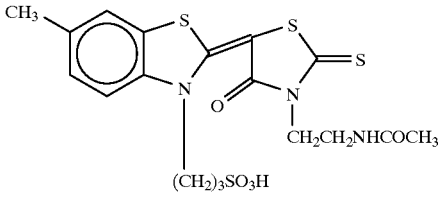

-continued (II-13)

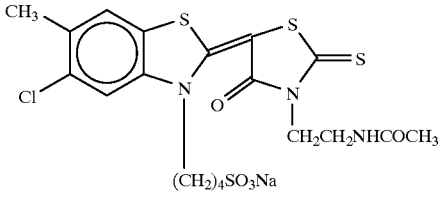

-continued (II-14)

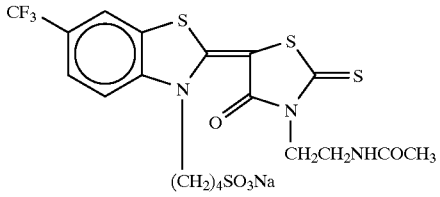

It is preferred that the light-sensitive silver halide emulsions of the present invention are spectral-sensitized by the compounds of the following formula (III-a), (III-b) or (III-c). Further, it is preferred that these compounds are used together with compounds represented by formula (IV) described hereinafter.

(III-a)

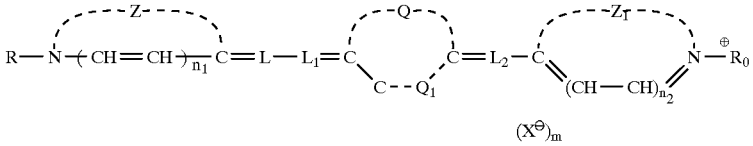

In formula (III-a), Z and $Z_1$ each represents a non-metallic atomic group necessary for forming a five-membered or six-membered nitrogen-containing heterocyclic nucleus; R and $R_0$ each represents an alkyl group, a substituted alkyl group or an aryl group; Q and $Q_1$ each represents a non-metallic atomic group and are bonded to form a 4-thiazolidinone nucleus, a 5-thiazolidinone nucleus or a 4-imidazolidinone nucleus; L, $L_1$ and $L_2$ each represents a methine group or a substituted methine group; $n_1$ and $n_2$ each represents 0 or 1; X represents an anion; and m represents 0 or 1 and when an inner salt is formed, m=0.

(III-b)

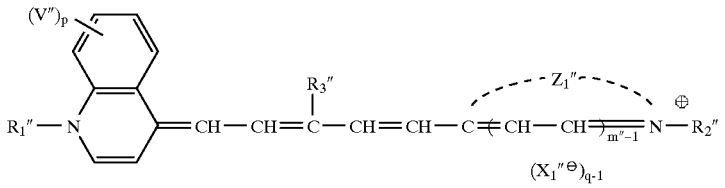

In formula (III-b), $R_1''$ and $R_2''$ may be the same or different and each represents an alkyl group; $R_3''$ represents a hydrogen atom, a lower alkyl group, a lower alkoxy group, a phenyl group, a benzyl group or a phenethyl group; V" represents a hydrogen atom, a lower alkyl group, an alkoxy group, a halogen atom or a substituted alkyl group; $Z_1''$ represents a non-metallic atomic group necessary for forming a five-membered or six-membered nitrogen-containing heterocyclic ring; $X_1''$ represents an acid anion; and m", p and q represent independently 1 or 2; and when the dye forms an inner salt, q is 1.

(III-c)

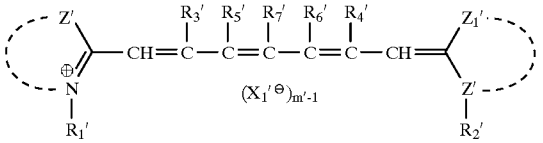

In formula (III-c), $R_1'$ and $R_2'$ may be the same or different and each represents an alkyl group; $R_3'$ and $R_4'$ represent independently a hydrogen atom, a lower alkyl group, a lower alkoxy group, a phenyl group, a benzyl group or a phenethyl group; $R_5'$ and $R_6'$ each represents a hydrogen atom or are bonded to form a bivalent alkylene group; $R_7'$ represents a hydrogen atom, a lower alkyl group, a lower alkoxy group, a phenyl group, a benzyl group, a phenethyl group or —$NW_1'(W_2')$; $W_1'$ and $W_2'$ represent independently an alkyl group or an aryl group, or $W_1'$ and $W_2'$ may be bonded to form a five-membered or six-membered nitrogen-containing heterocyclic ring; $R_3'$ and $R_7'$ or $R_4'$ and $R_7'$ may be bonded to form a bivalent alkylene group; Z' and $Z_1'$ represent independently a non-metallic atomic group necessary for forming a five-membered or six-membered nitrogen-containing heterocyclic ring; $X_1'$ represents an acid anion; and m' represents 1 or 2 and when the dye forms an inner salt, m' is 1.

(IV)

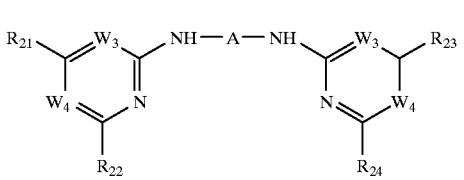

In formula (IV), A represents a bivalent aromatic group; $R_{21}$, $R_{22}$, $R_{23}$ and $R_{24}$ each represents a hydrogen atom, a hydroxyl group, an alkyl group, an alkoxy group, an aryloxy group, a halogen atom, a heterocyclic nucleus, a heterocyclic thio group, an arylthio group, an amino group, a substituted or unsubstituted alkylamino group, a substituted or unsubstituted arylamino group, a substituted or unsubstituted aralkylamino group, an aryl group or a mercapto group; at least one of A, $R_{21}$, $R_{22}$, $R_{23}$ and $R_{24}$ is a group having sulfo group; and $W_3$ and $W_4$ each represents —CH= or —N= with the proviso that at least one of $W_3$ and $W_4$ is —N=.

The sensitizing dyes which are preferably used in the silver halide emulsions of the present invention have an optimum spectral sensitivity to a He—Ne laser beam and a semiconductor laser beam and are the compounds represented by formulas (III-a), (III-b) and (III-c). However, when these compounds are used alone, the spectral sensitivity is not sufficient and intrinsic desensitization is apt to increase when the amounts of these compounds are increased. It is known that these compounds may be used in combination with the compounds of formula (IV) to solve this problem. This is disclosed in, for example, JP-B-60-45414, JP-B-46-10473 and JP-A-59-192242. However, it is an unexpected finding to those in the art that when these compounds are used in combination of the emulsions of the present invention, spectral sensitivity can be further increased and when a He—Ne laser beam or a semiconductor laser beam is used, sensitivity can be further increased in comparison to the prior art.

These compounds are illustrated in more detail below.

First, the sensitizing dyes of the formula (III-a) which can be used in the present invention are illustrated in more detail below.

Examples of the nitrogen-containing heterocyclic nucleus formed by Z or $Z_1$ in formula (III-a) include thiazole nucleuses {e.g., thiazole, 4-methylthiazole, 4-phenylthiazole, 4,5-dimethylthiazole, 4,5-diphenylthiazole}, benzothiazole nucleuses {e.g., benzothiazole, 5-chlorobenzothiazole, 6-chlorobenzothiazole, 5-methylbenzothiazole, 6-methylbenzothiazole, 5-bromobenzothiazole, 6-bromobenzothiazole, 5-iodobenzothiazole, 6-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-hydroxybenzothiazole, 5-carboxybenzothiazole, 5-fluorobenzothiazole, 5-dimethylaminobenzothiazole, 5-acetylaminobenzothiazole, 5-trifluoromethylbenzothiazole, 5,6-dimethylbenzothiazole, 5-hydroxy-6-methylbenzothiazole, 5-ethoxy-6-methylbenzothiazole, tetrahydrobenzothiazole), naphthothiazole nucleuses {e.g., naphtho[2,1-d]thiazole, naphtho[1,2-d]thiazole, naphtho[2,3-d]-thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]-thiazole}, selenazole nucleuses {e.g., 4-methylselenazole, 4-phenylselenazole}, benzoselenazole nucleuses {e.g., benzoselenazole, 5-chlorobenzoselenazole, 5-phenylbenzoselenazole, 5-methoxybenzoselenazole, 5-methylbenzoselenazole, 5-hydroxybenzoselenazole}, naphthoselenazole nucleuses {e.g., naphtho[2,1-d]selenazole, naphtho[1,2-d]selenazole}, oxazole nucleuses {e.g., oxazole, 4-methyloxazole, 5-methyloxazole, 4,5-dimethyloxazole}, benzoxazole nucleuses {e.g., benzoxazole, 5-fluorobenzoxazole, 5-chlorobenzoxazole, 5-bromobenzoxazole, 5-trifluoro-methylbenzoxazole, 5-methylbenzoxazole, 5-methyl-6-phenylbenzoxazole, 5,6-dimethylbenzoxazole, 5-methoxybenzoxazole, 5,6-dimethoxybenzoxazole, 5-phenylbenzoxazole, 5-carboxybenzoxazole, 5-methoxycarbonylbenzoxazole, 5-acetylbenzoxazole, 5-hydroxybenzoxazole}, naphthoxazole nucleuses {e.g., naphtho[2,1-d]oxazole, naphtho[1,2-d]oxazole, naphtho[2,3-d]oxazole}, 2-quinoline nucleuses, imidazole nucleuses, benzimidazole nucleuses, 3,3'-dialkylindolenine nucleuses, 2-pyridine nucleuses, and thiazoline nucleuses. Particularly preferred are the cases where at least one of Z and $Z_1$ is a thiazole nucleus, a thiazoline nucleus, an oxazole nucleus or a benzoxazole nucleus.

The unsubstituted alkyl group represented by R or $R_0$ is an alkyl group preferably having not more than 5 carbon atoms (e.g., methyl, ethyl, n-propyl, n-butyl). The substituted alkyl group represented by R and $R_0$ includes a substituted alkyl group having an alkyl portion preferably having not more than 5 carbon atoms {e.g., a hydroxyalkyl group (e.g., 2-hydroxyethyl, 3-hydroxypropyl, 4-hydroxybutyl), a carboxyalkyl group (e.g., carboxymethyl, 2-carboxyethyl, 3-carboxypropyl, 4-carboxybutyl, 2-(2-carboxyethoxy)ethyl), a sulfoalkyl group (e.g., 2-sulfoethyl, 3-sulfopropyl, 3-sulfobutyl, 4-sulfobutyl, 2-hydroxy-3-sulfopropyl, 2-(3-sulfopropoxy) ethyl, 2-acetoxy-3-sulfopropyl, 3-methoxy-2-(3-sulfopropoxy)propyl, 2-[3-(sulfopropoxy)ethoxy]ethyl, 2-hydroxy-3-(3'-sulfopropoxy)propyl), an aralkyl group (whose alkyl portion has preferably 1 to 5 carbon atoms and whose aryl portion is. preferably a phenyl group, such as benzyl, phenethyl, phenylpropyl, phenylbutyl, p-tolylpropyl, p-methoxyphenethyl, p-chlorophenethyl, p-carboxybenzyl, p-sulfophenethyl, p-sulfobenzyl), an aryloxyalkyl group (whose alkyl portion has preferably 1 to 5 carbon atoms and whose aryl portion is preferably a phenyl group, such as phenoxyethyl, phenoxypropyl, phenoxybutyl, p-methylphenoxyethyl, p-methoxyphenoxypropyl), vinylmethyl group, etc.}. The aryl group includes a phenyl group.

L, $L_1$ and $L_2$ each represents a methine group or a substituted methine group, i.e., =C(R')— wherein R' is an alkyl group (e.g., methyl, ethyl), a substituted alkyl group {for example, an alkoxyalkyl group (e.g., 2-ethoxyethyl), a carboxyalkyl group (e.g., 2-carboxyethyl), an alkoxycarbonylalkyl group (e.g., 2-methoxycarbonylethyl), an aralkyl group (e.g., benzyl, phenethyl)}, or an aryl group (e.g., phenyl, p-methoxyphenyl, p-chlorophenyl, o-carboxyphenyl). L and R or $L_1$ and $R_0$ may be bonded through a methine chain to form a nitrogen containing heterocyclic ring. Examples of the substituent which may be attached to the nitrogen atom of the position-3 of the thiazoline nucleus or the imidazolinone nucleus formed by Q and $Q_1$ include an alkyl group (having preferably 1 to 8 carbon atoms such as methyl, ethyl, propyl), an allyl group, an aralkyl group (whose alkyl portion has preferably 1 to 5 carbon atoms, such as benzyl, p-carboxyphenylmethyl), an aryl group (having preferably 6 to 9 carbon atoms in total, such as phenyl, p-carboxyphenyl), a hydroxyalkyl group (whose alkyl portion has preferably 1 to 5 carbon atoms, such as 2-hydroxyethyl), a carboxyalkyl group (whose alkyl portion has preferably 1 to 5 carbon atoms, such as carboxymethyl) and an alkoxycarbonylalkyl group (wherein the alkyl portion of the alkoxy radical has preferably 1 to 3 carbon atoms, and the alkyl portion of the group has preferably 1 to 5 carbon atoms, such as methoxycarbonylethyl).

Examples of the anion represented by X include halogen ions (e.g., iodine ion, bromine ion, chlorine ion), perchlorate ion, thiocyanate ion, benzenesulfonate ion, p-toluenesulfonate ion, methylsulfate ion and ethylsulfate ion.

The compounds of formula (III-b) are illustrated in more detail below.

In formula (III-b), $R_1$" and $R_2$" may be the same or different and each is an alkyl group (including a substituted alkyl group). The alkyl group has preferably 1 to 8 carbon atoms, and examples thereof include methyl, ethyl, propyl, butyl, pentyl, heptyl and octyl.

Examples of the substituent for the substituted alkyl group (whose alkyl portion has preferably not more than 6 carbon atoms) include a carboxyl group, a sulfo group, a cyano group, a halogen atom (e.g., fluorine, chlorine, bromine), a hydroxyl group, an alkoxycarbonyl group (having preferably not more than 8 carbon atoms such as methoxycarbonyl, ethoxycarbonyl, benzyloxycarbonyl), an alkoxy group (having preferably not more than 7 carbon atoms such as methoxy, ethoxy, propoxy, butoxy, benzyloxy), an aryloxy group (e.g., phenoxy, p-tolyloxy), an acyloxy group (having preferably not more than 3 carbon atoms such as acetyloxy, propionyloxy), an acyl group (having preferably not more than 8 carbon atoms such as acetyl, propionyl, benzoyl, mesyl), a carbamoyl group (e.g., carbamoyl, N,N-dimethylcarbamoyl, morpholinocarbamoyl, piperidinocarbamoyl), a sulfamoyl group (e.g., sulfamoyl, N,N-dimethylsulfamoyl, morpholinosulfonyl) and an aryl group (e.g., phenyl, p-hydroxyphenyl, p-carboxyphenyl, p-sulfophenyl, α-naphthyl). The alkyl group may be substituted by one or more of these substituents.

$R_3$" represents a hydrogen atom, a lower alkyl group (having preferably 1 to 4 carbon atoms such as methyl, ethyl, propyl, butyl), a lower alkoxy group (having preferably 1 to 4 carbon atoms such as methoxy, ethoxy, propoxy, butoxy), a phenyl group, a benzyl group or a phenethyl group. A lower alkyl group and a benzyl group are particularly preferred.

V" represents a hydrogen atom, a lower alkyl group (having preferably 1 to 4 carbon atoms such as methyl, ethyl, propyl), an alkoxy group (having preferably 1 to 4 carbon atoms such as methoxy, ethoxy, butoxy), a halogen atom (e.g., fluorine, chlorine) or a substituted alkyl group (having preferably 1 to 4 carbon atoms such as trifluoromethyl, carboxymethyl).

$Z_1$ represents an atomic group necessary for forming a five-membered or six-membered nitrogen containing heterocyclic ring. Examples of the heterocyclic ring include thiazole nucleuses (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazoel, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho[1,2-d]thiazole, naphtho[2,3-d]-thiazole, 5-methoxynaphtho[1,2-d]thiazole, 7-ethoxynaphtho[2,1-d]thiazole, 8-methoxynaphtho[2,1-d] thiazole, 5-methoxynaphtho[2,3-d]thiazole), selenazole nucleuses (e.g., benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole), oxazole nucleuses (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethylbenzoxazole, 4,6-dimethylbenzoxazole, 5-ethoxybenzoxazole, naphtho-[2,1-d]oxazole, naphtho[1,2-d]oxazole, naphtho[2,3-d]-oxazole), quinoline nucleuses (e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline), 3,3-dialkylindolenine nucleuses (e.g., 3,3-dimethylindolenine, 3,3-diethylindolenine, 3,3-dimethyl-5-cyanoiondolenine, 3,3-dimethyl-5-methoxyindolenine, 3,3-dimethyl-5-methylindolenine, 3,3-dimethyl-5-chloroindolenine), imidazole nucleuses (e.g., 1-methylbenzimidazole, 1-ethylbenzimidazole, 1-methyl-5-chlorobenzimidazole, 1-ethyl-5-chlorobenzimidazole, 1-methyl-5,6-dichlorobenzimidazole,1-ethyl-5,6-dichlorobenzimidazole, 1-ethyl-5-methoxybenzimidazole, 1-methyl-5-cyanobenzimidazole,1-ethyl-5-cyanobenzimidazole, 1-methyl-5-fluorobenzimidazole,1-ethyl-5-fluorobenzimidazole, 1-phenyl-5,6-dichlorobenzimidazole, 1-allyl-5,6-dichlorobenzimidazole, 1-allyl-5-chloroenzimidazole, 1-phenylbenzimidazole, 1-phenyl-5-chlorobenzimidazole, 1-methyl-5-trifluoromethylbenzimidazole, 1-ethyl-5-trifluoromethylbenzimidazole, 1-ethylnaphtho[1,2-d] imidazole), and pyridine nucleuses (e.g., pyridine, 5-methyl-2-pyridine, 3-methyl-4-pyridine). Among them, thiazole nucleuses and oxazole nucleuses are preferred. More preferred are benzthiazole nucleuses, naphthothiazole nucleuses, naphthoxazole nucleuses and benzoxazole nucleuses. m", p and q represent independently 1 or 2 with proviso that when the dye forms an inner salt, q is 1.

$X_1$" represents an acid anion (e.g., chloride, bromide, iodide, tetrafluoroborate, hexafluorophosphate, methylsulfate, ethylsulfate, benzenesulfonate, 4-methylbenzenesulfonate, 4-chlorobenzenesulfonate, 4-nitrobenzenesulfonate, trifluoromethanesulfonate, perchlorate).

The compounds of the formula (III-c) are illustrated in more detail below.

In formula (III-c), $R_1$' and $R_2$' may be the same or different and each is an alkyl group (including a substituted alkyl group). The alkyl group has preferably 1 to 8 carbon atoms. Examples thereof include methyl, ethyl, propyl, butyl, pentyl, heptyl and octyl.

Examples of the substituent for the substituted alkyl group (the alkyl portion has preferably not more than 6 carbon atoms) include a carboxyl group, a sulfo group, a cyano group, a halogen atom (e.g., fluorine, chlorine, bromine), a hydroxyl group, an alkoxycarbonyl group (having preferably not more than 8 carbon atoms such as methoxycarbonyl, ethoxycarbonyl, benzyloxycarbonyl), an alkoxy group (having preferably not more than 7 carbon atoms such as methoxy, ethoxy, propoxy, butoxy, benzyloxy), an aryloxy group (e.g., phenoxy, p-tolyloxy), an acyloxy group (having preferably not more than 3 carbon atoms such as acetyloxy, propionyloxy), an acyl group (having preferably not more than 8 carbon atoms such as acetyl, propionyl, benzoyl, mesyl), a carbamoyl group (e.g., carbamoyl, N,N-dimethylcarbamoyl, morphlinocarbamoyl, piperidinocarbamoyl), a sulfamoyl group (e.g., sulfamoyl, N,N-dimethylsulfamoyl, morpholinosulfonyl) and an aryl group (e.g., phenyl, p-hydroxyphenyl, p-carboxyphenyl, p-sulfophenyl, α-naphthyl). The alkyl group may be substituted by one or more of these substituents.

$R_3$' and $R_4$' each represents a hydrogen atom, a lower alkyl group (having preferably 1 to 4 carbon atoms such as methyl, ethyl, propyl, butyl), a lower alkoxy group (having preferably 1 to 4 carbon atoms such as methoxy, ethoxy, propoxy, butoxy), a phenyl group, a benzyl group or a phenethyl group, with a lower alkyl group or benzyl group being particularly preferred.

$R_5$' and $R_6$' each represents a hydrogen atom, or $R_5$' and $R_6$' are bonded to form a bivalent alkylene group (e.g., ethylene or trimethylene). The alkylene group may be substituted by one or more suitable substituents such as an alkyl group (having preferably 1 to 4 carbon atoms such as methyl, ethyl, propyl, isopropyl, butyl), a halogen atom (e.g., chlorine, bromine) and an alkoxy group (having preferably 1 to 4 carbon atoms such as methoxy, ethoxy, propoxy, isopropoxy, butoxy).

$R_7$' represents a hydrogen atom, a lower alkyl group (having preferably 1 to 4 carbon atoms such as methyl, ethyl, propyl), a lower alkoxy group (having preferably 1 to 4 carbon atoms such as methoxy, ethoxy, propoxy, butoxy), a phenyl group, a benzyl group or —N($W_1$')($W_2$') wherein $W_1$' and $W_2$' represent independently an alkyl group (including a substituted alkyl group, the alkyl portion has preferably 1 to 18 carbon atoms, more preferably 1 to 4 carbon atoms, such as methyl, ethyl, propyl, butyl, benzyl, phenylethyl) or an aryl group (including a substituted phenyl group, such as phenyl, naphthyl, tolyl, p-chlorophenyl, or $W_1$' and $W_2$' may be bonded to form a five-membered or six-membered nitrogen-containing heterocyclic ring. $R_3$' and $R_7$' or $R_4$' and $R_7$' may be bonded to form a bivalent alkylene group (which has the same meaning as in the case where $R_5$' and $R_6$' are bonded to form a bivalent alkylene group).

$Z_1$' and $Z_2$' each represents a non-metallic atomic group necessary for forming a five-membered or six-membered nitrogen-containing heterocyclic ring. Examples of the nitrogen-containing heterocyclic ring include thiazole nucleuses (e.g., benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-carboxybenzothiazole, 5-ethoxycarbonylbenzothiazole, 5-phenethylbenzothiazole, 5-fluorobenzothiazole, 5-trifluoromethylbenzothiazole, 5,6-dimethylbenzothiazole, 5-hydroxy-6-methylbenzothiazole, tetrahydrobenzothiazole, 4-phenylbenzothiazole, naphtho[2,1-d]thiazole, naphtho-[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 5-methoxynaphtho[2,3-d]thiazole), selenazole nucleuses (e.g., benzoselenazole, 5-chlorobenzoselenazole, 5-methoxybenzoselenazole, 5-methylbenzoselenazole, 5-hydroxybenzoselenazole, naphtho[2,1-d]selenazole, naphtho[1,2-d]selenazole), oxazole nucleuses (e.g., benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-trifluorobenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, 5,6-dimethoxybenzoxazole, 4,6-dimethylbenzoxazole, 5-ethoxybenzoxazole, naphtho[2,1-d]oxazole, naphtho[1,2-d]oxazole, naphtho[2,3-d]oxazole), quinoline nucleuses (e.g., 2-quinoline, 3-methyl-2-quinoline, 5-ethyl-2-quinoline, 6-methyl-2-quinoline, 8-fluoro-2-quinoline, 6-methoxy-2-quinoline, 6-hydroxy-2-quinoline, 8-chloro-2-quinoline, 8-fluoro-4-quinoline), 3,3-dialkylindolenine nucleuses (e.g., 3,3-dimethylindolenine, 3,3-diethylindolenine, 3,3-dimethyl-5-cyanoindolenine, 3,3-dimethyl-5-methoxyindolenine, 3,3-dimethyl-5-methylindolenine, 3,3-dimethyl-5-chloroindolenine), imidazole nucleuses (e.g.,1-methylbenzimidazole,1-ethylbenzimidazole,1-methyl-5-chlorobenzimidazole, 1-ethyl-5-chlorobenzimidazole,1-methyl-5,6-dichlorobenzimidazole, 1-ethyl-5,6-dichlorobenzimidazole, 1-ethyl-5-methoxybenzimidazole,1-methyl-5-cyanobenzimidazole, 1-ethyl-5-cyanobenzimidazole,1-methyl-5-fluorobenzimidazole, 1-ethyl-5-fluorobenzimidazole, 1-phenyl-5,5-dichlorobenzimidazole, 1-allyl-5,6-dichlorobenzimidazole, 1-allyl-5-chlorobenzimidazole, 1-phenylbenzimidazole, 1-phenyl-5-chlorobenzimidazole,1-methyl-5-trifluoromethylbenzimidazole, 1-ethyl-5-trifluoromethylbenzimidazole, 1-ethylnaphtho[1,2-d]imidazole) and pyridine nucleuses (e.g., pyridine, 5-methyl-2-pyridine, 3-methyl-4-pyridine). Among them, thiazole and oxazole nucleuses are preferred. More preferred are benzothiazole, naphthothiazole, naphthoxazole and benzoxazole nucleuses.

$X_1'$ represents an acid anion (e.g., chloride, bromide, iodide, tetrafluoroborate, hexafluorophosphate, methylsulfate, ethylsulfate, benzenesulfonate, 4-methylbenzenesulfonate, 4-chlorobenzenesulfonate, 4-nitrobenzenesulfonate, trifluoromethanesulfonate, perchlorate), and m' represents 1 or 2. When the dye forms an inner salt, m' is 1.

Examples of the compounds of the formula (III-a), (III-b) and (III-c) which can be used in the present invention include, but are not limited to, the following compounds:

(III-1)

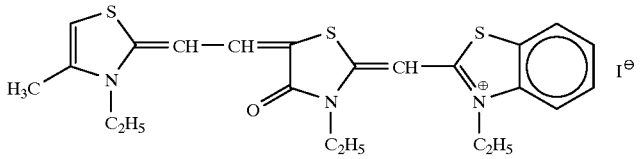

(III-2)

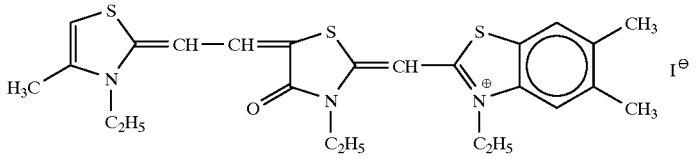

(III-3)

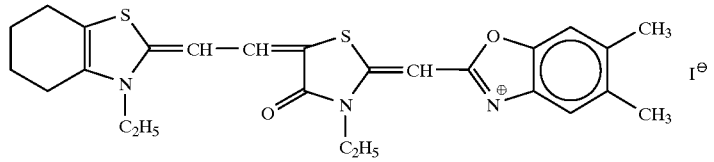

(III-4)

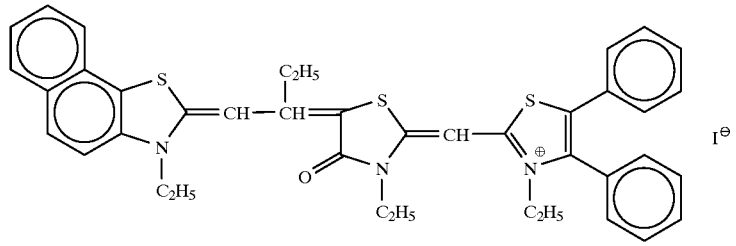

(III-5)

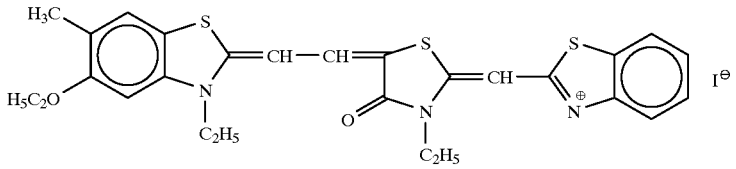

-continued
(III-6)
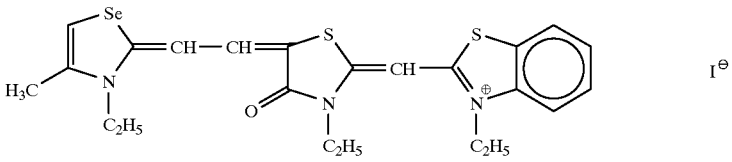
(III-7)
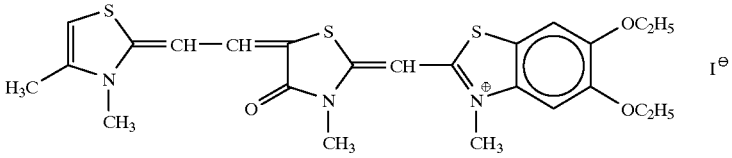
(III-8)
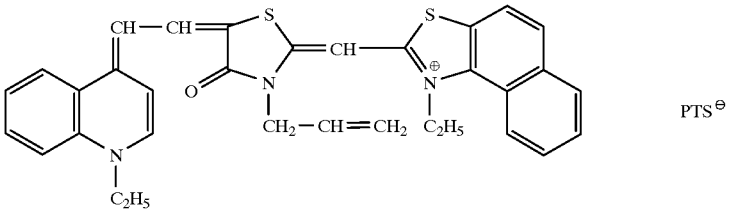
(III-9)
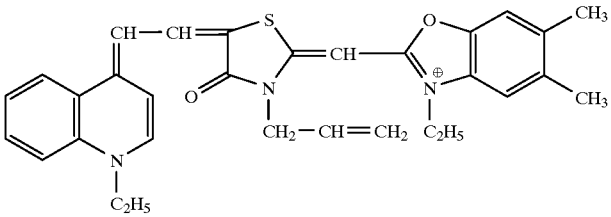
(III-10)
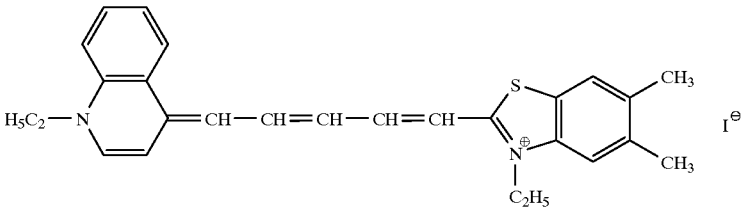
(III-11)
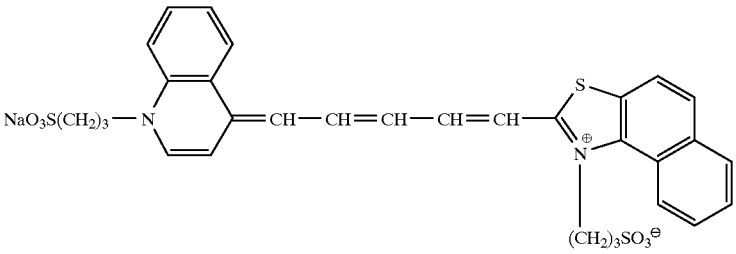
(III-12)
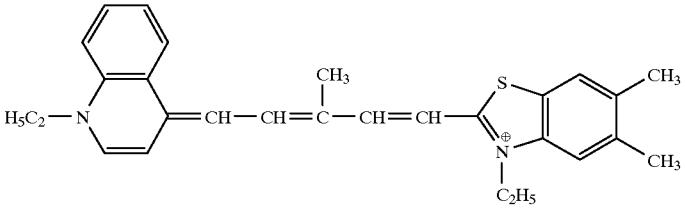

-continued
(III-13)
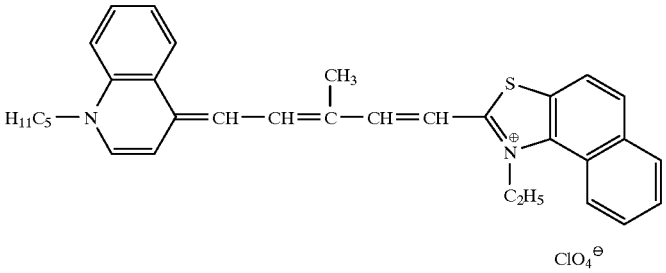
(III-14)
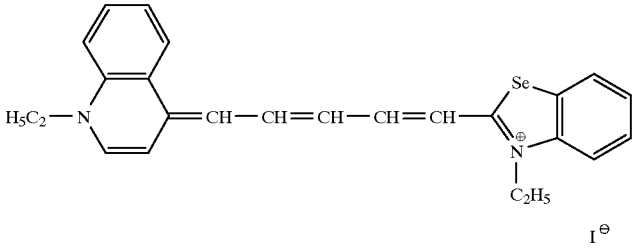
(III-15)
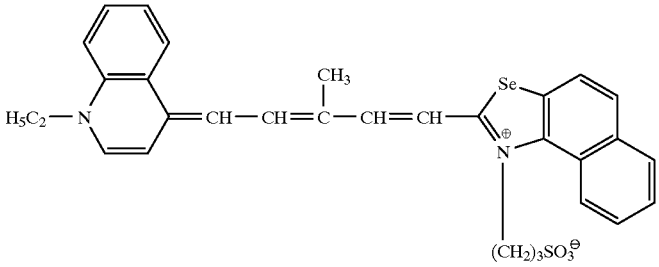
(III-16)
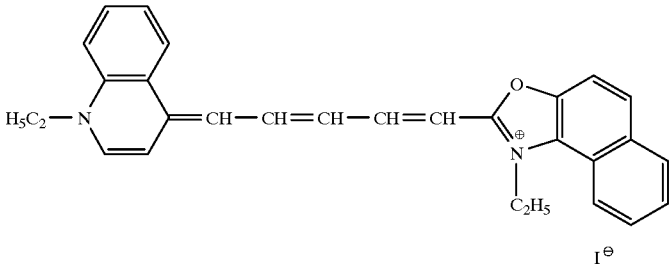
(III-17)
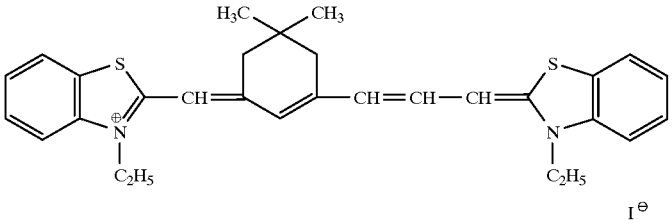

-continued
(III-18)
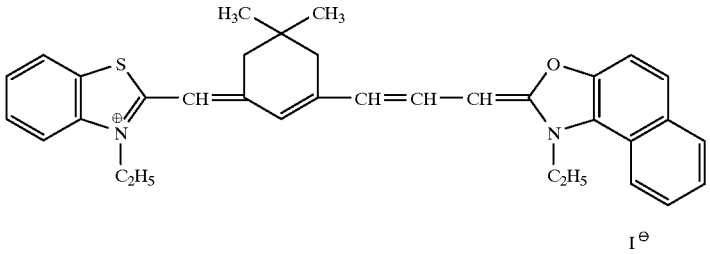
(III-19)
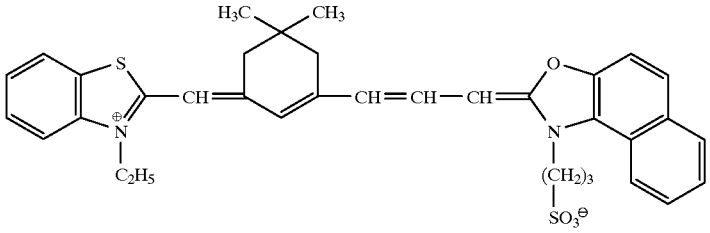
(III-20)
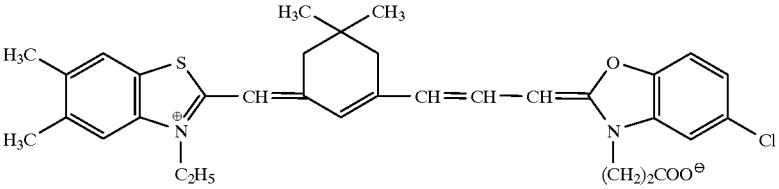
(III-21)
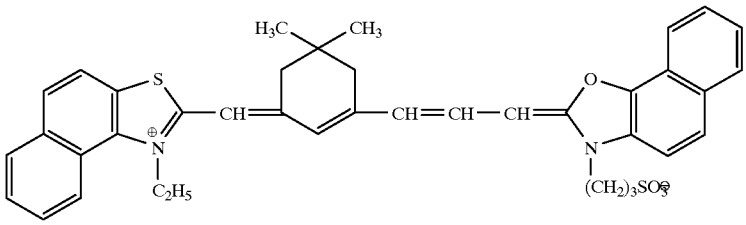
(III-22)
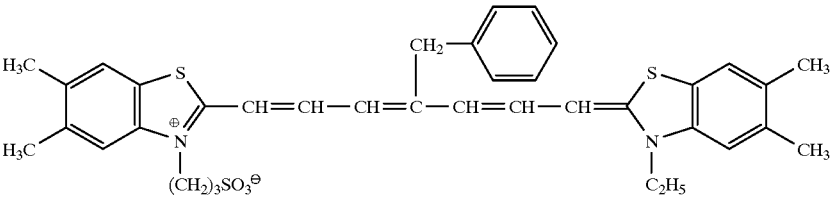
(III-23)
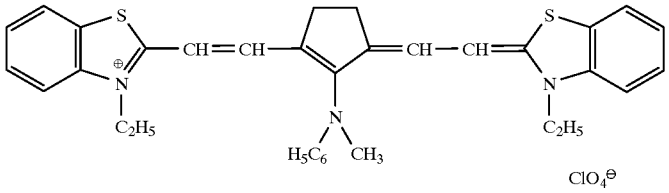

-continued (III-24)

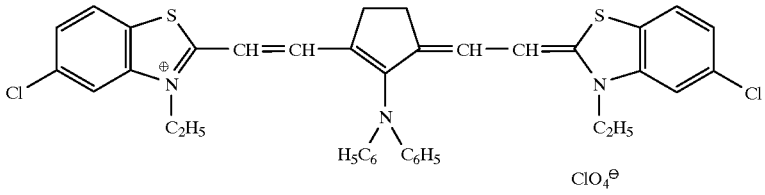

(III-25)

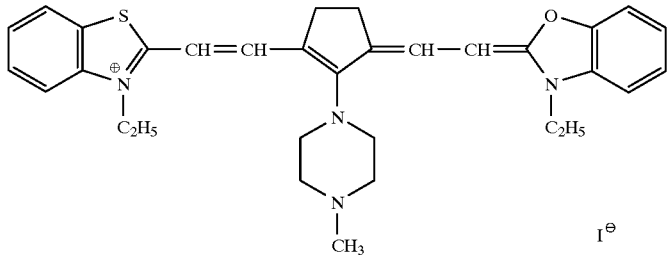

These sensitizing dyes of general formulas (III-a), (III-b) and (III-c) may be used either alone or in combination. The combinations of the sensitizing dyes are often used for the purpose of supersensitization. In addition to the sensitizing dyes, the emulsions may contain a dye which itself does not have a spectral sensitization effect or a substance which substantially does not absorb visible light, but has a supersensitization effect.

Examples of combinations of useful sensitizing dyes with dyes having a supersensitization effect and examples of the substance having a supersensitization effect are described in *Research Disclosure*, Vol. 176, No. 17643 (December 1978), page 23, item IV-J, JP-B-49-25500, JP-B-43-4933, JP-A-59-19032 and JP-A-59-192242.

The optimum amounts of the sensitizing dyes of the formulas (III-a), (III-b) and (III-c) to be contained in the silver halide emulsions vary depending on the particle sizes and halogen compositions of the silver halide grains, the type and degree of chemical sensitization, the relationship between the layer containing the sensitizing dye and silver halide emulsion, the types of anti-fogging compounds, etc. The optimum amounts can be easily determined by experiments by those skilled in the art. Generally, the sensitizing dyes are used in an amount of preferably $1\times10^{-7}$ to $1\times10^{-2}$ mol, particularly preferably $1\times10^{-6}$ to $5\times10^{-3}$ mol, per mol of silver halide.

The compounds of the formula (IV) which are used in combination with the compounds of the formulas (III-a), (III-b) and (III-c) are illustrated in more detail below.

In formula (IV), —A— represents a bivalent aromatic group which may have a $—SO_3M$ group (wherein M is a hydrogen atom or a cation such as sodium or potassium which makes the compound water-soluble).

A suitable —A— is selected from the group consisting of the following $—A_1—$ and $—A_2—$ groups. When $R_{21}$, $R_{22}$, $R_{23}$ or $R_{24}$ does not have a $—SO_3M$ group, —A— is selected from among the following $—A_1—$ groups. $—A_1—$:

($A_1$-1)

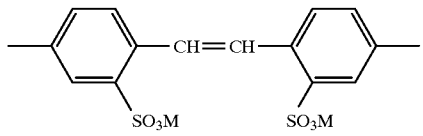

($A_1$-2)

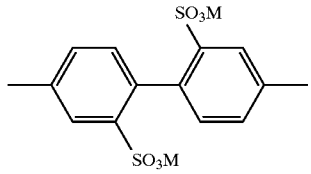

($A_1$-3)

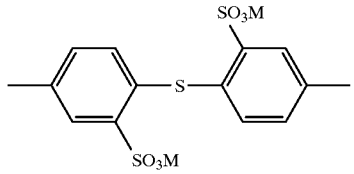

-continued ($A_1$-4)

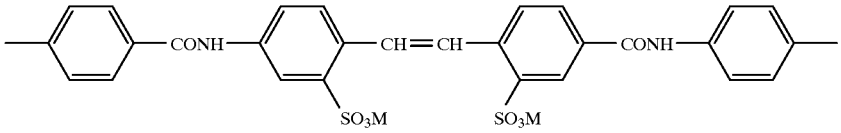

($A_1$-5)

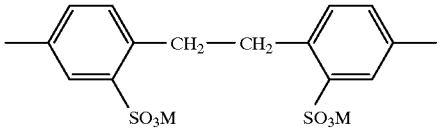

($A_1$-6)

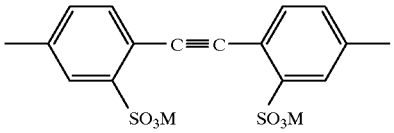

($A_1$-7)

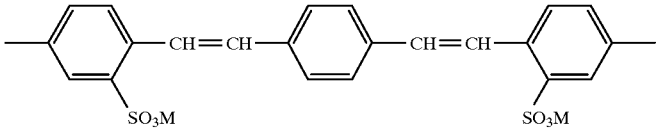

($A_1$-8)

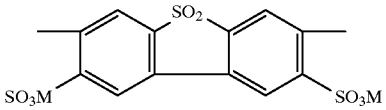

($A_1$-9)

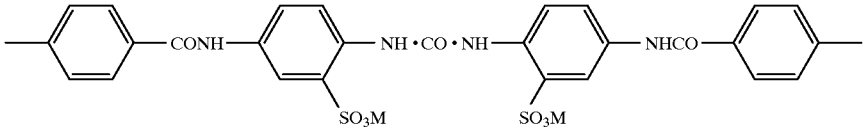

M is a hydrogen atom or a cation which makes the compound water-soluble. —$A_2$—:

($A_2$-1)

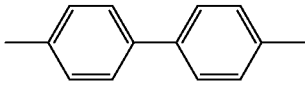

($A_2$-2)

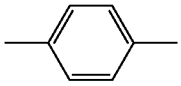

($A_2$-3)

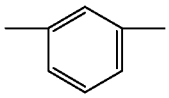

($A_2$-4)

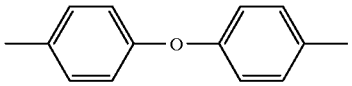

-continued ($A_2$-5)

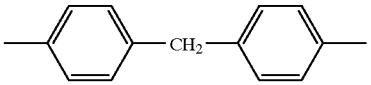

($A_2$-6)

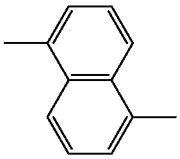

($A_2$-7)

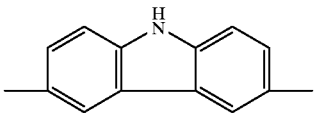

$R_{21}$, $R_{22}$, $R_{23}$ and $R_{24}$ each represents a hydrogen atom, hydroxyl group, a lower alkyl group (having preferably 1 to 8 carbon atoms such as methyl, ethyl, n-propyl, n-butyl), an alkoxy group (having preferably 1 to 8 carbon atoms such as methoxy, ethoxy, propoxy, butoxy), an aryloxy group (e.g., phenoxy, naphthoxy, o-tolyloxy, p-sulfophenoxy), a halogen atom (e.g., chlorine, bromine), a heterocyclic nucleus (e.g., morpholinyl, piperidyl), an alkylthio group (e.g., methylthio, ethylthio), a heterocyclic thio group (e.g., benzothiazolylthio group, benzimidazolylthio group, phenyltetrazolylthio group), an arylthio group (e.g., phenylthio, tolylthio), an amino group, an unsubstituted or substituted alkylamino group (e.g., methylamino, ethylamino, propylamino, dimethylamino, diethylamino, dodecylamino, cyclohexylamino, β-hydroxyethylamino, di-(β-hydroxyethyl)amino, β-sulfoethylamino), an unsubstituted or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), a heterocyclic amino group (e.g., 2-benzothiazolylamino, 2-pyridylamino), a substituted or unsubstituted aralkylamino group (e.g., benzylamino, o-anisylamino, m-anisylamino, p-anisylamino), a substituted or unsubstituted aryl group (e.g., phenyl) or a mercapto group. $R_{21}$, $R_{22}$, $R_{23}$ and $R_{24}$ may be the same or different. When —A— is selected from among the —$A_2$— groups, at least one of $R_{21}$, $R_{22}$, $R_{23}$ and $R_{24}$ must be a group having a sulfo group (in the form of a free acid or in the form of a salt). $W_3$ and $W_4$ each represents —CH═ or —N═, and at least one of $W_3$ and $W_4$ is —N═.

Examples of the compounds of the formula (IV) include, but are not limited to, the following compounds:

(IV-1) Disodium salt of 4,4'-bis[4,6-di(naphthyl-2-oxy) pyrimidine-2-ylamino]stilbene-2,2'-disulfonic acid (IV-2) Disodium salt of 4,4'-bis[4,6-di(naphthyl-2-oxy) pyrimidine-2-ylamino]bibenzyl-2,2'-disulfonic acid (IV-3) Disodium salt of 4,4'-bis[4,6-dianilinopyrimidine-2-ylamino)stilbene-2,2'-disulfonic acid (IV-4) Disodium salt of 4,4'-bis[4,6-diphenoxypyrimidine-2-ylamino)stilbene-2,2'-disulfonic acid (IV-5) Disodium salt of 4,4'-bis[4,6-dianilinotriazine-2-ylamino)stilbene-2,2'-disulfonic acid (IV-6) Disodium salt of 4,4'-bis[4-anilino-6-hydroxytriazine-2-ylamino)stilbene-2,2'-disulfonic acid (IV-7) Disodium salt of 4,4'-bis[4-naphthylamino-6-anilino-triazine-2-ylamino)stilbene-2,2'-disulfonic acid (IV-8) 4,4'-Bis[2,6-di(2-naphthoxy)pyrimidine-4-ylamio] stilbene-2,2'-disulfonic acid (IV-9) Disodium salt of 4,4'-bis[2,6-di(2-naphthylamino) pyrimidine-4-ylaminolstilbene-2,2'-disulfonic acid (IV-10) Disodium salt of 4,4'-bis(2,6-dianilinopyrimidine-4-ylamino)stilbene-2,2'-disulfonicacid (IV-11) 4,4'-Bis(2-naphthylamino-6-anilinopyrimidine-4-ylamino)stilbene-2,2'-disulfonic acid The compounds of the formula (IV) are known or can be prepared by known methods (e.g., methods described in U.S. Pat. No. 4,536,473).

The compounds of the formula (IV) may be used either singly or as a mixture of two or more. The compounds of the formula (IV) are used in an amount of preferably 0.01 to 5 g and more preferably 0.1 to 2 g, per mol of silver halide in the emulsion.

The spectral sensitizing dyes of the formulas (III-a), (III-b) and (III-c) and the compounds of the formula (IV) are used in a ratio of the dye/the compound of the formula (IV) of preferably from 1/1 to 1/200, particularly preferably from 1/2 to 1/50.

It may be suitable for the compounds represented by formula (IX) are used together with the sensitizing dyes in the present invention:

(IX)

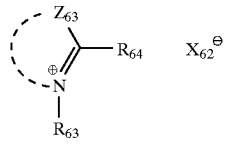

In formula (IX), $Z_{63}$ represents a non-metallic atomic group necessary for forming a five-membered or six-membered nitrogen-containing heterocyclic ring. Examples of the nitrogen-containing heterocyclic ring include thiazolium rings (e.g., thiazolium, 4-methylthiazolium, benzthiazolium, 5-methylbenzothiazolium, 5-chlorobenzothiazolium, 5-methoxybenzothiazolium, 6-methylbenzothiazolium, 6-methoxybenzothiazolium naphtho-[1,2-d]thiazolium, naphtho[2,1-d]thiazolium), oxazolium rings (e.g., oxazolium, 4-methyloxazolium, benzoxazolium, 5-chlorobenzoxazolium, 5-phenylbenzoxazolium, 5-methylbenzoxazolium, naphtho [1,2-d]oxazolium), imidazolium rings (e.g.,1-methylbenzimidazolium, 1-propyl-5-chlorobenzimidazolium, 1-ethyl-5,6-dichlorobenzimidazolium, 1-allyl-5-trichloromethyl-6-chlorobenzimidazolium) and selenazolium rings (e.g., benzoselenazolium, 5-chlorobenzoselenazolium, 5-methylbenzoselenazolium, 5-methoxybenzoselenazolium, naphtho[1,2-d]selenazolium). $R_{63}$ represents a hydrogen atom, an alkyl group (having not more than 8 carbon atoms such as methyl, ethyl, propyl, butyl, pentyl) or an alkenyl group (e.g., allyl). $R_{64}$ represents a hydrogen atom or a lower alkyl group (e.g., methyl, ethyl). $X_{62}$ represents an acid anion (e.g., $Cl^-$, $Br^-$, $I^-$, $ClO_4^-$, p-toluenesulfonate). Among the $Z_{63}$ groups thiazoliums are preferred, and substituted or unsubstituted benzothiazoliums or naphthothiazoliums are more preferred.

Examples of the compounds of the formula (IX) which can be used in the present invention include, but are not limited to, the following compounds:

(IX-1)

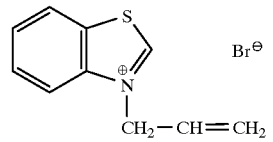

(IX-2)

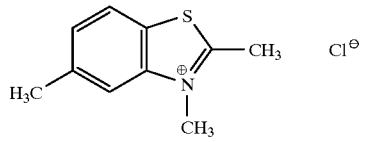

(IX-3)

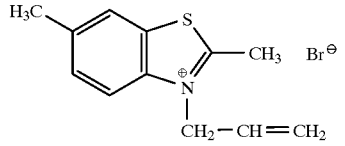

-continued (IX-4)

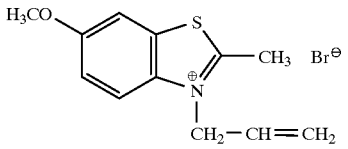

(IX-5)

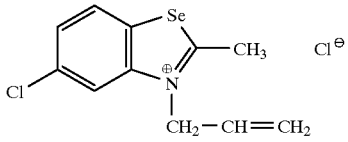

The compounds of the formula (IX) are used in an amount of preferably about 0.01 to 5 g per mol of silver halide in the emulsion.

The above-described sensitizing dyes of the present invention and the compounds of the formula (IX) are used in a ratio of the dye/the compound of the formula (IX) of preferably from 1/1 to 1/300, particularly preferably from 1/2 to 1/50.

The light-sensitive materials of the present invention may contain various compounds to prevent fogging from occurring during the preparation, storage or photographic processing of the light-sensitive materials or to stabilize photographic performance. For example, the light-sensitive materials of the present invention may contain various compounds known as anti-fogging agents or stabilizers, such as azoles (e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles); mercaptopyrimidines; mercaptotriazines; thioketo compounds (e.g., oxazolinethione); azaindenes (e.g., triazaindenes, tetrazaindenes (particularly 4-hydroxy-substituted (1,3,3a,7)-tetraazaindenes), pentaazaindenes); and benzenesulfonic acids, benzenesulfinic acids and benzenesulfonic acid amides.

It is preferred from the viewpoint of improving pressure resistance without detriment to sensitivity and further from the viewpoint of improving dependence of processing on the composition of processing solutions and long-time stability that at least one polyhydroxy compound is contained in the light-sensitive materials of the present invention. It is preferred that the polyhydroxybenzene compound is a compound represented by formula (VII-a), (VII-b) or (VII-c):

(VII-a)

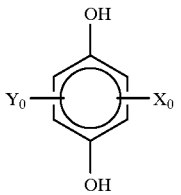

(VII-b)

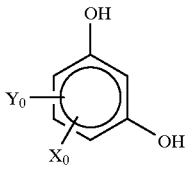

-continued (VII-c)

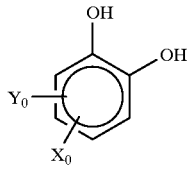

The compounds of the formulas (VII-a), (VII-b) and (VII-c) are illustrated below.

$X_0$ and $Y_0$ each represents —H, —OH, a halogen atom, —OM (wherein M is an alkali metal ion), an alkyl group, a phenyl group, an amino group, a carbonyl group, a sulfone group, a sulfonated phenyl group, a sulfonated alkyl group, a sulfonated amino group, a sulfonated carbonyl group, a carboxyl group, a carboxyphenyl group, a carboxyalkyl group, a carboxyamino group, a hydroxyphenyl group, a hydroxyalkyl group, an alkyl ether group, an alkylphenyl group, an alkylthioether group or a phenylthioether group. More preferably, $X_0$ and $Y_0$ are each —H, —OH, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3Na$, $—SO_3H$,

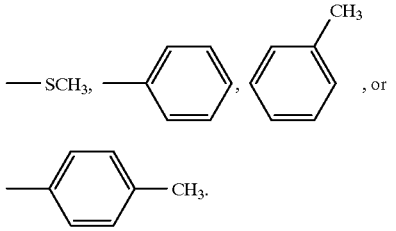

$X_0$ and $Y_0$ may be the same or different.

Typical examples of the polyhydroxybenzene compounds which are particularly preferably used in the present invention include the following compounds:

E-(1)

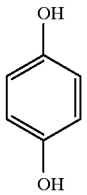

E-(2)

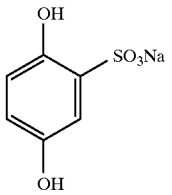

-continued

E-(3)

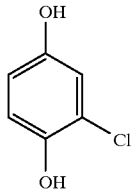

E-(4)

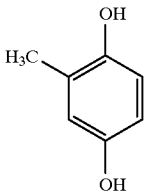

E-(5)

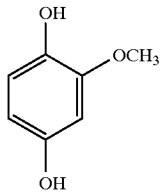

E-(6)

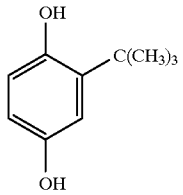

The polyhydroxybenzene compounds may be added to the emulsion layers of the light-sensitive materials or to layers other than the emulsion layers. The polyhydroxybenzene compounds are used in an amount of preferably $1\times10^{-5}$ to 1 mol, particularly preferably $1\times10^{-3}$ to $1\times10^{-1}$ mol, per mol of silver halide.

The hydrophilic colloid layers of the light-sensitive materials of the present invention may contain water-soluble dyes as filter dyes or for other various purposes, for example, the present irradiation.

Examples of useful dyes include oxonol dyes, hemioxanol dyes, styryl dyes, merocyanine dyes, cyanine dyes and azo dyes. Among them, oxonol dyes, hemioxonol dyes and merocyanine dyes are preferred. Compounds represented by formulas (VIII-a), (VIII-b) and (VIII-c) are particularly preferred as the dyes which are used in the present invention:

(VIII-a)

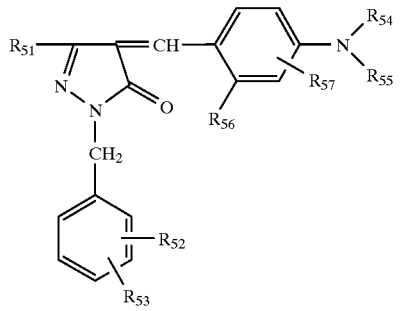

In formula (VIII-a), $R_{51}$ represents a substituted or unsubstituted alkyl group having 1 to 6 carbon atoms (e.g., methyl, ethyl, n-propyl, n-butyl, n-hexyl, isopropyl, carboxymethyl, hydroxyethyl) or a substituted or unsubstituted alkoxy group having 1 to 6 carbon atoms (e.g., methoxy, ethoxy, n-butoxy, methoxyethoxy, hydroxyethoxy); $R_{52}$ and $R_{53}$ each represents a hydrogen atom, a halogen atom (e.g., chlorine, bromine), a substituted or unsubstituted alkyl group having 1 to 6 carbon atoms (e.g., methyl, ethyl, n-propyl, n-butyl, n-hexyl, hydroxyethyl), a substituted or unsubstituted alkoxy group having 1 to 6 carbon atoms (e.g., methoxy, ethoxy, n-butoxy, methoxyethoxy, hydroxyethoxy), a hydroxy group, a carboxyl group or a salt thereof or a sulfo group or a salt thereof, and at least one of $R_{52}$ and $R_{53}$ is a sulfo group or a salt thereof; $R_{54}$ and $R_{55}$ each represents a substituted or unsubstituted alkyl group having 1 to 6 carbon atoms (e.g., methyl, ethyl, n-propyl, sulfoethyl, methanesulfonamidoethyl, carboxymethyl, hydroxyethyl, carboxypropyl, ethoxycarbonylmethyl); $R_{56}$ represents a substituted or unsubstituted alkyl group having 1 to 6 carbon atoms (e.g., methoxy, ethoxy, n-butoxy, hydroxyethoxy); and $R_{57}$ represents a hydrogen atom, a halogen atom (e.g., chlorine, bromine), a substituted or unsubstituted alkyl group having 1 to 6 carbon atoms (e.g., methyl, ethyl, n-propyl, hydroxyethyl) or a substituted or unsubstituted alkoxy group having 1 to 6 carbon atoms (e.g., methoxy, ethoxy, hydroxyethoxy, n-butoxy);

(VIII-b)

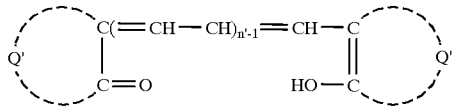

in formula (VIII-b), Q' represents an atomic group necessary for forming a heterocyclic nucleus of pyrazolone, barbituric acid, thiobarbituric acid, isoxazolone, 3-oxythionaphthene or 1,3-indandione, and n' represents 0 or 1;

(VIII-c)

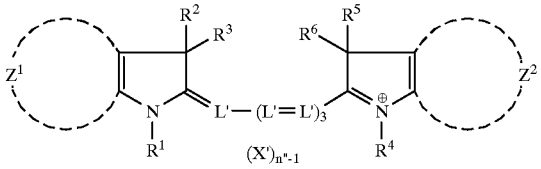

in formula (VIII-c), $R^1$, $R^2$, $R^3$, $R^4$, $R^5$ and $R^6$ may be the same or different and each represents a substituted or unsubstituted alkyl group; $Z^1$ and $Z^2$ each represents a non-metallic atomic group necessary for forming a substituted or unsubstituted benz- or naphtho-condensed ring, and at least 3, preferably 4 to 6, of $R^1$, $R^2$, $R^3$, $R^4$, $R^5$, $R^6$, $Z^1$ and $Z^2$ have an acid-substituted group (e.g., sulfo or carboxyl). Particularly preferably the dye molecule has groups which can be substituted by 4 to 6 sulfo groups. The term "sulfo group" as used herein includes both sulfo group and a salt thereof. The term "carboxyl group" as used herein includes both carboxyl group and a salt thereof. Examples of the salt include alkali metal salts such as Na and K, ammonium salt and organic ammonium salts such as triethylamine salt, tributylamine salt and pyridine salt.

L' represents a substituted or unsubstituted methine group, and X' represents an anion. Examples of the anion include halogen ions (Cl, Br), p-toluenesulfonate ion and ethylsulfate ion.

n" represents 1 or 2, and when the dye forms an inner salt, n" is 1.

Examples of the dye compounds of the formulas (VIII-a), (VIII-b) and (VIII-c) which can be used in the present invention include, but are not limited to, the following compounds:

(VIII-1)

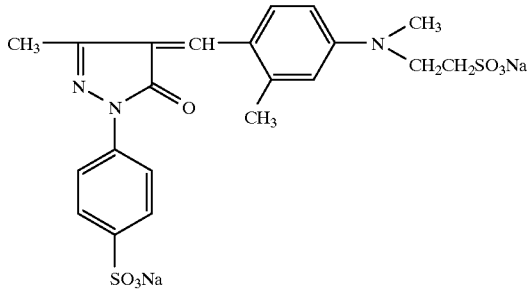

(VIII-2)

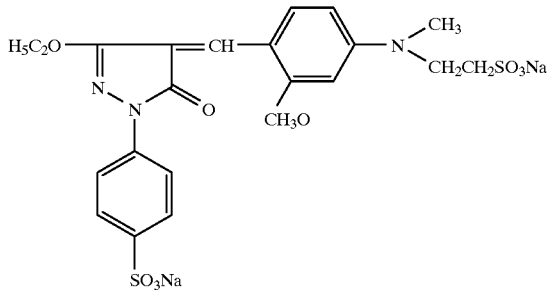

(VIII-3)

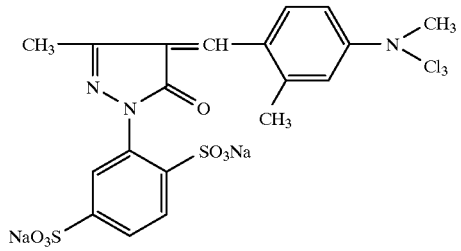

(VIII-4)

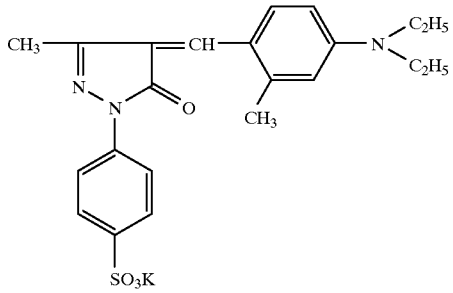

-continued
(VIII-5)
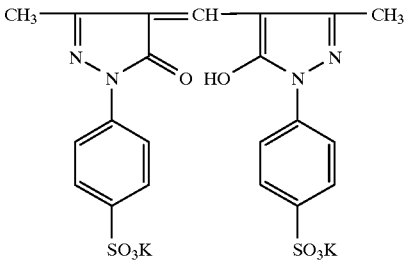
(VIII-6)
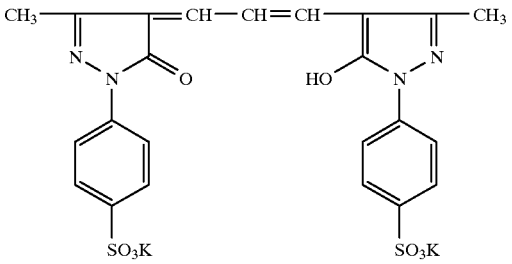
(VIII-7)
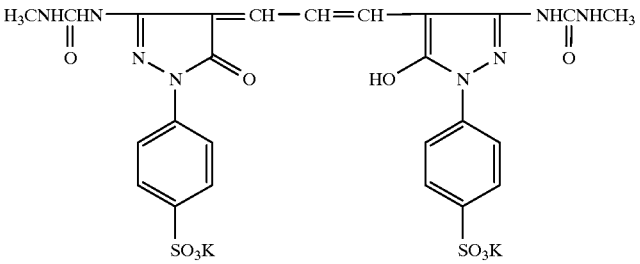
(VIII-8)
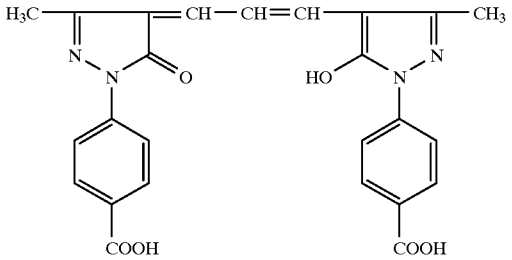
(VIII-9)
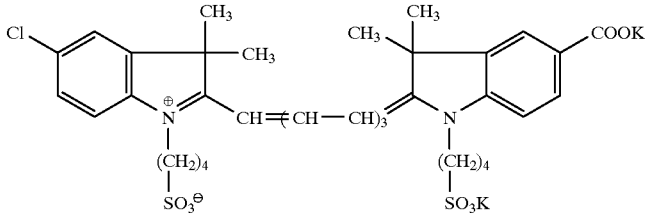
(VIII-10)
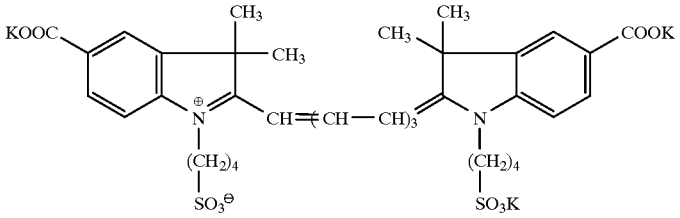

-continued
(VIII-11)
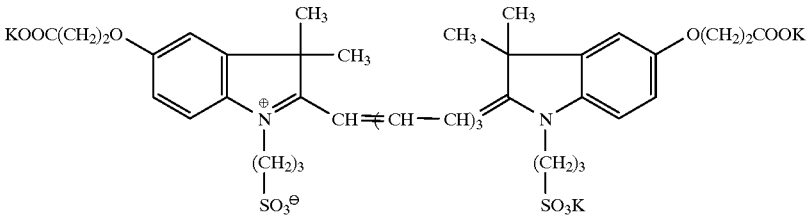
(VIII-12)
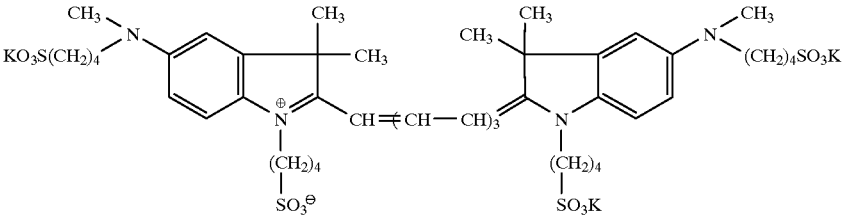
(VIII-13)
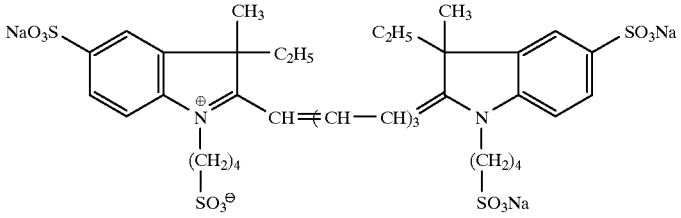
(VIII-14)
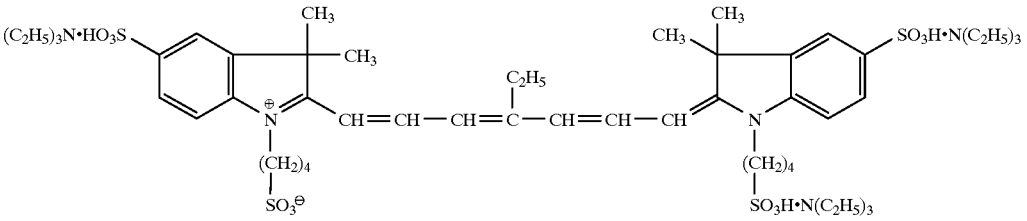
(VIII-15)
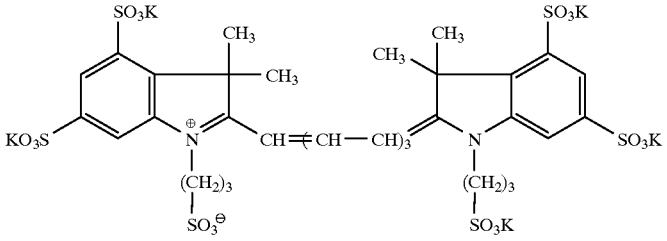
(VIII-16)
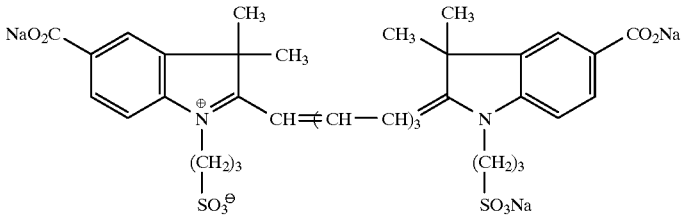

-continued (VIII-17)

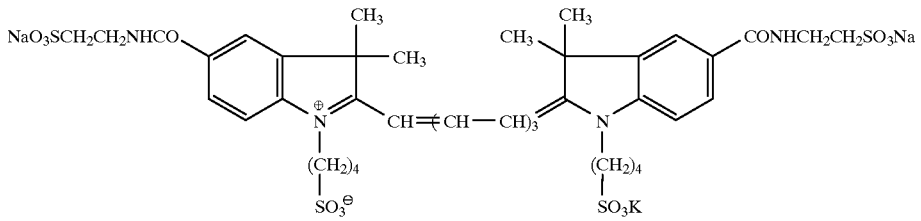

(VIII-18)

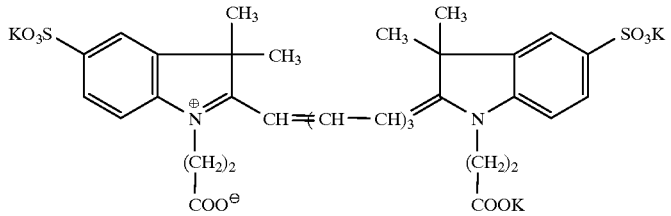

(VIII-19)

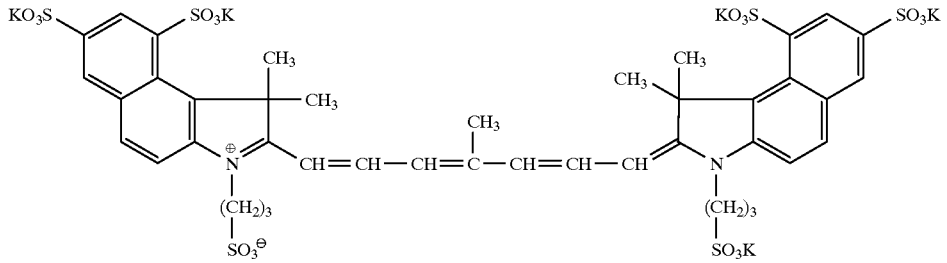

(VIII-20)

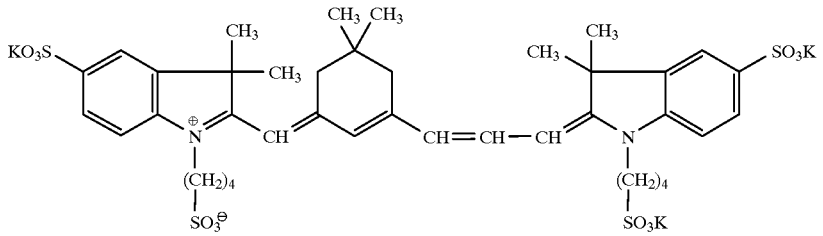

These dyes are used in an amount of generally 0.0001 to 2 g/m$^2$, preferably 0.001 to 1 g/m$^2$. These dyes may be used alone or in combination. If desired, these dyes may be used in combination with other dyes.

The photographic emulsion layers of the photographic materials of the present invention may contain developing agents such as polyalkylene oxides or ether, ester or amine derivatives thereof, thioether compounds, thiomorpholines, quaternary ammonium salt compounds, urethane derivatives, urea derivatives, imidazole derivatives, 3-pyrazolidones and aminophenols to increase sensitivity or contrast or to accelerate development.

Among them, 3-pyrazolidones (e.g., 1-phenyl-3-pyrazolidone, 1-phenyl-4-methyl-4-hydroxymethyl-3-pyrazolidone) are preferred. These compounds are used in an amount of generally not more than 5 g/m$^2$, preferably 0.01 to 0.2 g/m$^2$.

The photographic emulsions and non-sensitive hydrophilic colloid layers of the photographic materials of the present invention may contain inorganic or organic hardening agents. . Examples of such hardening agents include active vinyl compounds (e.g., 1,3,5-triacryloyl-hexahydro-s-triazine, bis(vinylsulfonyl)methyl ether, N,N-methylene-bis[β-(vinylsulfonyl)propioneamide), active halogen compounds (e.g., 2,4-dichloro-6-hydroxy-s-triazine), mucohalogenic acids (e.g., mucochloric acid), N-carbamoylpyridinium salts (e.g., (1-morphlinocarbonyl-3-pyridinio)methanesulfonate) and haloamidinium salts (e.g., (1-(1-chloro-1-pyridinomethylene)pyrrolidinum 2-naphthalenesulfonate). These compounds may be used alone or in combination. Particularly, the active vinyl compounds described in JP-A-53-41220, JP-A-53-57257, JP-A-59-162546 and JP-A-60-80846 and active halogen compounds described in U.S. Pat. No. 3,325,287 are preferred.

The photographic emulsion layers and other hydrophilic colloid layers of the light-sensitive materials of the present invention may contain various surfactants as coating aids or to impart antistatic properties, improve a sliding property or emulsification dispersion, prevent an adhesive property or improve photographic characteristics (e.g., development acceleration, increase of contrast, sensitization).

Examples of such surfactants include nonionic surfactants such as saponin (steroid); alkylene oxide derivatives (e.g., polyethylene glycol, polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines or amides, polyethylene oxide adducts of silicone); glycidol derivatives (e.g., alkenylsuccinic acid polyglycerides, alkylphenol polyglycerides), fatty acid esters of polyhydric alcohols and alkyl esters of sugar; anionic surfactants having an acid group such as a carboxyl group, a sulfo group, a phospho group, a sulfuric acid ester group or a phosphoric acid ester group, such as alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyethylene alkylphenyl ethers and polyoxyethylene alkylphosphoric acid esters; ampholytic surfactants such as salts of amino acids, aminoalkylsulfonic acids, aminoalkylsulfuric acid or phosphoric acid esters, alkylbetaines and amino oxides; and cationic surfactants such as alkylamine salts, aliphatic or aromatic quaternary ammonium salts, heterocyclic quaternary ammonium salts (e.g., pyridinium or imidazolium) and phosphonium or sulfonium salts having an aliphatic or heterocyclic ring.

It is preferred that the fluorine-containing surfactants described in JP-A-60-80849 are used when antistatic properties are to be imparted.

The photographic emulsion layers and other hydrophilic colloid layers of the photographic materials of the present invention may contain matting agents such as silica, magnesium oxide and polymethyl methacrylate to prevent sticking.

The light-sensitive materials of the present invention may contain a dispersion of a synthetic polymer which is insoluble or sparingly soluble in water to stabilize the dimensions of the materials. Examples of the polymer include polymers obtained by using monomer compounds such as an alkyl (meth)acrylate, an alkoxyacrylic (meth) acrylate and glycidyl (meth)acrylate either alone or in combination or by using a combination of these monomers with acrylic acid or methacrylic acid as a monomer component.

Gelatin can be advantageously used as a binder or protective colloid for the photographic emulsions. Other hydrophilic colloids can also be used. Examples of other hydrophilic colloids which can be used in the present invention include protein such as gelatin derivatives, graft polymers of gelatin with other high-molecular materials, albumin and casein; cellulose derivatives such as hydroxyethyl cellulose, carboxymethyl cellulose and cellulose sulfate; sugar derivatives such as sodium alginate and starch derivatives; and various synthetic hydrophilic high-molecular materials such as homopolymers, for example, polyvinyl alcohol, polyvinyl alcohol partial acetal, poly-N-vinylpyrrolidone, polyacrylic acid, polymethacrylic acid, polyacrylamide, polyvinyl imidazole and polyvinyl pyrazole and copolymers thereof.

Examples of gelatin include lime-processed gelatin, acid-processed gelatin, hydrolyzate of gelatin and enzymatic hydrolyzate of gelatin.

The silver halide emulsion layers of the present invention may contain polymer latexes such as alkyl acrylates.

Examples of the support for the light-sensitive materials of the present invention include cellulose triacetate, cellulose diacetate, nitrocellulose, polystyrene, polyethylene terephthalate paper, baryta paper and polyolefin-coated paper.

It is preferred from the viewpoint of easily obtaining dots of good quality that the developing solutions of the present invention contain dihydroxybenzenes as developing agents, though there is no particular limitation with regard to the developing agents. Combinations of dihydroxybenzenes with 1-phenyl-3-pyrazolidones or p-aminophenols are often used.

Examples of dihydroxybenzene developing agents which can be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone and 2,5-dimethylhydroquinone. Among them, hydroquinone is particularly preferred.

Examples of 1-phenyl-3-pyrazolidone developing agents which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

Examples of p-aminophenol developing agents which can be used in the present invention include N-methyl-p-aminophenol, p-aminophenol,N-(β-hydroxyethyl)-p-aminophenol, N-(4-hydroxyphenyl)glycine, 2-methyl-p-aminophenol and p-benzylaminophenol. Among them, N-methyl-p-aminophenol is preferred.

The developing agents are used in an amount of preferably 0.05 to 0.8 mol/liter. When combinations of dihydroxybenzenes with 1-phenyl-3-pyrazolidones or p-aminophenols are used, the former is used in an amount of 0.05 to 0.5 mol/l, and the latter is used in an amount of not more than 0.06 mol/l.

Examples of sulfites which are used as preservatives in the present invention include sodium sulfite, potassium sulfite, lithium sulfite, ammonium sulfite, sodium bisulfite, potassium metabisulfite and formaldehyde-sodium bisulfite adduct. The sulfites are used in an amount of preferably at least 0.25 mol/l, more preferably at least 0.3 mol/l, particularly preferably at least 0.4 mol/l. It is preferred that the upper limit is not more than 2.5 mol/l, particularly not more than 1.2 mol/l.

Examples of alkali agents for use in adjusting pH include pH adjustors or buffering agents such as sodium hydroxide, potassium hydroxide, sodium carbonate, potassium carbonate, sodium tertiary phosphate, potassium tertiary phosphate, sodium silicate and potassium silicate.

Examples of additives which can be used in the developing solutions in addition to the above-described ingredients include development inhibitor such as boric acid, borax, sodium bromide, potassium bromide and potassium iodide; organic solvents such as ethylene glycol, diethylene glycol, triethylene glycol, dimethylformamide, methyl cellosolve, hexylene glycol, ethanol and methanol; and anti-fogging agents such as mercapto compounds (e.g., 1-phenyl-5-mercaptotetrazple, sodium 2-mercaptobenzimidazole-5-sulfonate), indazole compounds (e.g., 5-nitroindazole) and benztriazole compounds (e.g., 5-methylbenztriazole). If desired, the developing solutions may optionally contain color toning agent, surfactant, defoaming agent, hard water softener and hardening agent. The amino compounds described in JP-A-56-106244, JP-A-61-267759 and JP-A-2-208652 and the imidazole compounds described in JP-B-48-35493 are particularly preferred to accelerate development and increase sensitivity.

The developing solutions of the present invention may contain the silver stain inhibitors described in JP-A-56-24347, the uneven development inhibitors described in JP-A-62-212651 and the dissolution aids described in JP-A-61-267759.

Buffering agents such as the boric acid compounds described in JP-A-62-186259 and the saccharide (e.g., saccharose), oximes (e.g., acetoxime) and phenols (e.g., 5-sulfosalocylic acid) described in JP-A-60-93433 can be used in the developing solutions of the present invention.

Processing can be carried out in the presence of a polyalkylene oxide in the present invention. However, it is preferred that a polyethylene glycol having an average molecular weight of 1000 to 6000 is used in an amount of 0.1 to 10 g/l to contain the polyalkylene oxide in the developing solution.

The fixing solution of the present invention is an aqueous solution containing a fixing agent and optionally a hardening agent (e.g., a water-soluble aluminum compound), acetic acid and a dibasic acid (e.g., tartaric acid, citric acid or a salt thereof), and has a pH of preferably not lower than 3.8, more preferably 4.0 to 6.5.

Examples of the fixing agent include sodium thiosulfate and ammonium thiosulfate. The amount of the fixing agent to be used can be properly varied, but is generally in the range of about 0.1 to about 5 mol/l.

Water-soluble aluminum salts which are used mainly as hardening agents in the fixing solutions are compounds generally known as hardening agents in hardening acid fixers. Examples of the water-soluble aluminum salts include aluminum chloride, aluminum sulfate and potash alum. The effect of the present invention is achieved in spite of existence of the hardening agents.

Examples of the above-described dibasic acid include tartaric acid and derivatives thereof and citric acid and derivatives thereof. These compounds may be used either alone or in combination of two or more. These compounds are effectively used in an amount of not less than 0.005 mol per liter of the fixing solution, and an amount of 0.01 to 0.03 mol/l is particularly effective.

Examples of tartaric acid and derivatives thereof include tartaric acid, potassium tartrate, sodium tartrate, sodium potassium tartrate, ammonium tartrate and potassium ammonium tartrate.

Examples of citric acid and derivatives thereof which can be effectively used in the present invention include citric acid, sodium citrate and potassium citrate.

It is preferred that meso-ionic compounds repre- sented by formula (X-a) are used in the fixing solutions of the present invention:

(X-a)

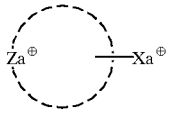

In formula (X-a), Za represents a five-membered or six-membered ring comprising a carbon atom, a nitrogen atom, an oxygen atom, a sulfur atom or a selenium atom; and $Xa^-$ represents $—O^-$, $—S^-$, or $—N^-R$ (wherein R is an alkyl group, a cycloalkyl group, an alkenyl group, an alkinyl group, an aralkyl group, an aryl group or a heterocyclic group).

Among them, the compounds represented by formula (X-b) are preferred:

(X-b)

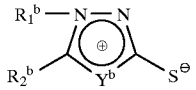

wherein $R_1^b$ and $R_2^b$ each represents an alkyl group, a cycloalkyl group, an alkenyl group, an alkinyl group, an aralkyl group, an aryl group or a heterocyclic group and $R_2^b$ may be a hydrogen atom; and $y^b$ represents —O—, —S— or $—N(R_3^b)—$ wherein $R_3^b$ is an alkyl group, a cycloalkyl group, an alkenyl group, an alkinyl group, an aryl group, a heterocyclic group, an amino group, an acylamino group, a sulfonamido group, a ureido group or a sulfamoylamino group, $R_1^b$ and $R_2^b$ or $R_2^b$ and $R_3^b$ may be combined together to form a ring.

The compounds of the formula (X-b) are illustrated in more detail below.

$R_1^b$ and $R_2^b$ each represents a substituted or unsubstituted alkyl group (e.g., methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkynyl group (e.g., propargyl), a substituted or unsubstituted aralkyl group (e.g., benzyl, phenethyl, 4-methyoxybenzyl), an aryl group (e.g., phenyl, naphthyl, 4-methylphenyl, 4-methoxyphenyl, 4-carboxyphenyl, 4-sulfophenyl), or a substituted or unsubstituted heterocyclic group (e.g., 2-pyridyl, 3-pyridyl, 4-pyridyl, 2-thienyl, 1-pyrazolyl, 1-imidazolyl, 2-tetrahydrofuryl). $R_2^b$ may be a hydrogen atom.

$R_3^b$ represents a substituted or unsubstituted alkyl group (e.g., methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkynyl group (e.g., propargyl), a substituted or unsubstituted aralkyl group (e.g., benzyl, phenethyl, 4-methoxybenzyl), an aryl group (e.g., phenyl, naphthyl, 4-methylphenyl, 4-methyoxyphenyl, 4-carboxyphenyl, 4-sulfophenyl), a substituted or unsubstituted heterocyclic group (e.g., 2-pyridyl, 3-pyridyl, 4-pyridyl, 2-thienyl, 1-pyrazolyl, 1-imidazolyl, 2-tetrahydrofuryl), a substituted or unsubstituted amino group (e.g., amino, dimethylamino, methylamino), an acylamino group (e.g., acetylamino, benzoylamino, methoxypropionylamino), a sulfonamido group (e.g., methanesulfonamido, benzenesulfonamido, 4-toluenesulfonamido), a ureido group (e.g., unsubstituted ureido, 3-methylureido) or a sulfamoylamino group (e.g., unsubstituted sulfamoylamino, 3-methylsulfamoylamino).

In formula (X-b), $Y^b$ is preferably $—N(R_3^b)—$, $R_1^b$, and $R_3^b$ are preferably each a substituted or unsubstituted alkyl group, a substituted or unsubstituted alkenyl group, a substituted or unsubstituted alkynyl group or a substituted or unsubstituted heterocyclic group, and $R_2^b$ is preferably a hydrogen atom, a substituted or unsubstituted alkyl group, a substituted or unsubstituted alkenyl group, a substituted or unsubstituted alkynyl group or a substituted or unsubstituted heterocyclic group.

Examples of the compounds of the formulae (X-a) and (X-b) which can be used in the present invention include, but are not limited to, the following compounds:

(X-1)

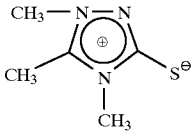

(X-2)

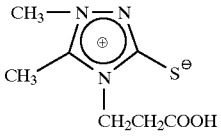

(X-3)

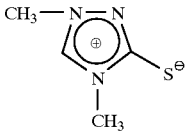

(X-4)

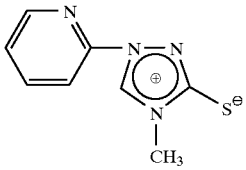

(X-5)

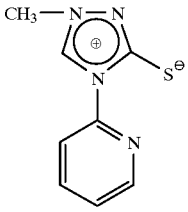

(X-6)

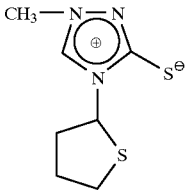

(X-7)

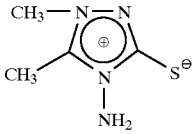

(X-8)

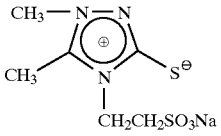

(X-9)

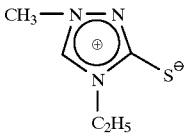

-continued (X-10)

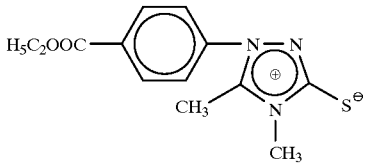

The compounds of the formula (X-a) are used in an amount of preferably $1\times10^{-5}$ to 10 mol/l, particularly preferably $1\times10^{-3}$ to 3 mol/l in the fixing solutions or in the replenishers of the fixing solutions.

When the halogen composition of silver halide emulsions in the light-sensitive materials to be processed is silver chlorobromide or a high silver chloride emulsion (silver halide having a silver chloride content of not lower than 80 mol %), the compounds of the formula (X-a) are used in an amount of preferably 0.05 to 1 mol/l.

If desired, the fixing solutions may contain preservatives (e.g., sulfites, bisulfites), pH buffering agents (e.g., acetic acid, boric acid), pH adjustors (e.g., ammonia, sulfuric acid), image storage improvers (e.g., potassium iodide) and chelating agents. The pH buffering agents are used in an amount of preferably 10 to 40 g/l, more preferably 18 to 25 g/l, because the pH of the developing solutions is high.

The light-sensitive materials of the present invention display excellent performance in rapid processing with automatic processors wherein the total processing time is 15 to 60 seconds.

In the rapid processing of the present invention, development and fixing temperature and time are each about 25 to 50° C. for 25 seconds or shorter, preferably 30 to 40° C. for 4 to 15 seconds.

In the present invention, the light-sensitive materials are subjected to development, fixation and then rinsing or stabilization treatment. Water can be saved in the rinsing stage by using a two or three-stage countercurrent system. It is preferred that when rinsing is conducted with a small amount of rinsing water, a washing bath provided with squeeze rollers is used. Further, a part or the whole of overflow from the rinsing bath or the stabilizing bath can be used for the fixing solution as described in JP-A-60-235133, whereby the amount of waste liquor can also be reduced.

Further, rinsing water may contain mildewproofing agents (e.g., compounds described in *Chemistry of Germicidal Antifungal Agent* written by Hiroshi Horiguchi and JP-A-62-115154), rinsing accelerators (e.g., sulfites), chelating agents, etc.

According to the above-described method, developed and fixed photographic materials are rinsed and dried. Rinsing is carried out to remove substantially completely silver salts which are dissolved out in the fixing stage. Rinsing time is generally 20 to 50° C. for 4 to 30 seconds, preferably 25 to 50° C. for 5 to 20 seconds.

After the photographic materials are developed, fixed and rinsed, they are generally dried through squeeze rollers. Generally, drying is carried out at 40 to 100° C. Drying time varies depending on environmental conditions, but is generally 3 to 60 seconds. Preferably, drying is carried out at 40 to 80° C. for 5 to 20 seconds.

In the present invention, processing may be carried out by using roller conveying type automatic processors. The roller conveying type automatic processors are described in U.S. Pat. Nos. 3,025,779 and 3,545,971 and are hereinafter referred to simply as roller conveying type processors. In the roller conveying type processors, processing comprises 4 stages of development, fixing, rinsing and drying. In the present invention, other stages (e.g., stop stage) may be included, but it is most preferred that the processing of the present invention follows the above 4 stages.

The replenishment rate of rinsing water may be not more than 1200 ml/m$^2$ (including 0). A replenishment rate of rinsing water (or stabilizing solution) of 0 indicates a washing method according to the so-called reservoir water rinsing system. As a method for reducing the replenishment rate, multi-stage counter-current systems (e.g., two-stage, three-stage) have been known for a long time.

Good processing performance can be obtained by using the following techniques in combination with rinsing water to solve problems caused by the reduction of the replenishment rate of the rinsing water.

The isothiazoline compounds described in R. T. Kreiman, *J. Image. Tech.* Vol. 10, No. 6, 242 (1984), the isothiazoline compounds described in *Research Disclosure* (RD), Vol. 205, No. 20526 (May 1981), the isothiazoline compounds described in *Research Disclosure*, Vol. 228, No. 22845 (April 1983), and the compounds described in JP-A-61-115154 and JP-A-62-209532 can be used as microbiocides in the rinsing bath or stabilizing bath. Further, the rinsing bath or the stabilizing bath may contain the compounds described in *Chemistry of Germicidal Antifungal Agent*, by Hiroshi Horiguchi (published by Sankyo Shuppan 1982), *Antibacterial and Antifungal Cyclopedie*, edited by Nippon Antibacterial Antifungal Society (published by Hakuhodo 1986), L. E. West, "Water Quality Criteria" *Photo. Sci. & Eng.*, Vol. 9, No. 6 (1965), T. W. Beach, "Microbiological Growth in Motion Picture Processing" *SMPTE Journal*, Vol. 85 (1976) and R. O. Deegan, "Photo Processing Wash Water Biocides", *J. Imaging Tech.*, Vol. 10, No. 6 (1984).

It is preferred that washing baths provided with squeeze rollers or cross-over rack as described in JP-A-63-18350 and JP-A-62-287252 are used when rinsing is carried out with a small amount of rinsing water in the present invention.

Further, a part or the whole of the overflow from the rinsing bath or the stabilizing bath, caused by replenishing the rinsing bath or the stabilizing bath with water containing antifungal agents according to processing, can be used as a processing solution having a fixing ability for the prebath prior to the rinsing stage as described in JP-A-60-236133 and JP-A-63-129343. Further, water-soluble surfactants or defoaming agents may be added to prevent unevenness in foaming and/or to prevent processing ingredients deposited on the squeeze rollers from being transferred to the processed film, said unevenness in foaming and/or the transfer of ingredients to the processed film being possible when rinsing is carried out with a small amount of rinsing water.

The dye adsorbents described in JP-A-63-163456 may be contained in the rinsing bath to prevent the photographic materials from being stained by the dyes dissolved out of the photographic materials.

It is preferred that the developing solutions of the present invention are stored in packaging materials having low permeability to oxygen and moisture as described in JP-A-61-73147. The developing solutions of the present invention can be preferably applied to the replenishment systems described in JP-A-62-91939.

The silver halide photographic materials of the present invention can provide high Dmax. Accordingly, when the photographic materials are subjected to a reduction treatment after image formation, high density can be maintained even when dot area is reduced.

There is no particular limitation with regard to the reducers which can be used in the present invention. For example, the reducers described in Meeds, *The Theory of the Photographic Process*, pp. 738–744 (Macmillan 1954), *Theory and Practice of Photographic Process*, pp. 166–169 (written by Tetsuo Yano published by Kyoritsu Shuppan 1978), JP-A-50-27543, JP-A-52-68429, JP-A-55-17123, JP-A-55-79444, JP-A-57-10140, JP-A-51-140733, JP-A-52-68419, JP-A-53-14901, JP-A-54-119236, JP-A-54-119237, JP-A-55-2244, JP-A-55-2245, JP-A-55-81344, JP-A-57-142639, JP-A-61-61155, JP-A-1-282551 and JP-A-2-25846 can be used in the present invention. Permanganates, persulfates, ferric salts, cupric salts, ceric salts, red prussiate and dichromates can be used alone or in combination as oxidizing agents in the reducers. Namely, there can be used reducers containing these oxidizing agents and optionally an inorganic acid such as sulfuric acid and alcohols, and reducers containing an oxidizing agent such as red prussiate or (ethylenediaminetetraacetato)ferrate(III), a solvent for silver halide, such as a thiosulfate, a rhodanide, thiourea or a derivative thereof and optionally an inorganic acid such as sulfuric acid.

Further, the reducers which are used in the present invention may contain compounds having a mercapto group described in JP-A-52-68419.

Typical examples of the reducers which can be used in the present invention include Farmer's reducer, reducer (Kodak R-5) containing ethylenediaminetetraacetato ferrate(III), potassium permanganate and ammonium persulfate and ceric reducer.

It is preferred that the reduction is carried out under such conditions that the reduction is completed within a period of several seconds to several tens of minutes, particularly several minutes at a temperature of 10 to 40° C., particularly 15 to 30° C. When the photographic materials for plate making according to the present invention are used, a sufficiently wide reduction margin can be obtained under the above conditions.

The reducer is reacted with a video image formed in the emulsion layer through an insensitive upper layer containing the compounds of the present invention.

Concretely, the reduction treatment can be carried out by various methods such as a method wherein the photographic material for plate making is immersed in the reducer, and the reducer is then stirred; and a method wherein the reducer is applied to the surface of the photographic material for plate making by means of a writing brush (drawing pen or brush), rollers, etc.

It is preferred that the photographic materials of the present invention are processed at a line speed of at least 1000 mm/min (preferably at least 1500 mm/min) by using an automatic processor under such conditions that the replenishment rate of each of the developing solution and the fixing solution is not more than 200 ml/m$^2$ and the total processing time is 10 to 60 seconds.

The term "total processing time" as used herein refers to the total time taken from the time that the top of the film is introduced into the inlet of the automatic processor and passed through the development bath, a transferring zone, the fixing bath, a transferring zone, the rinsing bath, a transferring zone and a drying zone, until the top of the film leaves the outlet of the drying zone.

In the silver halide light-sensitive materials of the present invention, the amount of gelatin used as a binder for the emulsion layers and the protective layers can be reduced without detriment due to pressure marks. Accordingly, development can be achieved without detriment to development rate, fixing rate and drying rate even in rapid processing wherein the total processing time is as short as 15 to 60 seconds.

The present invention is now illustrated in greater detail by reference to the following examples which, however, are not to be construed as limiting the present invention in any way.

EXAMPLE 1

Preparation of Emulsion A

Solution 1

| Solution 1 | |
|---|---|
| Water | 1.0 liter |
| Gelatin | 20 g |
| Sodium chloride | 20 g |
| 1,3-Dimethylimidazolidine-2-thione | 20 mg |
| Sodium benzenethiosulfonate | 6 mg |
| **Solution 2** | |
| Water | 400 ml |
| Silver nitrate | 100 g |
| **Solution 3** | |
| Water | 400 ml |
| Sodium chloride | 30.5 g |
| Potassium bromide | 14.0 g |
| Potassium hexachloroiridate (III) (0.001% aqueous solution) | 10 ml |
| Potassium hexachlororhodate (III) (0.001% aqueous solution) | amount indicated in Table 1 |

To Solution 1 kept at 38° C. and at a pH of 4.5, there were simultaneously added Solution 2 and Solution 3 with stirring over a period of 10 minutes to form nuclear grains having a grain size of 0.16 μm. Subsequently, the following Solutions 4 and 5 were added thereto over a period of 10 minutes. Further, 0.15 g of potassium iodide was added thereto to complete the formation of grains.

| Solution 4 | |
|---|---|
| Water | 400 ml |
| Silver nitrate | 100 g |
| **Solution 5** | |
| Water | 400 ml |
| Sodium chloride | 30.5 g |
| Potassium bromide | 14.0 g |
| Potassium hexacyanoferrate (II) (0.1% aqueous solution) | amount indicated in Table 1 |

The emulsion was washed with water by a conventional flocculation method, and 30 g of gelatin was added thereto.

The emulsion was divided into two equal parts. The pH of one emulsion was adjusted to 5.5 and the pAg thereof was adjusted to 7.5. There were then added 3.7 mg of sodium thiosulfate and 6.2 mg of chloroauric acid. Chemical sensitization was carried out at 65° C. to give optimum sensitivity.

The pH of the other emulsion was adjusted to 5.3, and the pAg thereof was adjusted to 7.5. There were then added 2.6 mg of sodium thiosulfate and 1.0 mg of N-dimethylselenourea. Further, 4 mg of sodium benzenethiosulfonate, 6.2 mg of chloroauric acid and 1 mg of sodium benzenesulfinate were added thereto. Chemical sensitization was carried out at 55° C. to give optimum sensitivity, whereby a cubic silver iodochlorobromide emulsion having a mean grain size of 0.20 μm and a silver chloride content of 80 mol % was finally obtained.

Preparation of Comparative Emulsion B

A cubic silver iodochlorobromide emulsion having a mean grain size of 0.20 μm and a silver chloride content of 80 mol % was prepared in the same manner as in the preparation of the Emulsion A except that potassium hexacyanoferrate(II) (0.1% aqueous solution) was omitted from Solution 5, and potassium hexacyanoferrate(II) (0.1% aqueous solution) in an amount shown in Table 1 was added to Solution 3.

Preparation of Emulsion C

A cubic silver iodochlorobromide emulsion having a mean grain size of 0.18 μm and a silver chloride content of 20 mol % was prepared in the same manner as in the preparation of the Emulsion A except that the amounts of sodium chloride and potassium bromide in each of Solutions 3 and 5 were 9.9 g and 56 g, respectively.

Preparation of Coated Samples

An ortho-sensitizing dye (Sensitizing Dye (1)) in an amount of $5\times10^{-4}$ mol/mol of Ag was added to each of Emulsions A to C, and the emulsion was ortho-sensitized. Further, 2.5 g (per mol of Ag) of hydroquinone as an anti-fogging agent, 50 mg (per mol of Ag) of 1-phenyl-5-mercaptotetrazole as an anti-fogging agent, polyethyl acrylate latex (in an amount of 25% based on the amount of gelatin binder) as a plasticizer and 2-bis (vinylsulfonylacetamide) as a hardening agent were added thereto. The resulting emulsion was coated on a polyester support in such an amount as to give a coating weight of 3.0 g/m$^2$ in terms of Ag and 1.0 g of gelatin per m$^2$. Further, the following lower protective layer and the following upper protective layer were coated thereon.

| Lower Protective Layer | |
|---|---|
| Gelatin | 0.5 g/m$^2$ |
| Sodium benzenethiosulfonate | 4 mg/m$^2$ |
| 1,5-Dihydroxy-2-benzaldoxime | 25 mg/m$^2$ |
| Polyethyl acylate latex | 125 mg/m$^2$ |
| **Upper Protective Layer** | |
| Gelatin | 0.5 g/m$^2$ |
| Matting agent having an average particle size of 3.4 μm | 100 mg/m$^2$ |
| Compound (1) (gelatin dispersion) | 30 mg/m$^2$ |
| Compound (2) | 5 mg/m$^2$ |
| Sodium dodecylbenzenesulfonate | 22 mg/m$^2$ |

The support for the samples in this Example had the following back layer and the following back protective layer:

| Back Layer | |
|---|---|
| Gelatin | 2.0 g/m$^2$ |
| Sodium dodecylbenzenesulfonate | 80 mg/m$^2$ |
| Compound (3) | 70 mg/m$^2$ |
| Compound (4) | 70 mg/m$^2$ |
| Compound (5) | 90 mg/m$^2$ |
| 1,3-Divinylsulfonyl-2-propanol | 60 mg/m$^2$ |
| **Back Protective Layer** | |
| Gelatin | 0.5 g/m$^2$ |
| Polymethyl methacrylate (particle size: 4.7 μm) | 30 mg/m$^2$ |
| Sodium dodecylbenzenesulfonate | 20 mg/m$^2$ |
| Compound (2) | 2 mg/m$^2$ |
| Silicone oil | 100 mg/m$^2$ |

-continued

Sensitizing Dye (1):

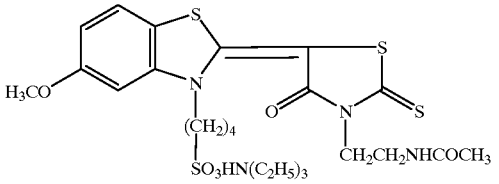

Compound (1):

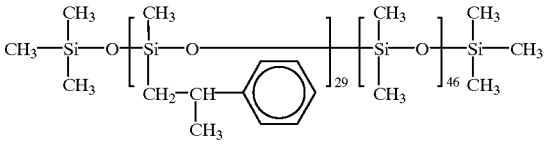

Compound (2):

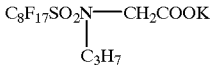

Compound (3):

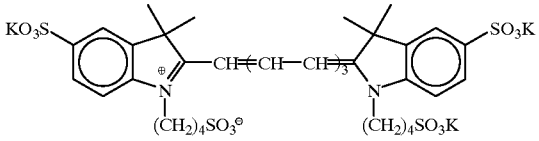

Compound (4):

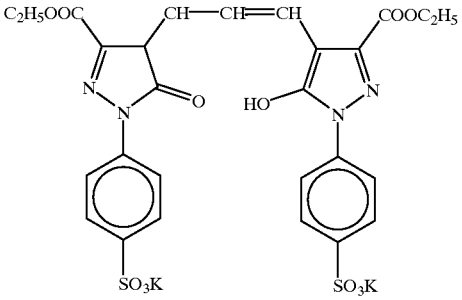

-continued

Compound (5):

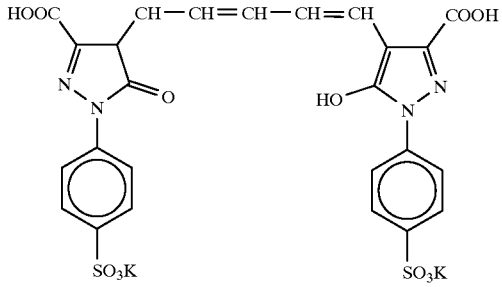

Evaluation of Samples

The resulting samples were exposed to xenon flash light (emission time: $10^{-5}$ sec) through an interference filter having a peak at 488 nm, and were processed at the temperature given below for the period of time given below by using an automatic processor ("FG-710NH" manufactured by Fuji Photo Film Co., Ltd.) to conduct sensitometry.

The developing solution used and the fixing solution were LD835 and LF 308, respectively, both being manufactured by Fuji Photo Film Co., Ltd.

| | | |
|---|---|---|
| Development | 38° C. | 14 sec |
| Fixing | 37° C. | 9.7 sec |
| Rinsing | 26° C. | 9 sec |
| Squeeze | — | 2.4 sec |
| Drying | 55° C. | 8.3 sec |
| Total | — | 43.4 sec |

The reciprocal of the exposure amount giving a density of 3.0 is referred to herein as sensitivity. The sensitivity in terms of relative sensitivity is shown in Table 1. The gradient of a straight line formed by joining a point wherein the density is 0.1 to a point wherein the density is 3.0 on the characteris-tics curve, is referred to herein as gradation. Gradation and fog are shown in Table 1.

TABLE 1

| Sample No. | Halogen Composition | $K_3RhCl_6$ (mol/mol of Ag) | $K_4[Fe(CN)_6]$ (mol/mol of Ag) | Solution to which $K_4[Fe(CN)_6]$ was added | Chemical Sensitizing Agent | Relative Sensitivity | Gradation | Fog | |
|---|---|---|---|---|---|---|---|---|---|
| 1 | $AgBr_{20}Cl_{80}$ | — | — | — | sulfur | 100 | 4.5 | 0.04 | |
| 2 | $AgBr_{20}Cl_{80}$ | — | — | — | selenium/sulfur | 120 | 4.2 | 0.04 | |
| 3 | $AgBr_{20}Cl_{80}$ | $5 \times 10^{-8}$ | — | — | sulfur | 85 | 5.2 | 0.04 | |
| 4 | $AgBr_{20}Cl_{80}$ | $5 \times 10^{-8}$ | — | — | selenium/sulfur | 117 | 6.1 | 0.04 | Invention |
| 5 | $AgBr_{20}Cl_{80}$ | $5 \times 10^{-8}$ | $1 \times 10^{-5}$ | Solution 3 | sulfur | 100 | 5.1 | 0.04 | |
| 6 | $AgBr_{20}Cl_{80}$ | $5 \times 10^{-8}$ | $1 \times 10^{-5}$ | Solution 3 | selenium/sulfur | 140 | 5.9 | 0.04 | Invention |
| 7 | $AgBr_{20}Cl_{80}$ | $5 \times 10^{-8}$ | $1 \times 10^{-5}$ | Solution 5 | sulfur | 105 | 5.1 | 0.04 | |
| 8 | $AgBr_{20}Cl_{80}$ | $5 \times 10^{-8}$ | $1 \times 10^{-5}$ | Solution 5 | selenium/sulfur | 145 | 6.1 | 0.04 | Invention |
| 9 | $AgBr_{20}Cl_{80}$ | $5 \times 10^{-8}$ | $3 \times 10^{-5}$ | Solution 5 | sulfur | 105 | 5.0 | 0.04 | |
| 10 | $AgBr_{20}Cl_{80}$ | $5 \times 10^{-8}$ | $3 \times 10^{-5}$ | Solution 5 | selenium/sulfur | 148 | 6.0 | 0.04 | Invention |
| 11 | $AgBr_{20}Cl_{80}$ | $1 \times 10^{-7}$ | — | — | sulfur | 75 | 5.3 | 0.04 | |
| 12 | $AgBr_{20}Cl_{80}$ | $1 \times 10^{-7}$ | — | — | selenium/sulfur | 110 | 6.5 | 0.04 | Invention |
| 13 | $AgBr_{20}Cl_{80}$ | $1 \times 10^{-7}$ | $1 \times 10^{-5}$ | Solution 5 | sulfur | 85 | 5.2 | 0.04 | |
| 14 | $AgBr_{20}Cl_{80}$ | $1 \times 10^{-7}$ | $1 \times 10^{-5}$ | Solution 5 | selenium/sulfur | 134 | 6.4 | 0.04 | Invention |
| 15 | $AgBr_{80}Cl_{20}$ | — | — | — | sulfur | 90 | 3.9 | 0.05 | |
| 16 | $AgBr_{80}Cl_{20}$ | — | — | — | selenium/sulfur | 104 | 3.8 | 0.05 | |
| 17 | $AgBr_{80}Cl_{20}$ | $5 \times 10^{-8}$ | — | — | sulfur | 85 | 4.4 | 0.05 | |
| 18 | $AgBr_{80}Cl_{20}$ | $5 \times 10^{-8}$ | — | — | selenium/sulfur | 95 | 4.6 | 0.05 | |

TABLE 1-continued

| Sample No. | Halogen Composition | $K_3RhCl_6$ (mol/mol of Ag) | $K_4[Fe(CN)_6]$ (mol/mol of Ag) | Solution to which $K_4[Fe(CN)_6]$ was added | Chemical Sensitizing Agent | Relative Sensitivity | Gradation | Fog |
|---|---|---|---|---|---|---|---|---|
| 19 | $AgBr_{80}Cl_{20}$ | $5 \times 10^{-8}$ | $1 \times 10^{-5}$ | Solution 5 | sulfur | 102 | 4.4 | 0.05 |
| 20 | $AgBr_{80}Cl_{20}$ | $5 \times 10^{-8}$ | $1 \times 10^{-5}$ | Solution 5 | selenium/sulfur | 110 | 4.5 | 0.05 |

As is apparent from the results of Table 1 that one can obtain photographic materials which have high sensitivity, are high-contrast and have rapid processability when at least 30 mol % of silver halide grains comprises silver chloride, the emulsion contains a rhodium compound and the silver halide grains are sensitized by a selenium sensitizing agent. Further, it will be understood that when an iron compound is incorporated into the emulsion, even higher sensitivity can be obtained.

EXAMPLE 2

A cubic silver iodochlorobromide emulsion having a mean grain size of 0.20 $\mu$m and a silver chloride content of 80 mol % was prepared in the same manner as in the preparation of the Emulsion A in Example 1 except that ammonium hexabromorhodate(III) was used in place of the potassium hexachlororhodate(III) used in Solution 3 of the Emulsion A. Each of compounds shown in Table 2 was used in place of the potassium hexacyanoferrate(II) used in Solution 5 and was added in such an amount as to give $3\times10^{-5}$ mol per mol of silver.

Preparation of Coated Samples

Coated samples were prepared in the same manner as in the preparation of the coated samples of Example 1 except that 10 mg (per mol of silver) of a panchromatic dye (Sensitizing Dye (2)) was used in place of the sensitizing dye used in Example 1, and further 300 mg (per mol of silver) of 4,4'-bis(4,6-dinaphthoxypyridine-2-ylamino) stilbenedisulfonic acid was added to effect supersensitization and stabilization.

Sensitizing Dye (2):

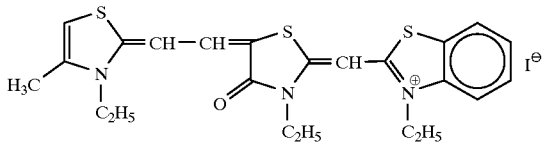

Evaluation of Samples

Evaluation was made in the same manner as in Example 1 except that an interference filter having a peack at 633 nm was used in place of the interference filter used in Example 1.

TABLE 2

| Sample No. | $(NH_4)_3RhBr_6$ (mol/mol of Ag) | Compound added to Solution 5 | Sensitizing Agent | Relative Sensitivity | Gradation | Fog | |
|---|---|---|---|---|---|---|---|
| 1 | $5 \times 10^{-8}$ | $K_2Re(CN)_6$ | sulfur | 103 | 5.0 | 0.04 | |
| 2 | $5 \times 10^{-8}$ | $K_2Re(CN)_6$ | selenium/sulfur | 144 | 6.0 | 0.04 | Invention |
| 3 | $5 \times 10^{-8}$ | $K_2Os(CN)_6$ | sulfur | 103 | 4.9 | 0.04 | |
| 4 | $5 \times 10^{-8}$ | $K_2Os(CN)_6$ | selenium/sulfur | 142 | 5.9 | 0.04 | Invention |
| 5 | $5 \times 10^{-8}$ | $K_2Ru(CN)_6$ | sulfur | 100 | 4.9 | 0.04 | |
| 6 | $5 \times 10^{-8}$ | $K_2Ru(CN)_6$ | selenium/sulfur | 140 | 5.9 | 0.04 | Invention |

As is apparent from the results of Table 2 that when a rhenium compound, a ruthenium compound and an osmium compound are incorporated into the silver halide emulsion which comprises silver halide grains containing at least 30 mol % of silver chloride, contains a rhodium compound and is sensitized by a selenium sensitizing agent, sensitivity can be increased as in the case wherein the emulsion contains an iron compound.

EXAMPLE 3

A film coated with an emulsion having a halogen composition of $AgBr_{30}Cl_{70}$ in a coating weight of 3.6 g/m$^2$ in terms of silver, was exposed to light at such a rate as to give a blackened area of 50%. The film was then 150 m$^2$-processed with the following developing solution and the following fixing solution in an automatic processor ("FG 710NH" manufactured by Fuji Photo Film Co., Ltd.). Subsequently, Samples 1 to 6 of Example 1 were processed in the same manner as in Example 1, and photographic characteristics were evaluated.

| Developing solution | |
|---|---|
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| Compound (a) (2,3,5,6,7,8-hexahydro-2-thioxo-4-(1H)-quinazolinon) | 0.09 g |
| Sodium 2-mercaptobenzimidazole-5-sulfonate | 0.3 g |
| Water to make | 1 liter |
| pH (adjusted with potassium hydroxide) | 10.7 |

-continued

| Fixing solution | |
|---|---|
| Sodium thiosulfate · 5 hydrate | 300 g |
| Sodium sulfite | 7 g |
| Sodium metabisulfite | 20 g |
| EDTA | 0.025 g |
| Compound (b) | 0.25 mol |
| Water to make | 1 liter |
| pH | 5.7 |

Compound (a)

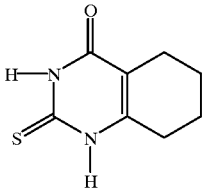

Compound (b)

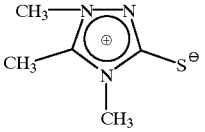

TABLE 3

| Sample No. | $K_2RhCl_6$ (mol/mol of Ag) | $K_4Fe(CN)_6$ (mol/mol of Ag) | Chemical Sensitizing Agent | Relative Sensitivity | Gradation | |
|---|---|---|---|---|---|---|
| 1 | — | — | sulfur | 80 | 4.2 | |
| 2 | — | — | selenium/sulfur | 100 | 4.3 | Invention |
| 3 | $5 \times 10^{-8}$ | — | sulfur | 72 | 4.8 | |
| 4 | $5 \times 10^{-8}$ | — | selenium/sulfur | 114 | 6.0 | Invention |
| 5 | $5 \times 10^{-8}$ | $1 \times 10^{-5}$ | sulfur | 83 | 5.0 | |
| 6 | $5 \times 10^{-8}$ | $1 \times 10^{-5}$ | selenium/sulfur | 136 | 6.0 | Invention |

As is apparent from the results of Table 3 that when at least 30 mol % of silver halide grains comprise silver chloride, the emulsion contains a rhodium compound and the silver halide grains are sensitized by a selenium sensitizing agent, a photographic material can be obtained which has high sensitivity, is high-contrast and can be rapidly processed even under such processing conditions that the replenishment rate of each of the developing solution and the fixing solution is not more than 200 ml/$m^2$. Further, it will be understood that when the emulsion contains an iron compound, sensitivity can be further increased.

EXAMPLE 4

To Solution 1 of Table 4 kept at 38° C. and at a pH of 4.5, there were simultaneously added Solution 2 and Solution 3 over a period of 24 minutes to form grains having a grain size of 0.18 $\mu$m. Subsequently, Solutions 4 and 5 shown in Table 4 were added thereto over a period of 8 minutes. Further, 0.15 g of potassium iodide was added thereto to complete the formation of grains.

The emulsion was then washed with water by a conventional flocculation method. After gelatin was added thereto, pH was adjusted to 5.2 and pAg was adjusted to 7.5. Eight mg of sodium thiosulfate and 12 mg of chloroauric acid were added thereto, and chemical sensitization was carried out at 65° C. to give optimum sensitivity.

TABLE 4

| | | |
|---|---|---|
| Solution 1 | Water | 1.0 l |
| | Gelatin | 20 g |
| | Sodium chloride | 2 g |
| | 1,3-Dimethylimidazolidine-2-thione | 20 mg |
| | Sodium benzenethiosulfonate | 6 mg |
| Solution 2 | Water | 600 ml |
| | Silver nitrate | 150 g |
| Solution 3 | Water | 600 ml |
| | Sodium chloride | 45 g |
| | Potassium bromide | 21 g |
| | Potassium hexachloroiridate (III) (0.001% aqueous solution) | 15 ml |
| | Ammonium hexabromorhodate (III) (0.001% aqueous solution) | 1.5 ml |
| Solution 4 | Water | 200 ml |
| | Silver nitrate | 50 g |
| Solution 5 | Water | 200 ml |
| | Sodium chloride | 15 g |
| | Potassium bromide | 7 g |
| | $K_4Fe(CN)_6$ | 30 mg |

Further, 50 mg of 2-methyl-4-hydroxy-1,3,3a,7-tetrazaindene as a stabilizer and 100 ppm of phenoxyethanol as an antiseptic were added thereto to obtain a cubic silver iodochlorobromide grain Emulsion A having a mean grain size of 0.20 um and a silver chloride content of 80 mol % (a coefficient of variation: 9%).

The formation of grains was conducted in the same manner as in the preparation of Emulsion A. The resulting emulsion was then washed with water, and gelatin was added thereto. Subsequently, pH and pAg were adjusted in the same manner as described in the preparation of Emulsion A. Thereafter, 4 mg of sodium thiosulfate, 2 mg of N,N-dimethylselenourea, 10 mg of chloroauric acid, 4 mg of sodium benzenethiosulfonate and 1 mg of sodium benzenethiosulfinate were added thereto, and chemical sensitization was carried out at 55° C. to give optimum sensitivity. Further, the same stabilizer and antiseptic as those used in Emulsion A were added thereto. The resulting emulsion is referred to as Emulsion B.

Preparation of Coated Samples

Emulsion A prepared above was diluted with gelatin to form each of Emulsions A-(1) to A-(4). Emulsion B prepared above was diluted with gelatin to form each of Emulsions B-(1) to B-(4). Ortho-sensitizing Dye A-6 in an amount of 200 mg per mol of Ag were added thereto, and ortho-sensitization was carried out. Dye A-6:

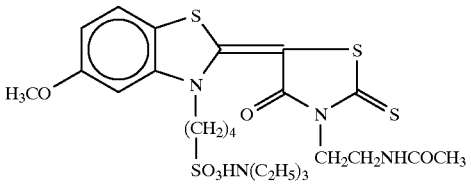

Further, 300 mg of disodium 4,4'-bis(4,6-dinaphthoxy-pyrimidine-2-ylamino)stilbenedisulfonate and 450 mg of 2,5-dimethyl-3-allylbenzothiazole iodide were added thereto to effect supersensitization and stabilization, each amount being per mol of Ag.

Further, polyethyl acrylate latex in an amount of 25% based on the amount of gelatin binder, colloidal silica having a particle size of 10 μm in an amount of 30% based on the amount of gelatin binder in the emulsion layer and 2-bis (vinylsulfonylacetamido)ethane (80 mg/m$^2$) as a hardening agent were added thereto. The resulting emulsion was coated on a polyester support in such an amount as to give a coating weight of 3.0 g/m$^2$ in terms of silver. In the coating mentioned above, the upper and lower protective layers shown in Table 5 were simultaneously coated thereon.

The above polyester support was one wherein side (side A) thereof was coated with the following first undercoating layer and the following third undercoating layer. The other side (side B) thereof was coated with the following first, second (electrically conductive layer) and third undercoating layers in order.

First Undercoating Layer

| First undercoating layer | |
|---|---|
| Aqueous dispersion of a vinylidene chloride/methyl methacrylate/acrylonitrile/methacrylic acid (90/8/1/8 by weight) copolymer | 15 g |
| 2,4-Dichloro-6-hydroxy-s-triazine | 0.25 g |
| Fine polystyrene particles (average particle size: 3 μm) | 0.05 g |
| Compound-6 | 0.20 g |
| Add water to make | 100 g |

Further, 10 wt % KOH was added thereto to adjust pH to 6. The resulting coating solution was coated on the support in such an aount as to give a dry film thickness of 0.9 um at a drying temperature of 180° C. for 2 minutes.

Second Undercoating Layer (Electrically Conductive Layer)

| Second undercoating layer (electrically conductive layer) | |
|---|---|
| $SnO_2$/Sb (9/1 by weight, average particle size: 0.25 μm) | 300 mg/m$^2$ |
| Gelatin ($Ca^{++}$ content: 3000 pp) | 170 mg/m$^2$ |
| Compound-8 | 7 mg/m$^2$ |
| Sodium dodecylbenzenesulfonate | 10 mg/m$^2$ |
| Sodium dihexyl α-sulfosuccinate | 40 mg/m$^2$ |
| Polysodium styrenesulfonate | 9 mg/m$^2$ |
| **Third undercoating layer** | |
| Gelatin | 1 g |
| Methyl cellulose | 0.05 g |
| Compound-7 | 0.02 g |
| $Cl_2H_{25}O(CH_2CH_2O)_{10}H$ | 0.03 g |
| Compound-8 | $3.5 \times 10^{-3}$ g |
| Acetic acid | 0.2 g |
| Add water to make | 100 g |

The coating solution was coated in such an amount as to give a dry film thickness of 0.1 μm at a drying temperature of 170° C. for 2 minutes.

Compound-6

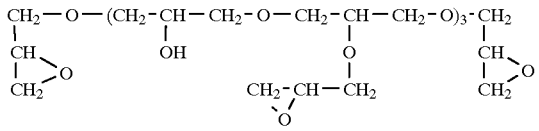

Compound-7

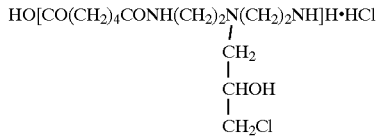

Compound-8

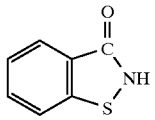

TABLE 5

| | per m$^2$ |
|---|---|
| **Upper protective layer** | |
| Gelatin | |
| Matting agent having an average particle size of 2.5 μm | 50 mg |
| Silicone oil | 100 mg |
| Colloidal silica having a particle size of 10 μm | 30 mg |
| Compounds *1) and *2) | each 5 mg |
| Sodium dodecylbenzenesulfonate | 22 mg |
| **Lower protective layer** | |
| Gelatin | |
| Compound *3) | 5 mg |
| Sodium benzenethiosulfonate | 2 mg |
| 1,5-Dihydroxy-2-benzaldoxime | 25 mg |
| 5-Chloro-8-hydroxyquinoline | 5 mg |
| Polyethyl acrylate latex | 160 mg |

*1)

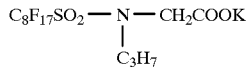

*2)

$C_8F_{17}SO_3K$

*3)

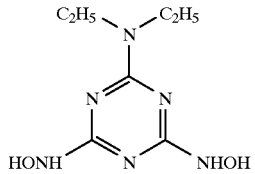

The coating weight of gelatin for each layer and the amount of polyhydroxybenzene added are shown in the following Table 6. Polyhydroxybenzene was added to the upper protective layer.

TABLE 6

| Sample No. | Emulsion | Coating weight of Gelatin ($g/m^2$) Emulsion Layer | Lower Protective Layer | Upper Protective Layer | Polyhydroxybenzene Type | Amount | Dependence of Processing on Composition of Processing Solution $\Delta S_{3.0}$ |
|---|---|---|---|---|---|---|---|
| 1 | A-(1) | 1.0 | 0.4 | 0.4 | — | — | 0.20 |
| 2 | (2) | 1.5 | 0.4 | 0.4 | — | — | 0.21 |
| 3 | (3) | 2.0 | 0.4 | 0.4 | — | — | 0.20 |
| 4 | (4) | 2.5 | 0.4 | 0.4 | — | — | 0.22 |
| 5 | B-(1) | 1.0 | 0.4 | 0.4 | — | — | 0.08 |
| 6 | (2) | 1.5 | 0.4 | 0.4 | — | — | 0.07 |
| 7 | (3) | 2.0 | 0.4 | 0.4 | — | — | 0.18 |
| 8 | (4) | 2.5 | 0.4 | 0.4 | — | — | 0.19 |
| 9 | B-(1) | 1.0 | 0.3 | 0.2 | — | — | 0.04 |
| 10 | (2) | 1.5 | 0.3 | 0.2 | — | — | 0.05 |
| 11 | (3) | 2.0 | 0.3 | 0.2 | — | — | 0.04 |
| 12 | (4) | 2.5 | 0.3 | 0.2 | — | — | 0.15 |
| 13 | B-(1) | 1.0 | 0.3 | 0.2 | V-1 | 100 $mg/m^2$ | 0.02 |
| 14 | (2) | 1.5 | 0.3 | 0.2 | V-1 | 100 $mg/m^2$ | 0.01 |
| 15 | (3) | 2.0 | 0.3 | 0.2 | V-1 | 100 $mg/m^2$ | 0.02 |
| 16 | (4) | 2.5 | 0.3 | 0.2 | V-1 | 100 $mg/m^2$ | 0.13 |
| 17 | A-(1) | 1.0 | 0.3 | 0.2 | V-1 | 100 $mg/m^2$ | 0.15 |

The support for the samples used in Example 4 had a back layer and a back protective layer, these back and back protective layers having the same composition as those used in Example 1.

Evaluation of Samples

Samples 1 to 17 shown in Table 6 were exposed to xenon flush lamp (emission time: $1\times10^{-6}$ sec) through an interference filter having a peak at 488 nm and a continuous wedge, and processed at the temperature given below for a given period of time given below by an automatic processor (FG 710NH manufactured by Fuji Photo Film Co., Ltd.) to carry out sensitometry.

| | | |
|---|---|---|
| Development | 38° C. | 14 sec |
| Fixing | 37° C. | 9.7 sec |
| Rinsing | 30° C. | 9 sec |
| Squeeze | — | 2.4 sec |
| Drying | 55° C. | 8.3 sec |
| Total | — | 43.4 sec |

In the above processing, the developing solutions shown in Table 7 and the fixing solution shown in Table 8 were used. Sensitivity is expressed by the logarithm of the reciprocal of the exposure amount giving a density of 3.0. The difference in sensitivity (ΔlogE) between the developing solutions (a) and (b) is referred to as the dependence of processing on the composition of the processing solution. A smaller difference in sensitivity means that the samples are more stable and much more preferred from the viewpoint of performance.

TABLE 7

Formulation of developing solutions

| | Solution (a) g/l | Solution (b) g/l |
|---|---|---|
| KOH | 24 | " |
| $K_2SO_3$ | 70 | " |
| Hydroquinone | 35 | 10 |
| Boric acid | 10 | " |

TABLE 7-continued

Formulation of developing solutions

| | Solution (a) g/l | Solution (b) g/l |
|---|---|---|
| Diethylene glycol | 12 | " |
| KBr | 5 | " |
| Compound a) shown below | 2.5 | " |
| Compound b) shown below | 0.3 | " |
| 4-Hydroxymethyl-4-methyl-1-phenyl-3-pyrazolidone | 2.5 | " |
| 5-Methylbenzotriazole | 0.1 | " |
| 2-Mercaptobenzimidazole-5-sulfonic acid | 0.3 | " |
| pH | 10.0 | 10.0 |

Compound a)

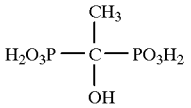

Compound b)

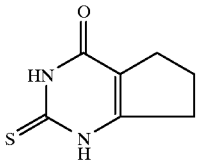

TABLE 8

Formulation of fixing solution

| | (g/l) |
|---|---|
| Ammonium thiosulfate | 143 |
| Sodium thiosulfate · 5 hydrate | 20 |
| Compound c) indicated below | 20 |
| Sodium bisulfite | 30 |

TABLE 8-continued

| Formulation of fixing solution | (g/l) |
|---|---|
| Disodium ethylenediaminetetraacetate dihydrate (TDTA) | 0.025 |
| pH | 6.0 |

Compound c)

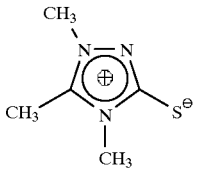

Results:

As is apparent from Table 6 that the samples wherein the total coating weight of gelatin is not more than 2.5 g/m$^2$, obtained by a selenium-sensitized emulsion, have less dependence of processing on the composition of the processing solution. Further, it will be understood that when the coating weight of gelatin in the protective layer is not more than 0.5 g/m$^2$ and when polyhydroxybenzene is used, the property with regard to dependence of processing on the composition of the processing solution can be improved even more.

EXAMPLE 5

Preparation of Emulsion A

An Emulsion A was prepared in the same manner as in Example 1.

After rinsing, the emulsion was divided into two equal parts. The pH of one emulsion was adjusted to 5.5 and pAg was adjusted to 7.5. 3.7 mg of sodium thiosulfate and 6.2 mg of chloroauric acid were added thereto, and chemical sensitization was carried out at 65° C. to give optimum sensitivity.

The pH of the other emulsion was adjusted to 5.3 and the pAg thereof was adjusted to 7.5. Subsequently, 2.6 mg of sodium thiosulfate and N,N-dimethylselenourea in an amount shown in Table 9 were added thereto. Further, 6.2 mg of chloroauric acid was added thereto, and chemical sensitization was carried out at 55° C. to give optimum sensitivity.

The samples described above included samples containing 4 mg of sodium benzenethiosulfonate and 1 mg of sodium benzenesulfinate and samples containing neither sodium benzenethiosulfonate nor sodium benzenesulfinate.

Preparation of Comparative Emulsion B

A cubic silver iodochlorobromide grain emulsion having a mean grain size of 0.18 μm and a silver chloride content of 20 mol % was prepared in the same manner as in the preparation of Emulsion A except that the amounts of sodium chloride and potassium bromide in Solution 3 and Solution 5 were 9.9 g and 56 g, respectively.

Preparation of Coated Samples

The same Sensitizing Dye (1) as that of Example 1 was added to the emulsions. The sensitizing dye was used in an amount of $5\times10^{-4}$ mol/mol of Ag. Ortho-sensitization was conducted. Further, 2.5 g (per mol of Ag) of hydroquinone as an anti-fogging agent, 50 mg (per mol of Ag) of 1-phenyl-5-mercaptotetrazole as an anti-fogging agent, polyethyl acrylate latex as a plasticizer in an amount of 25% based on the amount of gelatin binder and $^2$-bis (vinylsulfonylacetamido)ethane as a hardening agent were added thereto. The resulting emulsion was coated on the same polyester support as that used in Example 4 in such an amount as to give a coating weight of 3.0 g/m$^2$ in terms of silver and a gelatin coating weight of 1.0 g/m$^2$. The protective layers were simultaneously coated thereon.

In the coating described above, a non-sensitive upper layer comprising a matting agent (polymethyl methacrylate having an average particle size of 3.4 μm, 0.10 g/m$^2$), gelatin (1.0 g/m$^2$), sodium p-dodecylbenzenesulfonate (coating aid) and the fluorine-containing surfactant (Compound (2) of Example 1, coating aid) were coated simultaneously with the coating of the emulsion layer.

The support for the samples used in Example 5 had the same back layer and back protective layer as those of Example 1.

The resulting samples were processed in the same manner as in Example 1. The results are shown in Table 9.

TABLE 9

| No. | Emulsion | Sodium Thiosulfate | N,N-Dimethyl-Selenourea | Sodium Benzene-thiosulfonate | Photographic performance Sensitivity | Gradation | Fog |
|---|---|---|---|---|---|---|---|
| 1 | A | 3.7 mg | — | Omitted | 100 | 6.0 | 0.04 |
| 2 | A | — | 3.7 mg | Omitted | 165 | 3.1 | 0.41 |
| 3 | A | 1.0 mg | 2.6 mg | Omitted | 142 | 3.9 | 0.11 |
| 4 | A | 2.6 mg | 1.0 mg | Omitted | 131 | 4.0 | 0.07 |
| 5 | A | — | 3.7 mg | Added | 163 | 5.7 | 0.04 |
| 6 | A | 1.0 mg | 2.6 mg | Added | 141 | 5.9 | 0.04 |
| 7 | A | 2.6 mg | 1.0 mg | Added | 130 | 6.2 | 0.03 |
| 8 | B | 3.7 mg | — | Omitted | 82 | 4.0 | 0.05 |
| 9 | B | 2.6 mg | 1.0 mg | Added | 97 | 4.9 | 0.05 |

As is apparent from the results of Table 9 that when sodium benzenethiosulfate is used, performance is further inproved.

EXAMPLE 6

The following developing solution and fixing solution were fed to an automatic processor ("FG 710NH" manufactured by Fuji Photo Film Co., Ltd.). A film coated with a silver chlorobromide emulsion having a halogen composition with a chloride content of 70 mol % in a coating weight of 3.6 g/m$^2$ in terms of silver, was exposed to light at a rate of a 50% blackened area. The film was 150 m$^2$-processed while replenishing the processor with the following developing solution and fixing solution at a rate of 180 ml/m$^2$. Samples similar to Samples 1 to 7 of Example 5 were passed through the solutions to make the evaluation. The results are shown in Table 10.

TABLE 10

| | Photographic performance | | |
|---|---|---|---|
| No. | Sensitivity | Gradation | Fog |
| 1 | 73 | 5.5 | 0.04 |
| 2 | 158 | 3.0 | 0.43 |
| 3 | 138 | 3.7 | 0.13 |
| 4 | 125 | 3.8 | 0.08 |
| 5 | 160 | 5.5 | 0.04 |
| 6 | 138 | 5.7 | 0.04 |
| 7 | 129 | 6.1 | 0.03 |

| Developing solution | |
|---|---|
| Sodium 1,2-dihydroxybenzene-3,5-disulfonate | 0.5 g |
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methylbenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-Hexahydro-2-thioxo-4-(1H)-quinazolinone | 0.09 g |
| Sodium 2-mercaptobenzimidazole-5-sulfonate | 0.3 g |

Water was added to make the total volume one liter, and pH was adjusted to 10.7 by adding potassium hydroxide.

| Fixing solution | |
|---|---|
| Sodium thiosulfate | 200 g/l |
| Sodium sulfite | 10 g/l |
| Compound-(6) | 0.25 mol/l |
| Sodium bisulfite | 30 g/l |
| Disodium ethylenediaminetetraacetate dihydrate | 0.025 g/l |
| pH was adjusted with sodium hydroxide to 6.0 | |

Compound-(6)

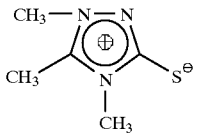

As is apparent from the results of Table 10 that the samples of the present invention have high sensitivity, are high-contrast and have rapid processability even when the replenishment rate of each of the developing solution and the fixing solution is reduced to not more than 200 ml/m$^2$.

EXAMPLE 7

Preparation of Emulsion A

Solution 1

| | |
|---|---|
| Water | 1.0 l |
| Gelatin | 20 g |
| Sodium chloride | 20 g |
| 1,3-Dimethylimidazolidine-2-thione | 20 mg |
| Sodium benzenethiosulfonate | 6 mg |
| Solution 2 | |
| Water | 400 ml |
| Silver nitrate | 100 g |
| Solution 3 | |
| Water | 400 ml |
| Sodium chloride | 30.5 g |
| Potassium bromide | 14.0 g |
| Ammonium hexabromorhodate(III) (0.001% aqueous solution) | 1.5 ml |

To Solution 1 kept at 38° C. and at a pH of 4.5, there were simultaneously added Solution 2 and Solution 3 with stirring over a period of 10 minutes to form nuclear grains of 0.16 μm. Subsequently, the following Solutions 4 and 5 were added thereto over a period of 10 minutes. Further, 0.15 g of potassium iodide was added thereto to complete the formulation of grains.

| Solution 4 | |
|---|---|
| Water | 400 ml |
| Silver nitrate | 100 g |
| Solution 5 | |
| Water | 400 ml |
| Sodium chloride | 30.5 g |
| Potassium bromide | 14.0 g |
| Potassium hexachloroiridate(III) (0.001% aqueous solution) | 15 ml |

The emulsion was washed with water by a conventional flocculation method, and 30 g of gelatin was added thereto.

The emulsion was divided into two equal parts. The pH of one emulsion was adjusted to 5.5 and pAg was adjusted to 7.5. Subsequently, 3.7 mg of sodium thiosulfate and 6.2 mg of chloroauric acid were added thereto, and chemical sensitization was carried out at 65° C. to give optimum sensitivity.

The pH of other part of the emulsion was adjusted to 5.3 and pAg was adjusted to 7.5. Subsequently, 2.6 mg of sodium thiosulfate, 6.2 mg of chloroauric acid and 1.0 mg of N,N-dimethylselenourea were added thereto. Further, 4 mg of sodium benzenethiosulfonate and 1 mg of sodium benzenesulfinate were added thereto, and chemical sensitization was carried out at 55° C. to give optimum sensitivity.

Further, 200 mg of 2-methyl-4-hydroxy-1,3,3a,7-tetraazaindene as a stabilizer was added to obtain a cubic silver iodochlorobromide emulsion having a mean grain size of 0.20 μm and a silver chloride content of 80 mol % (a coefficient of variation: 9%).

Preparation of Emulsion B

In the same manner as in the preparation of the Emulsion A, an emulsion was prepared and washed with water, and gelatin was added thereto. The emulsion was divided into two equal parts. The pH of one emulsion part was adjusted to 5.5 and the pAg thereof was adjusted to 7.5. Subsequently, 3.7 mg of sodium thiosulfate and 6.2 mg of chloroauric acid were added thereto, and chemical sensitization was carried out at 65° C. to give optimum sensitivity.

The pH of the other emulsion part was adjusted to 5.3 and the pAg thereof was adjusted to 7.5. Subsequently, 2.6 mg of sodium thiosulfate, 6.2 mg of chloroauric acid and 3.0 mg of triphenyl phosphine selenide were added thereto. Further, 4 mg of benzenethiosulfonate and 1 mg of sodium benzenesulfinate were added thereto, and chemical sensitization was carried out at 55° C. to give optimum sensitivity.

Two hundred mg of 2-methyl-4-hydroxy-1,3,3a,7-tetraazaindene as a stabilizer were added thereto to obtain a cubic iodochlorobromide emulsion having a mean grain size of 0.20 $\mu$m and a silver chloride content of 80 mol % (a coefficient of variation: 9%).

Preparation of Coated Samples

An ortho-sensitizing dye in an amount of $5\times10^{-4}$ mol/mol of Ag was added to the emulsion as shown in Table 11, and ortho-sensitization was carried out. Further, 2.5 g (per mol of Ag) of hydroquinone as an anti-fogging agent, 50 mg (per mol of Ag) of 1-phenyl-5-mercaptoptetrazole as an anti-fogging agent, polyethyl acrylate latex as a plasticizer in an amount of 25% based on the amount of gelatin binder and 2-bis(vinylsulfonylacetamido)ethane as a hardening agent were added thereto. The resulting emulsion was coated on the same polyester support as that used in Example 4 in such an amount as to give a coating weight of 3.0 g/m$^2$ in terms of silver and a gelatin coating weight of 1.0 g/m$^2$. The protective layers were simultaneously coated thereon.

In the coating described above, a non-sensitive upper layer comprising a. matting agent (polymethyl methacrylate having a mean grain size of 3.4 $\mu$m, 10 g/m$^2$), gelatin (0.5 g/m$^2$) and sodium p-dodecylbenzenesulfonate as coating aid was coated simultaneously with the emulsion.

The support for the samples of Example 7 had the same back layer and back protective layer as those of Example 1.

Evaluation of the Samples

The resulting samples were processed in the same manner as in Example 1.

Evaluation of Residual Color

In the processing of Example 1, the rinsing temperature was changed to 5° C., and evaluation was made by the degree of coloration due to the dye left behind in the processed photographic material.

Evaluation is made in a rating of 5, 4, 3, 2 and 1. The ratings of 5 and 4 in Tables 11 and 12 are estimated as good, and the ratings of 3, 2 and 1 are estimated as bad.

a

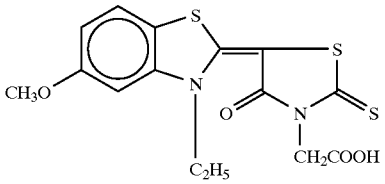

b

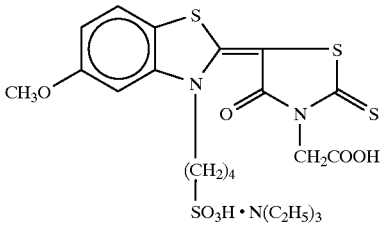

c

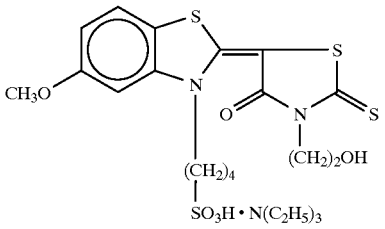

TABLE 11

| | | | | | Photographic Performance | | |
|---|---|---|---|---|---|---|---|
| No. | Emulsion | Sodium Thiosulfate | N,N-Dimethyl-Selenourea | Dye | Sensitivity | Gradation | Residual Color |
| 1 | A | 3.7 mg | — | a | 100 | 5.9 | 1 |
| 2 | A | 3.7 mg | — | b | 45 | 5.9 | 2 |
| 3 | A | 3.7 mg | — | c | 155 | 5.9 | 2 |
| 4 | A | 2.6 mg | 1.0 mg | a | 142 | 5.9 | 2 |
| 5 | A | 2.6 mg | 1.0 mg | c | 199 | 5.9 | 2 |
| 6 | A | 3.7 mg | — | Compound II-3 | 166 | 5.9 | 5 |
| 7 | A | 2.6 mg | 1.0 mg | Compound II-3 | 213 | 5.9 | 5 |
| 8 | A | 2.6 mg | 1.0 mg | Compound II-5 | 203 | 5.9 | 5 |

TABLE 12

| No. | Emulsion | Sodium Thiosulfate | Triphenyl Phosphine Selenide | Dye | Photographic Performance Sensitivity | Gradation | Residual Color |
|---|---|---|---|---|---|---|---|
| 1 | B | 3.7 mg | — | a | 99 | 5.9 | 1 |
| 2 | B | 3.7 mg | — | b | 45 | 5.9 | 2 |
| 3 | B | 3.7 mg | — | c | 152 | 5.9 | 2 |
| 4 | B | 2.6 mg | 3.0 mg | a | 143 | 5.9 | 2 |
| 5 | B | 2.6 mg | 3.0 mg | c | 200 | 5.9 | 2 |
| 6 | B | 3.7 mg | — | Compound II-3 | 165 | 5.9 | 5 |
| 7 | B | 2.6 mg | 3.0 mg | Compound II-3 | 213 | 5.9 | 5 |
| 8 | B | 2.6 mg | 3.0 mg | Compound II-5 | 204 | 5.9 | 5 |

As is apparent from the results of Tables 11 and 12 that when the compounds of the formula (II) are used as spectral sensitizing dyes, photographic materials can be obtained which have a still higher sensitivity, are low in fog and have rapid processability.

EXAMPLE 8

Emulsions A and B were prepared in the following manner.

An aqueous solution of 0.5 M silver nitrate and an aqueous halide solution containing 0.1 M potassium bromide, 0.44 M sodium chloride, potassium hexachloroiridate(III) and ammonium hexabromorhodate (III) were added to an aqueous gelatin solution containing sodium chloride, 1,3-dimethylimidazolidine-2-thione and benzenethiosulfonic acid, and adjusted to a pH of 4.0. The solution was stirred at 38° C. over a period of 10 minutes by a double jet method to obtain silver chlorobromide grains having a mean grain size of 0.16 μm and a silver chloride content of 70 mol % and to thereby effect nucleation. Subsequently, an aqueous solution of 0.5 M silver nitrate and an aqueous halide solution containing 0.1 M potassium bromide, 0.44 M sodium chloride and potassium ferrocyanide were added thereto over a period of 10 minutes by a double jet method to complete the formation of grains. The resulting grains were cubic silver chlorobromide grains having a mean grain size of 0.2 μm and a silver chloride content of 70 mol % and containing $3.8\times10^{-7}$ Mol of Ir per mol of silver and $2.3\times10^{-5}$ mol of Fe per mol of silver (a coefficient of variation: 10%) The emulsion was washed with water by a conventional flocculation method, and 30 g of gelatin was added thereto. The resulting emulsion was divided into two equal parts. Emulsions A and B were prepared in the following manner.

Emulsion A

The pH of one emulsion part was adjusted to 5.6 and the pAg thereof was adjusted to 7.5. Subsequently, 3.2 mg of sodium thiosulfate and 4.3 mg of chloroauric acid were added thereto, and chemical sensitization was carried out at 65° C. to give optimum sensitivity. Subsequently, 75 mg of 4-hydroxy-6-methyl-1,3,3a,7-tetraazaindene as a stabilizing agent was added thereto.

Emulsion B

The pH of one emulsion part was adjusted to 5.1 and the pAg thereof was adjusted to 7.5. Subsequently, 2.2 mg of sodium thiosulfate, 0.85 mg of N,N-dimethylselenourea, 3.4 mg of sodium benzenethiosulfate, 0.85 mg of sodium benzenesulfinate and 4.3 mg of chloroauric acid were added thereto. The ripening time was controlled at 55° C. so that the sensitivity of the emulsion was on the same level when evaluated by a method described hereinafter, and chemical sensitization was carried out. Subsequently, 75 mg of 4-hydrox-6-methyl-1,3,3a,7-tetraazaindene as a stabilizer was added thereto.

A dye (Dye 1 or Dye 2) having the following structure was added to the resulting Emulsion A or B as shown in Table 13. Further, 234 mg of disodium 4,4'-bis(4,6-dinaphthoxypryimidine-2-ylamino)stilbenedisulfonate and 25 mg of 1-phenyl-5-mercaptotetrazole were added thereto, each amount being per mol of silver.

Furthermore, hydroquinone (150 mg/m$^2$), polyethyl acrylate latex in an amount of 30% based on the amount of gelatin binder, colloidal silica of 0.01 μm in an amount of 30% based on the amount of gelatin binder and 2-bis (vinylsulfonylacetamido)ethane (70 mg/m$^2$) as a hardening agent were added thereto. The resulting emulsion was coated on the same polyester support as that used in Example 4 in such an amount as to give a coating weight of 3.2 g/m$^2$ in terms of silver and a gelatin coating weight of 1.4 g/m$^2$. In the coating described above, a protective layer comprising gelatin (0.5 g/m$^2$), Dye 3 having the following structure (70 mg/g), a matting agent (polymethyl methacrylate having a particle size of 2.5 μm, 60 mg/m$^2$), colloidal silica having a particle size of 10 μm (70 mg/m$^2$), sodium dodecylbenzenesulfonate as a coating aid, a fluorine-containing surfactant (1.5 mg/m$^2$) as a coating aid and a chelating agent (20 mg/m$^2$) (adjusted to a pH of 5.5) as an upper layer above the emulsion layer, was coated thereon simultaneously with the coating of the emulsion layer.

(Dye 1)

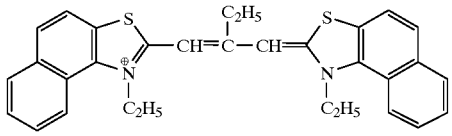

(Dye 2)

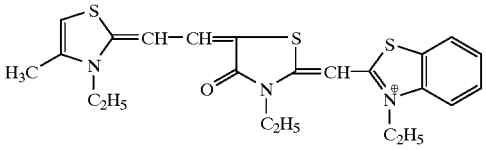

-continued (Dye 3)

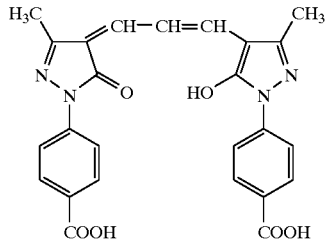

Surfactant $C_8H_{17}SO_2-N(C_3H_7)-CH_2COOK$

Chelating agent

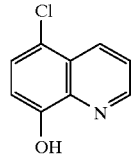

The support for the samples of Example 8 had the same back layer and back protective layer as those of Example 1.

Evaluation of Photographic Performance

Sensitometry was carried out in the same manner as in Example 6 except that the resulting samples were exposed to light through an interference filter having a peak at 633 nm.

The sensitivity was referred to as 633 nm sensitivity when exposure was conducted through an interference filter having a peak at 633 nm, while the sensitivity was referred to as Blue sensitivity when exposure was conducted through an interference filter having a peak at 380 nm.

Evaluation of Suitability for Running

A film coated with a silver chlorobromide emulsion having a silver chloride content of 70 mol % in a coating weight of 3.6 g/m$^2$ in terms of silver, was exposed to light at a rate of 50% blackened area and then introduced into the automatic processor ("FG-710NH" manufactured by Fuji Photo Film Co., Ltd.) used for the sensitivity evaluation. The film was subjected to 150 m$^2$ running processing while replenishing the processor with both the developing solution and the fixing solution at a rate of 180 ml/m$^2$. 633 nm sensitivity and 633 nm gradation were measured when those solutions were used. Evaluation was made by the difference between the result obtained by these solutions and the result obtained by fresh solutions.

Evaluation of Residual Color

The samples were processed in the same manner as in the sensitivity evaluation except that unexposed samples were used and the rinsing temperature was 5° C. The tinting of the samples was visually observed, and evaluation was made in five grades. The grade of 5 means that the degree of residual color is the lowest, while the grade of 1 means that the degree of residual color is the highest. The grade of 3 means that the samples are practically usable.

The evaluation results of each sample are shown in Table 13.

TABLE 13

| Sample No. | Emulsion | Sensitizing Dye Type | Sensitizing Dye Amount (mg/mol of Ag) | Relative Sensitivity Blue | Relative Sensitivity 633 nm | 633 nm Gradation | Suitability for Running | Residual Color |
|---|---|---|---|---|---|---|---|---|
| 1 | A | — | — | 100 | — | — | — | 5 |
| 2 | B | — | — | 100 | — | — | — | 5 |
| 3 | A | Dye 1 | 40 | 100 | 115 | 5.7 | 0.1 | 3 |
| 4 | B | Dye 1 | 40 | 100 | 115 | 6.3 | 0.06 | 3 |
| 5 | A | Dye 2 | 40 | 90 | 100 | 5.9 | 0.06 | 4 |
| 6 | B | Dye 2 | 40 | 100 | 120 | 6.6 | 0.0 | 4 |
| 7 | A | Dye 1 | 90 | 100 | 257 | 5.6 | 0.1 | 1 |
| 8 | B | Dye 1 | 90 | 100 | 257 | 6.2 | 0.07 | 1 |
| 9 | A | Dye 2 | 90 | 88 | 225 | 5.9 | 0.06 | 3 |
| 10 | B | Dye 2 | 90 | 100 | 270 | 6.6 | 0.0 | 3 |

It will be understood from the results of Table 13 that when a spectral sensitizing dye such as Dye 2 is used in the present invention, properties with regard to sensitivity, gradation, suitability for running and residual color are further improved.

EXAMPLE 9

Cubic silver chlorobromide grains having a mean grain size of 0.2 μm and a silver chloride content of 70 mol % (a coefficient of variation: 10%) were prepared in the same manner as in Example 8 except that the amounts of heavy metal compounds added were controlled so that Ir was $5.0\times10^{-7}$ mol, Rh was $1.5\times10^{-7}$ mol and Fe was 0.0 mol, each amount being per mol of silver. The emulsion was washed with water by a conventional flocculation method, and 30 g of gelatin was added thereto. The emulsion was divided into two equal parts. Emulsions C and D were prepared in the following manner.

Emulsion C

The pH of one emulsion part was adjusted to 5.9 and the pAg thereof was adjusted to 7.5. Subsequently, 2.8 mg of sodium thiosulfate and 4 mg of chloroauric acid were added thereto, and chemical sensitization was carried out at 60° C. to give optimum sensitivity. Subsequently, 75 mg of 4-hydroxy-6-methyl-1,3,3a,7-tetraazaindene was added thereto as a stabilizing agent.

Emulsion D

The pH of the other emulsion part was adjusted to 5.3 and the pAg thereof was adjusted to 7.5. Subsequently, 1.9 mg of sodium thiosulfate, 0.74 mg of N,N-dimethylselenourea, 3.4 mg of sodium benzenethiosulfonate, 0.85 mg of sodium benzenesulfinate and 4 mg of chloroauric acid were added thereto, and chemical sensitization was carried out to give optimum sensitivity. Subsequently, 75 mg of 4-hydroxy-6-methyl-1,3,3a,7-tetraazaindene was added thereto as a stabilizing agent.

A dye (Dye 4 or Dye 5) having the following structure was added to the resulting Emulsion C or D as shown in Table 14. Photographic performance was evaluated in the same manner as in Example 8 except that an interference filter having a peak at 780 nm was used in place of the interference filter having a peak at 633 nm. The results are shown in Table 14.

It will be understood from the results of Table 14 that when the spectral sensitizing dye such as Dye 4 or Dye 5 is used in the present invention, the sensitivity, gradation and suitability for running properties can be further improved.

EXAMPLE 10

Preparation of Emulsions

The same procedure as in the preparation of emulsion in Example 4 was repeated to obtain Emulsion A which was sensitized by the gold/sulfur sensitizing agents and Emulsion B which was sensitized by the gold/sulfur/selenium sensitizing agent, except that ammonium hexabromorhodate (III) used in Solution 3 of Table 4 in Example 4 and $K_4Fe(CN)_6$ used in Solution 5 of Table 4 in Example 4 were excluded from each the solutions.

Separately, the same procedure as in the preparation of emulsion in Example 4 was repeated to obtain Emulsion C which was sensitized by the gold/sulfur/selenium sensitizing agent, except that ammonium hexabromorhodate(III) and potassium hexachloroiridate(III) used in Solution 3 of Table 4 in Example 4 and $K_4Fe(CN)_6$ used in Solution 5 of Table 4 in Example 4 was excluded from each the solutions.

Preparation of Coated Samples

The Emulsions A, B and C prepared above each was diluted with gelatin to form each of Emulsions A-(1) to A-(4), B-(1) to B-(3) and C-(1) to C-(3), respectively. Ortho-sensitizing Dye A-6 in an amount of 200 mg per mol of Ag were added thereto, and ortho-sensitization was carried out.

(Dye 4)

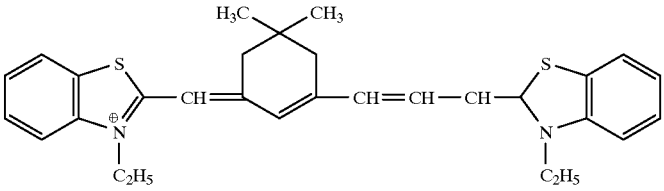

(Dye 5)

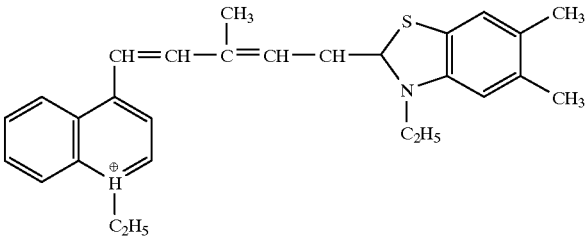

TABLE 14

| Sample No. | Emulsion | Sensitizing Dye Type | Sensitizing Dye Amount (mg/mol of Ag) | Relative Sensitivity Blue | Relative Sensitivity 780 nm | 780 nm Gradation | Suitability for Running |
|---|---|---|---|---|---|---|---|
| 11 | C | — | — | 100 | — | — | — |
| 12 | D | — | — | 126 | — | — | — |
| 13 | C | Dye 4 | 30 | 80 | 100 | 7.8 | 0.04 |
| 14 | D | Dye 4 | 30 | 100 | 136 | 8.6 | 0.0 |
| 15 | C | Dye 5 | 30 | 88 | 120 | 8.0 | 0.03 |
| 16 | D | Dye 5 | 30 | 100 | 158 | 8.8 | 0.0 |

The thus-obtained emulsions were coated by the same manner as in Example 4 to prepare Samples 1 to 10 shown in Table 15.

Dye A-6

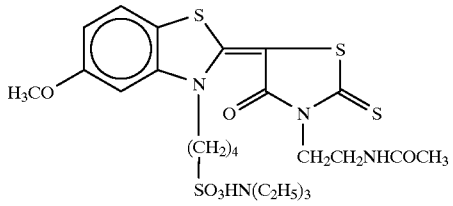

Evaluation of Samples

Evaluation was carried out in the same manner as in Example 4. The results are shown in Table 15.

TABLE 15

| Sample No. | Emulsion | Coating weight of Gelatin ($g/m^2$) Emulsion Layer | Lower Protective Layer | Upper Protective Layer | Dependence of Processing on Composition of Solution $\Delta S_{3.0}$ | Remarks |
|---|---|---|---|---|---|---|
| 1 | A-(1) | 1.0 | 0.25 | 0.25 | 0.30 | Comparison |
| 2 | (2) | 1.5 | 0.25 | 0.25 | 0.31 | Comparison |
| 3 | (3) | 2.0 | 0.25 | 0.25 | 0.33 | Comparison |
| 4 | (4) | 2.5 | 0.25 | 0.25 | 0.33 | Comparison |
| 5 | B-(1) | 1.0 | 0.25 | 0.25 | 0.13 | Invention |
| 6 | (2) | 1.5 | 0.25 | 0.25 | 0.15 | Invention |
| 7 | (3) | 2.0 | 0.25 | 0.25 | 0.15 | Invention |
| 8 | C-(1) | 1.0 | 0.25 | 0.25 | 0.25 | Comparison |
| 9 | (2) | 1.5 | 0.25 | 0.25 | 0.28 | Comparison |
| 10 | (3) | 2.0 | 0.25 | 0.25 | 0.27 | Comparison |

As is apparent from the results of Table 15, the dependence of processing on the composition of the processing solution can be first improved by combination use of the iridium compound and the selenium sensitizing agent.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer containing silver halide grains, wherein a silver chloride content of the silver halide grains contained in said light-sensitive silver halide emulsion layer is at least 30 mol %, and a silver iodide content of said silver halide grains is from 0 to not higher than 2 mol %; wherein said emulsion contains from $1\times10^{-9}$ to $1\times10^{-6}$ mol per mol of silver of a rhodium compound; and wherein said silver halide grains have been selenium-sensitized and sulfur sensitized.

2. The silver halide photographic material as in claim 1, wherein said light-sensitive silver halide emulsion contains at least one compound selected from the group consisting of an iron compound, a rhenium compound, a ruthenium compound and a osmium compound, in an amount greater than zero but not greater than $1\times10^{-3}$ mol, per mol of silver.

3. The silver halide photographic material as in claim 1, wherein the silver halide grains have been selenium-sensitized by a selenium compound represented by formula (VI-a) or (VI-b):

(VI-a)

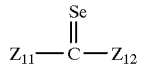

wherein $Z_{11}$ and $Z_{12}$ may be the same or different and each represents an alkyl group, an alkenyl group, an aralkyl group, an aryl group, a heterocyclic group, $—NR_{11}(R_{12})$, $—OR_{13}$ or $—SR_{14}$; and wherein $R_{11}$ and $R_{12}$ may be the same or different and each represents a hydrogen atom, an acyl group, an alkyl group, an aryl group or a heterocyclic group; $R_{13}$ and $R_{14}$ may be the same or different and each represents an alkyl group, an aryl group or a heterocyclic group;

(VI-b)

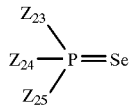

wherein $Z_{23}$, $Z_{24}$ and $Z_{25}$ may the same or different and each represents an aliphatic group, an aromatic group, a heterocyclic group, $—OR_{27}$, $—NR_{28}(R_{29})$, $—SR_{30}$, $—SeR_{31}$, a halogen atom or a hydrogen atom; $R_{27}$, $R_{30}$ and $R_{31}$ each represents an aliphatic group, an aromatic group, a heterocyclic group, a hydrogen atom or a cation; $R_{28}$ and $R_{29}$ each represents an aliphatic group, an aromatic group, a heterocyclic group or a hydrogen atom.

4. The silver halide photographic material as in claim 3, wherein the alkyl group represented by $R_{11}$, $R_{12}$, $R_{13}$ and $R_{14}$, is an aralkyl group.

5. The silver halide photographic material as in claim 1, wherein the silver halide grains have been sensitized by using at least $1\times10^{-8}$ mol per mol silver halide of a selenium sensitizing agent.

6. The silver halide photographic material as in claim 1, wherein the silver halide emulsion contains at least one polyhydroxybenzene compound represented by formula (VII-a), (VII-b) or (VII-c):

(VII-a)

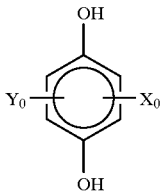

(VII-b)

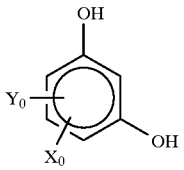

(VII-c)

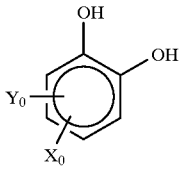

wherein $X_0$ and $Y_0$ each represents —H, —OH, a halogen atom, —OM wherein M is an alkali metal ion, an alkyl group, a phenyl group, an amino group, a carbonyl group, a sulfone group, a carboxyl group, an alkyl ether group, an alkyl thioether group or a phenylthioether group.

7. The silver halide photographic material as in claim 6, wherein the alkyl group represented by $X_0$ and $Y_0$ is a sulfonated alkyl group, a carboxyalkyl group or a hydroxyalkyl group, wherein the phenyl group represented by $X_0$ and $Y_0$ is a sulfonated phenyl group, a carboxyphenyl group, a hydroxyphenyl group, or an alkylphenyl group, and wherein the amino group represented by $X_0$ and $Y_0$ is a sulfonated amino group, or a carboxyamino group, and wherein the carbonyl represented by $X_0$ and $Y_0$ is a sulfonated carbonyl group.

8. The silver halide photographic material as in claim 1, wherein the silver halide grains have a cubic form or a plate form and have a mean grain size of 0.01 to 0.4 $\mu$m.

* * * * *